US012539993B2

(12) United States Patent
Ghosh et al.

(10) Patent No.: US 12,539,993 B2
(45) Date of Patent: Feb. 3, 2026

(54) SYSTEMS AND METHODS FOR WRAPPING COILS

(71) Applicant: Signode India Ltd., Hyderabad (IN)

(72) Inventors: Sanjoy Ghosh, Hyderabad (IN); Srungari Ramu, Hyderbad (IN)

(73) Assignee: Signode India Ltd., Hyderabad (IN)

( * ) Notice: Subject to any disclaimer, the term of this patent is extended or adjusted under 35 U.S.C. 154(b) by 0 days.

(21) Appl. No.: 18/854,351

(22) PCT Filed: Mar. 2, 2023

(86) PCT No.: PCT/IN2023/050194
§ 371 (c)(1),
(2) Date: Oct. 4, 2024

(87) PCT Pub. No.: WO2023/199340
PCT Pub. Date: Oct. 19, 2023

(65) Prior Publication Data

US 2025/0223066 A1 Jul. 10, 2025

(30) Foreign Application Priority Data

Apr. 15, 2022 (IN) ..... 202241022479

(51) Int. Cl.

| | |
|---|---|
| ***B65B 11/58*** | (2006.01) |
| ***B65B 11/04*** | (2006.01) |
| ***B65B 25/14*** | (2006.01) |
| ***B65B 25/24*** | (2006.01) |

(52) U.S. Cl.
CPC ..... *B65B 11/58* (2013.01); *B65B 11/04* (2013.01); *B65B 25/146* (2013.01); *B65B 25/24* (2013.01); *B65B 2210/20* (2013.01)

(58) Field of Classification Search
CPC ..... B65B 11/04; B65B 11/58; B65B 11/045; B65B 25/24; B65B 25/146; B26B 2210/20
See application file for complete search history.

(56) References Cited

U.S. PATENT DOCUMENTS

| | | | |
|---|---|---|---|
| 2,057,061 | A | 10/1936 | Eggerss |
| 4,204,377 | A | 5/1980 | Lancaster |
| 4,322,262 | A | 3/1982 | Cottam |
| 4,413,463 | A | 11/1983 | Lancaster |

(Continued)

FOREIGN PATENT DOCUMENTS

| | | | |
|---|---|---|---|
| CN | 1225881 | A | 8/1999 |
| CN | 2590874 | Y | 12/2003 |

(Continued)

OTHER PUBLICATIONS

"International Search Report and Written Opinion", from corresponding International Patent Application No. PCT/IN2023/050194, Dec. 13, 2023.

(Continued)

*Primary Examiner* — Andrew M Tecco
(74) *Attorney, Agent, or Firm* — Neal, Gerber & Eisenberg LLP

(57) ABSTRACT

Various embodiments of the present disclosure provide a coil-wrapping system (30) that simultaneously employs separate multiple film rolls (FR1, FR2) to simultaneously wrap separate films around a single coil while the coil is rotated about its longitudinal axis.

13 Claims, 46 Drawing Sheets

(56) References Cited

U.S. PATENT DOCUMENTS

| | | | | |
|---|---|---|---|---|
| 4,418,510 | A | 12/1983 | Lancaster | |
| 4,497,159 | A | 2/1985 | Lancaster | |
| 4,545,182 | A | 10/1985 | Mcdowell | |
| 4,553,374 | A | 11/1985 | Lancaster et al. | |
| 4,714,211 | A | 12/1987 | Hwang | |
| 4,829,753 | A * | 5/1989 | Bricmont | B65B 27/06 53/204 |
| 4,862,678 | A | 9/1989 | Humphrey | |
| 5,282,347 | A | 2/1994 | Cleine et al. | |
| 5,414,979 | A | 5/1995 | Moore et al. | |
| 5,447,009 | A | 9/1995 | Oleksy et al. | |
| 5,755,083 | A | 5/1998 | Cleine | |
| 5,779,179 | A | 7/1998 | Zentmyer et al. | |
| 5,829,234 | A | 11/1998 | Suolahti | |
| 5,904,094 | A | 5/1999 | Bredenberg | |
| 5,983,598 | A | 11/1999 | Quinones | |
| 6,006,498 | A | 12/1999 | Cleine | |
| 6,082,081 | A | 7/2000 | Mucha | |
| 6,192,653 | B1 | 2/2001 | Maekawa et al. | |
| 6,247,294 | B1 | 6/2001 | Suolahti | |
| 6,305,145 | B2 | 10/2001 | Suolahti | |
| 6,324,820 | B1 | 12/2001 | Gelfman et al. | |
| 6,446,418 | B1 | 9/2002 | Maekawa et al. | |
| 6,520,445 | B2 | 2/2003 | Araujo | |
| 6,594,976 | B1 | 7/2003 | Chikamitsu et al. | |
| 6,688,076 | B1 * | 2/2004 | Rivera, Jr. | B65B 25/24 53/204 |
| 6,699,346 | B1 | 3/2004 | Habisreitinger et al. | |
| 6,705,060 | B1 * | 3/2004 | McGuinness | B65B 25/24 53/409 |
| 6,742,322 | B2 | 6/2004 | Qicang | |
| 6,761,298 | B1 | 7/2004 | Cantrell | |
| 6,772,573 | B2 | 8/2004 | Federeszyn | |
| 6,775,961 | B2 | 8/2004 | Cook et al. | |
| 6,851,252 | B2 | 2/2005 | Maeki-Rahkola et al. | |
| 7,134,260 | B2 | 11/2006 | Haloila | |
| 7,356,976 | B2 | 4/2008 | Tosa | |
| 7,757,463 | B2 | 7/2010 | Boehl | |
| 7,837,140 | B2 | 11/2010 | Zitella et al. | |
| 7,963,087 | B2 | 6/2011 | Laensikallio | |
| 8,037,661 | B2 | 10/2011 | Albert et al. | |
| 8,650,836 | B2 | 2/2014 | Albert et al. | |
| 9,320,199 | B2 | 4/2016 | Smith et al. | |
| 10,370,131 | B2 | 8/2019 | Quinones | |
| 10,472,115 | B2 | 11/2019 | Clarke | |
| 10,583,945 | B2 | 3/2020 | Cere' et al. | |
| 10,604,287 | B2 * | 3/2020 | Tegström | B65B 11/045 |
| 11,066,198 | B2 | 7/2021 | Brizek et al. | |
| 12,049,334 | B2 | 7/2024 | Olsson et al. | |
| 12,246,867 | B2 | 3/2025 | Robèrt et al. | |
| 2008/0168643 | A1 * | 7/2008 | Albert | B65B 25/24 29/700 |
| 2010/0257816 | A1 | 10/2010 | Albert et al. | |
| 2010/0287882 | A1 | 11/2010 | Alberti et al. | |
| 2016/0272351 | A1 * | 9/2016 | Faehrenkaemper | B65B 25/24 |
| 2018/0072441 | A1 * | 3/2018 | Tegström | B65B 25/24 |
| 2023/0182940 | A1 | 6/2023 | Robèrt et al. | |

FOREIGN PATENT DOCUMENTS

| | | | |
|---|---|---|---|
| CN | 104670546 | A | 6/2015 |
| CN | 104709489 | A | 6/2015 |
| CN | 107380508 | A | 11/2017 |
| CN | 108163246 | A | 6/2018 |
| DE | 1192094 | B | 4/1965 |
| DE | 19954007 | A1 | 12/2000 |
| EP | 0220712 | A1 | 5/1987 |
| EP | 0544312 | A1 | 6/1993 |
| EP | 0936141 | A1 | 8/1999 |
| EP | 1468946 | A2 | 10/2004 |
| EP | 1568638 | A1 | 8/2005 |
| EP | 2019061 | A1 | 1/2009 |
| EP | 2862823 | A1 | 4/2015 |
| EP | 3070008 | A1 | 9/2016 |
| EP | 3303149 | B1 | 10/2020 |
| EP | 3947165 | A1 | 2/2022 |
| FR | 2631922 | A1 | 12/1989 |
| FR | 2932457 | A1 | 12/2009 |
| GB | 2043021 | A | 10/1980 |
| GB | 2153792 | A | 8/1985 |
| JP | 2018157789 | A | 10/2018 |
| KR | 102124253 | B1 | 6/2020 |
| WO | 9519913 | A1 | 7/1995 |
| WO | 2007128885 | A1 | 11/2007 |
| WO | 2008085702 | A1 | 7/2008 |
| WO | 2023249546 | A1 | 12/2023 |

OTHER PUBLICATIONS

"RL Automatic Stretch Wrapper Roll Change", Lantech, available at https://www.youtube.com/watch?v=mey0iYG93k8, Sep. 25, 2018.

Notification of Reasons for Rejection with English translation, from corresponding Japanese Patent Application No. 2024-560849, Sep. 2, 2025.

* cited by examiner

SYSTEMS AND METHODS FOR WRAPPING COILS

PRIORITY

This application is a national phase application of and claims priority to and the benefit of PCT/IN2023/050194, filed on Mar. 2, 2023, which claims priority to and the benefit of India patent application No. 202241022479, filed Apr. 15, 2022, the entire contents of which is incorporated herein by reference.

FIELD

The present disclosure relates to systems and methods for wrapping coils with film.

BACKGROUND

Many steel manufacturers produce relatively large coils of steel sheet or strip that are then shipped to their customers for use or further processing. FIG. 1 shows one such example coil C. The coil C has a cylindrical outer surface OS, a relatively flat annular first side surface SS1, a relatively flat annular second side surface SS2 opposite the first side surface SS1, and a cylindrical inner surface IS that extends between the side surfaces SS1 and SS2. The cylindrical inner surface IS defines a cylindrical central opening that is referred to herein as the "eye" E of the coil C and that extends between the opposing side surfaces SS1 and SS2. The coil C has a longitudinal axis LA that extends through the center of the eye E.

To prevent the coils from unrolling, circumferential straps (not shown) are typically applied around the outer cylindrical surface OS of the coil C and/or through-the-eye straps (not shown) are applied through the eye E and around the outer surface OS of the coil C such that they engage the inner and outer surfaces IS and OS of the coil C. While these straps prevent coils from unrolling, they do not protect coils from the elements or from damage during transit. If a customer desires this additional protection, the manufacturer typically wraps the coil with plastic stretch film. To do so, the manufacturer typically installs one of several known coil-wrapping systems in the manufacturing line. These known systems all use a single roll of plastic stretch film to wrap the coils. And while these known systems are different, they typically transfer the film roll through the eye of the coil and around its outer surface in repeated loops while rotating the coil along its longitudinal axis. These wrapping processes are relatively slow and can require an operator to replace an empty film roll with a replacement film roll during the coil wrapping process.

SUMMARY

Various embodiments of the present disclosure provide coil-wrapping systems and methods for simultaneously employing multiple separate film rolls to simultaneously wrap separate films (such as plastic films) on a coil while the coil is rotated about its longitudinal axis.

Various embodiments of the present disclosure provide mandrels for the film rolls that assist in maintaining tension on the films thereof before, during, and after the wrapping process by a coil-wrapping system.

Various embodiments of the present disclosure provide mandrel grippers that receive, hold, and release the mandrels and the film rolls mounted on the mandrels.

Various embodiments of the present disclosure provide a film-roll-change system and related methods for automatically replacing empty film rolls with new film rolls.

BRIEF DESCRIPTION OF THE FIGURES

FIG. 1NJ shows a fully wrapped coil.

DETAILED DESCRIPTION

Figure 1:
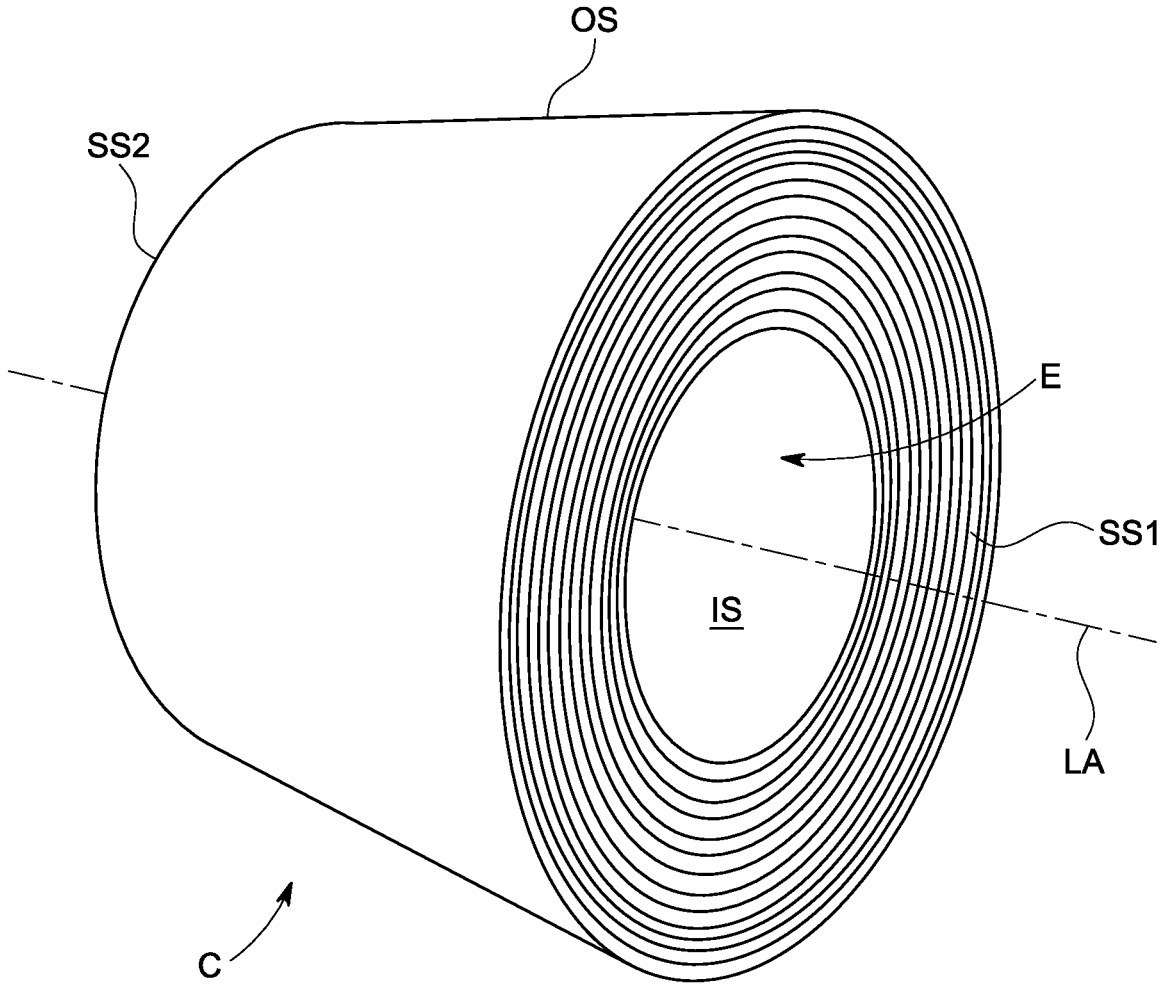
FIG. 1 is a perspective view of an example coil that is wrappable by the coil-wrapping system of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Coil-Wrapping System

Various embodiments of the present disclosure provide a coil-wrapping system that wraps a coil (such as the coil C described above) with film by simultaneously moving multiple film rolls through the eye E and around the outer surface OS of the coil C while the coil C is rotated about its longitudinal axis LA. FIGS. 1A, 1B, 1C, and 1L show one example coil-wrapping system 20 of the present disclosure and components thereof. The coil-wrapping system 20 includes: a coil-wrapping apparatus 30 for wrapping coils such as example coil C (described above), infeed and outfeed coil movers (not shown) for moving coils into the coil-wrapping apparatus 30 for wrapping and from the coil-wrapping apparatus 30 after wrapping, a coil rotator 500 for supporting and rotating each coil about its longitudinal axis during wrapping, a film-roll-change system 50 for receiving empty film rolls from the coil-wrapping apparatus 30 and for supplying new film rolls to the coil-wrapping apparatus 30, multiple sensors S, an operator interface OI, and a controller CR. For purposes of this disclosure, an empty film roll can be a completely empty film roll (that has no film left) or a near empty film roll (such as a film roll that has an insufficient amount of film to wrap a next coil).

Movements and components (described below) of the example coil-wrapping system 20 extending in the same direction as the longitudinal axis (such as parallel to the longitudinal axis LA) of the coil C as described above are sometimes described herein as longitudinal movements or components, and movements and components of the example coil-wrapping system 20 extending in the direction transverse to the longitudinal axis LA (such as perpendicular to the longitudinal axis LA) of the coil C are sometimes described herein as transverse movements or components.

Coil-Wrapping Apparatus

FIGS. 1A, 1B, 1C, 1D, 1E, and 1L show the coil-wrapping apparatus 30 and components thereof that are configured to simultaneously wrap each coil C with multiple film rolls (such as film rolls FR1 and FR2). The coil-wrapping apparatus 30 includes: a machine frame 60, a first wrapper 100 slidably mounted to the machine frame 60, a first-carriage actuator 110 operably connected to the first wrapper 100 via a first drive train 111 and configured to vertically slide the first wrapper 100 relative to the machine frame 60, a second wrapper 300 slidably mounted to the machine frame 60, and a second-carriage actuator 310 operably connected to the second wrapper 300 via a second drive train 311 and configured to vertically slide the second wrapper 300 relative to the machine frame 60.

Machine Frame, Coil Rotator, and Infeed and Outfeed Coil Movers

Figure 1A:
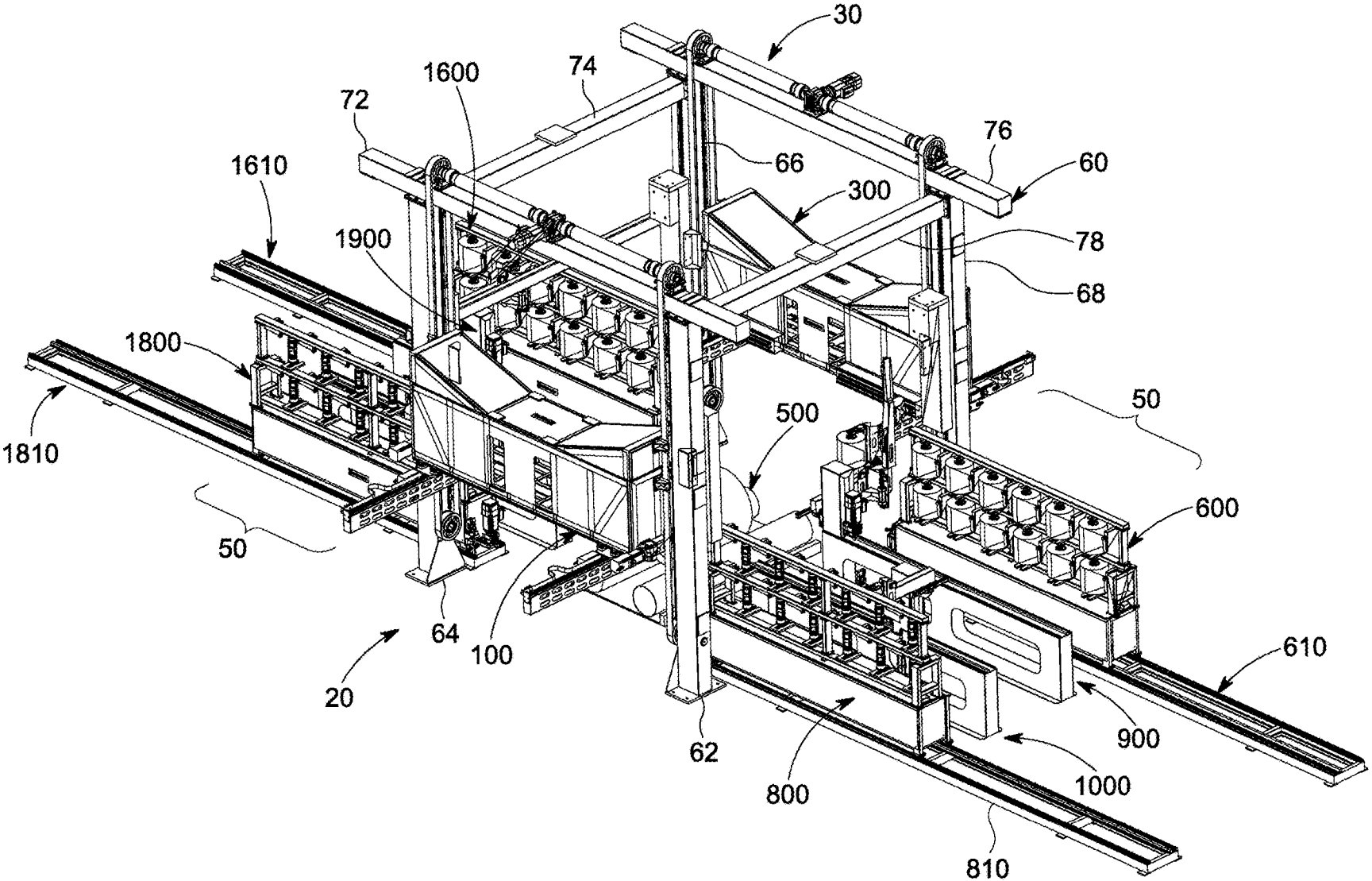
FIG. 1A is a top perspective view of a coil-wrapping system including a coil-wrapping apparatus and a film-change system of one example embodiment of the present disclosure.
Figure 1B:
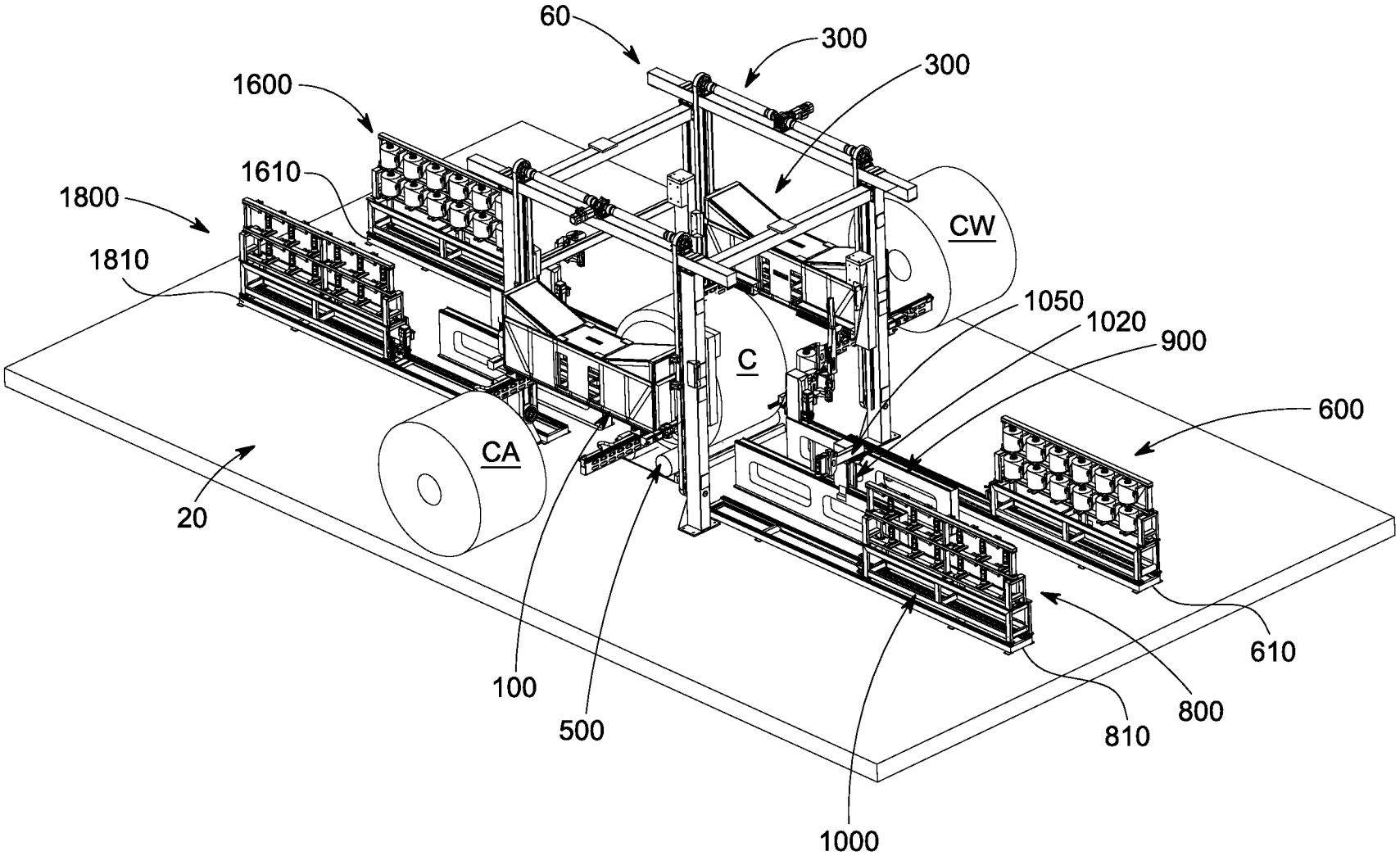
FIG. 1B is another top perspective view of the coil-wrapping system of FIG. 1A and coils positioned with respect to the coil-wrapping system.
Figure 1C:
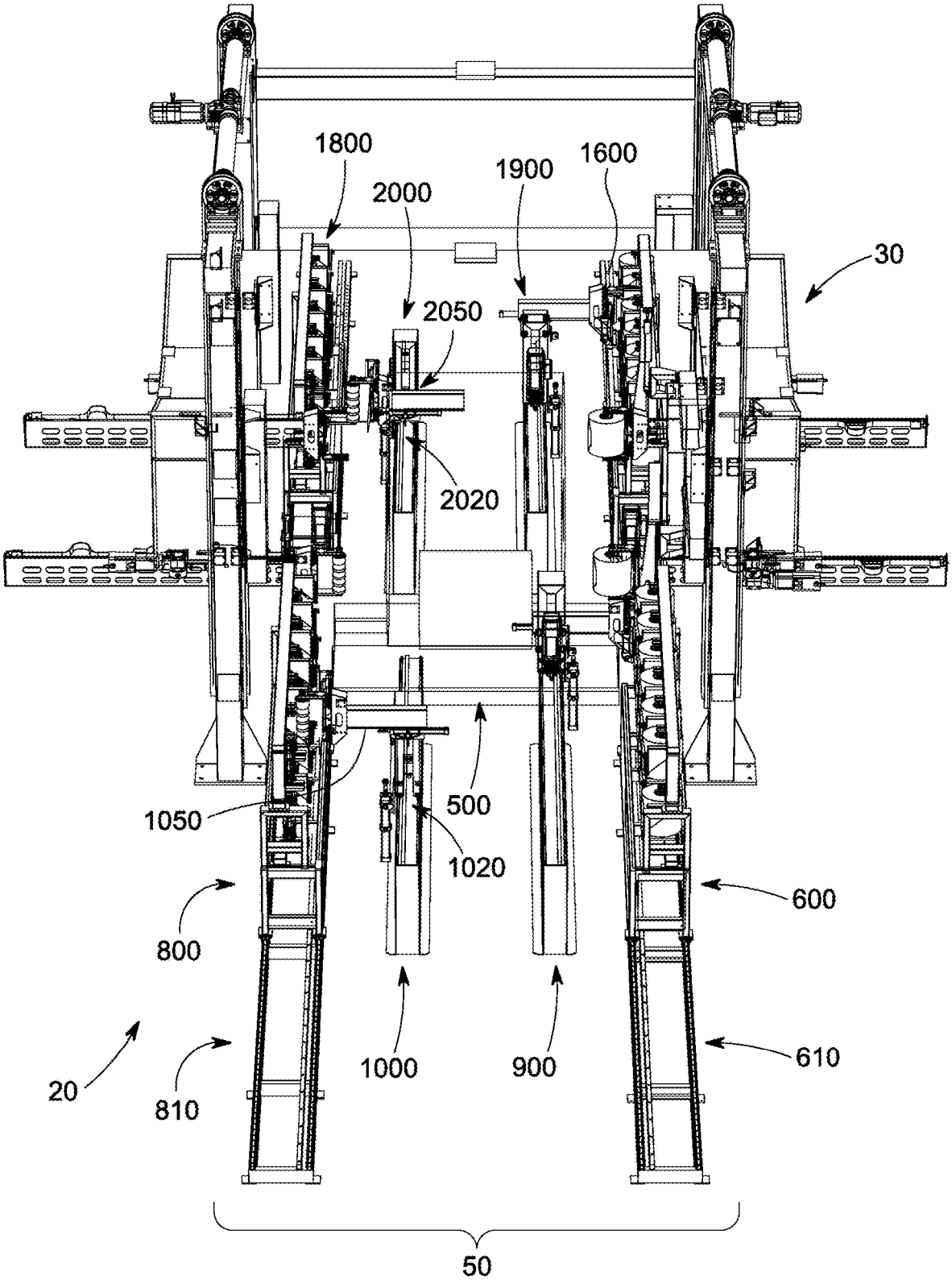
FIG. 1C is an end perspective view of the coil-wrapping system of FIG. 1A.
Figure 1D:
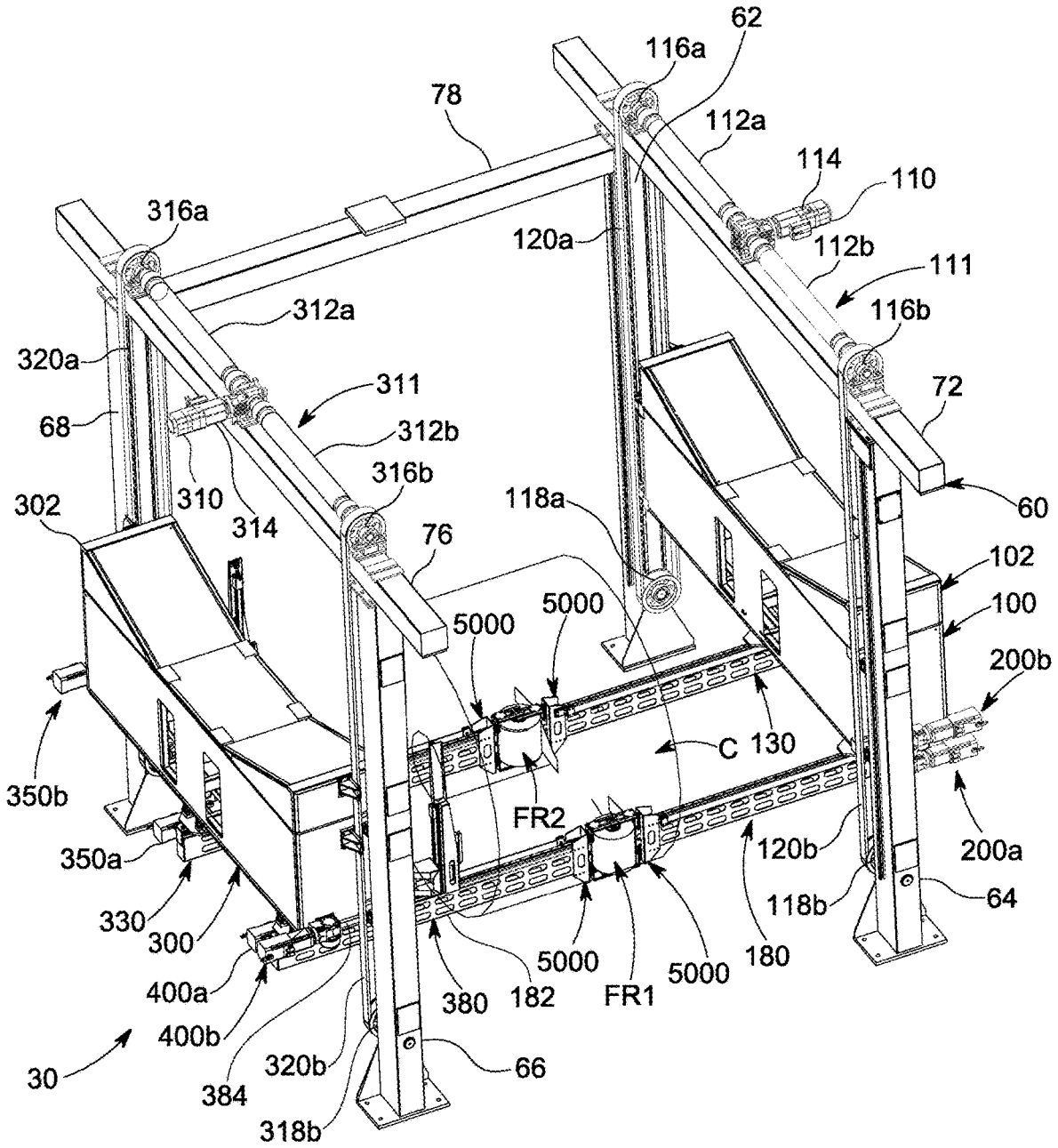
FIG. 1D is a top end perspective view of the coil-wrapping apparatus of FIG. 1A.
Figure 1E:
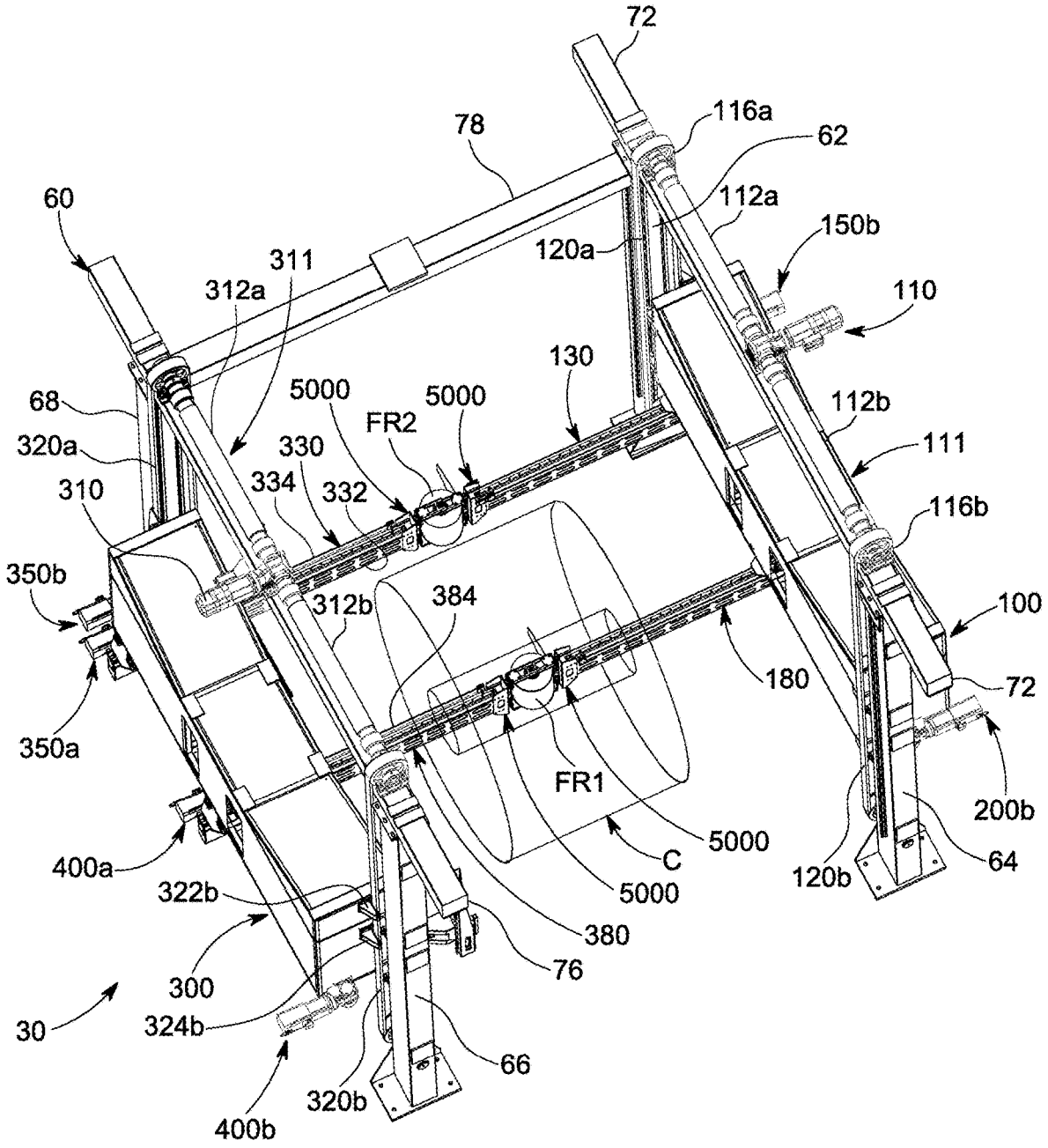
FIG. 1E is a top perspective view of the coil-wrapping apparatus of FIG. 1A.

The machine frame 60, as best shown in FIGS. 1D and 1E, is formed from multiple tubular and/or solid members and other elements (not individually labeled) and supports certain of the components of the coil-wrapping apparatus 30, and particularly movably supports the first wrapper 100 and the second wrapper 300. The machine frame 60 includes four spaced apart upstanding legs 62, 64, 66, and 68 and four crossbars 72, 74, 76, and 78. Crossbar 72 connects leg 62 to leg 64, crossbar 74 connects leg 64 to leg 66, crossbar 76 connects leg 66 to leg 68, and crossbar 78 connects leg 68 to leg 62. Legs 62 and 64 and crossbar 72 support the first wrapper 100 including its actuator 110 and its drive train 111. Specifically, opposing vertically extending rails (not labeled) are connected to the legs 62 and 64 and slidably support opposite ends of the first wrapper 100. Likewise, legs 66 and 68 and crossbar 76 support the second wrapper 300 including its actuator 310 and its drive train 311. Specifically, opposing vertically extending rails (not labeled) are connected to the legs 66 and 68 and slidably support the second wrapper 300.

The machine frame 60 defines: (a) a rectangular interior coil wrapping area (not labeled) bounded by the four spaced apart upstanding legs 62, 64, 66, and 68; (b) an exterior coil infeed area (not labeled) on one side of frame 60 and particularly adjacent to legs 62 and 64; and (c) an exterior coil outfeed area (not labeled) on an opposite side of frame 60 and particularly adjacent to legs 66 and 68. FIG. 1B illustrates a first coil CA in the exterior coil infeed area (waiting to be moved into the coil wrapping area), a second coil C in the interior coil wrapping area (on the coil rotator 500 in a position to be wrapped), and a third coil CW in the exterior coil outfeed area (after being wrapped and moved out of the coil wrapping area).

The illustrated machine frame 60 is merely one example configuration, and any suitable configuration of the machine frame can be employed in accordance with the present disclosure.

The coil rotator 500, as best shown in FIGS. 1A, 1B, 1C, and 1J, includes a coil rotator frame 510 (partially shown), two cylindrical coil engagers 520 and 530 supported by the coil rotator frame 510, and one or more coil engager actuators 540 supported by the coil rotator frame 510 and operably coupled to one or both of the coil engagers 520 and 530. The coil rotator 500, under control of the controller CR, causes the coil engager actuator 540 to rotate, at a desired speed, a coil C positioned on the cylindrical coil engagers 520 and 530 about the longitudinal axis LA of the coil C during wrapping of the coil C.

The coil-wrapping apparatus 30 includes or operates with a related infeed coil mover 550 that, under control of the controller CR, moves each awaiting coil (such as coil CA) that needs to be wrapped from the exterior coil infeed area under the first wrapper 100 when the first wrapper 100 is in a raised position (not shown but discussed below) and into the interior coil wrapping area and onto the coil engagers 520 and 530 of the coil rotator 500 for wrapping by the first and second wrappers 100 and 300, as discussed below. The coil-wrapping apparatus 30 also includes or operates with a related outfeed coil mover 560 that, under control of the controller CR, after a coil C is wrapped, moves the wrapped coil from the coil rotator 500 in the coil wrapping area under the second wrapper 300 when the second wrapper 300 is in a raised position (not shown but discussed below) to the exterior coil outfeed area. The wrapped coil (such as coil CW) can then be transported.

The first wrapper 100 and the second wrapper 300 are supported by the machine frame 60 in a manner that enables them to respectively independently move vertically upwardly to their respective raised positions to enable each coil to move under the wrappers (as described above) and vertically downwardly into their respective wrapping positions. More specifically, the first wrapper 100 is slidably mounted to and vertically movable relative to the machine frame 60 among a raised position (not shown) in which the first wrapper 100 is adjacent the crossbar 72, a coil-wrapping position (shown in FIGS. 1A to 1E) below the raised position, and a film-change position below the raised position. When the first wrapper 100 is in the raised position, there is enough clearance beneath the first wrapper 100 to enable the infeed coil mover 550 to move a coil onto the coil rotator 500. When the second wrapper 300 is in the coil-wrapping position, the first wrapper 100 is operable, under the control of the controller CR and along with the second wrapper 300, to wrap a coil C in the coil wrapping area (as described below). When the first wrapper 100 is in the film-change position, the first wrapper 100 is operable to transfer empty (or near-empty) film rolls to the film-change apparatus 50.

Likewise, the second wrapper 200 is slidably mounted to and vertically movable relative to the machine frame 60 among a raised position (not shown) in which the second wrapper 300 is adjacent the crossbar 76, a coil-wrapping position (shown in FIGS. 1A to 1E) below the raised position, and a film-change position below the raised position. When the second wrapper 300 is in the raised position, there is enough clearance beneath the second wrapper 300 to enable the outfeed coil mover 560 to move a coil from the coil rotator 500. When the second wrapper is in the coil-wrapping position, the second wrapper 300 is operable, under the control of the controller CR, and along with the first wrapper 100, to wrap a coil C in the coil wrapping area (as described below). When the second wrapper 300 is in the film-change position, the second wrapper 300 is operable to receive replacement film rolls from the film-change apparatus 50.

First-Carriage Actuator and First Drive Train for the First Wrapper

Figure 1F:
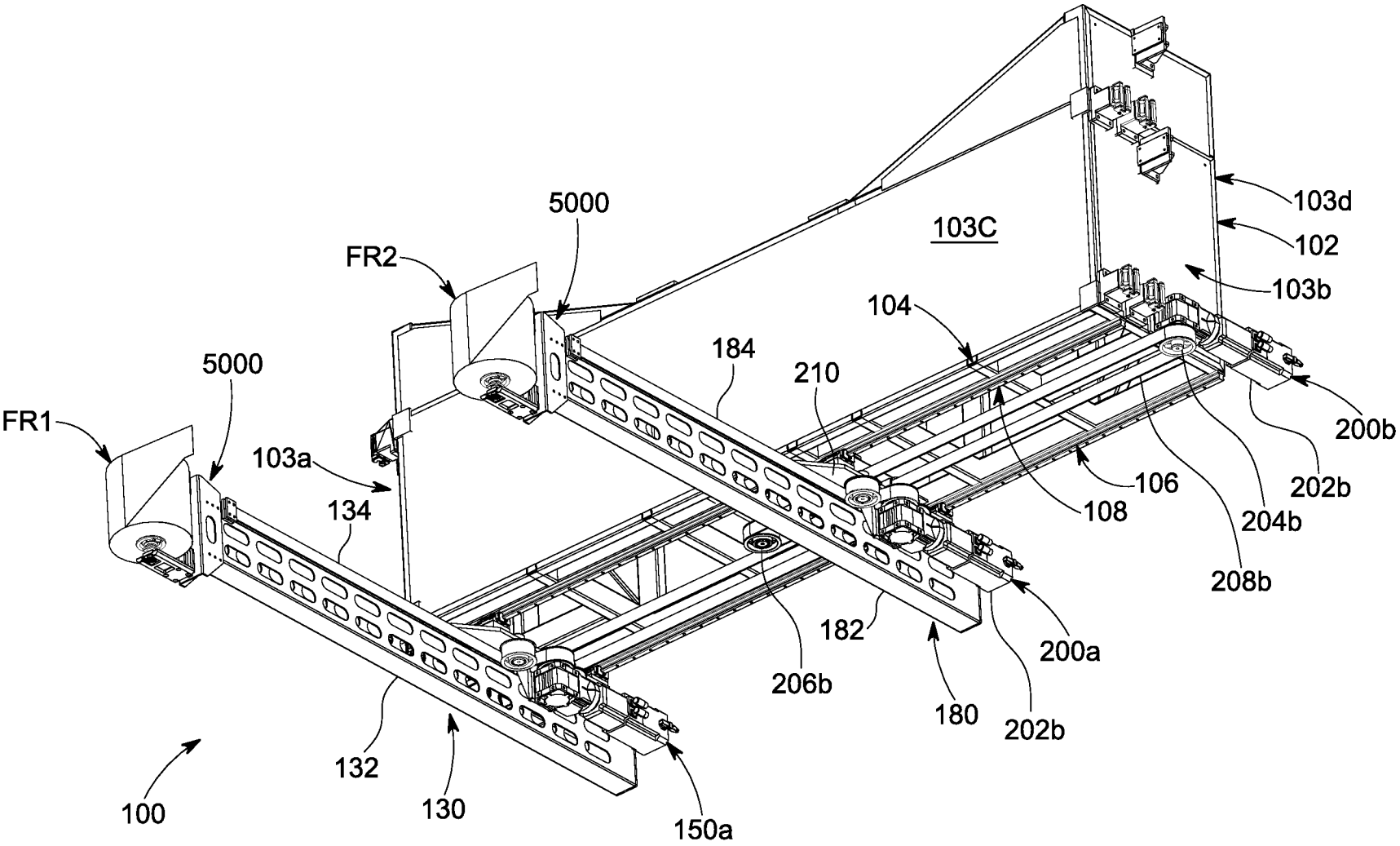
FIG. 1F is a bottom perspective view of the first wrapper of the coil-wrapping system of FIG. 1A.

The first-carriage actuator 110 and the first drive train 111, as best shown in FIGS. 1E and 1F, are operably connected to the first wrapper 100 and configured to move the first wrapper 100 relative to the machine frame 60 among its raised, coil-wrapping, and film-change positions. The first carriage actuator 110 includes an electric motor in this example embodiment, though it can include any other suitable actuator in other embodiments. The first drive train 111 includes drive shafts 112*a* and 112*b* each having one end connected to the first carriage actuator 110, spaced apart drive wheels 116*a* and 116*b* respectively connected to opposite ends of the drive shafts 112*a* and 112*b* and rotatably supported by the machine frame 60; spaced apart driven wheels 116*a* and 116*b* connected to and rotatably supported by the machine frame 60, respectively; spaced apart follower wheels 118*a* and 118*b* connected to and rotatably supported by the machine frame 60, respectively; a drive belt 120*a* wrapped around and extending between wheels 116*a* and 118*a*; a drive belt 120*b* wrapped around and extending between wheels 116*b* and 118*b*, first carriage connectors 122*a* and 124*a* (numbered but not shown for clarity) connecting the drive belt 120*a* to the first end of the carriage 102 of the first wrapper 100; and carriage connectors 122*b* and 124*b* (numbered but not shown for clarity) connecting the drive belt 120*b* to the second end of the carriage 102 of the first wrapper 100. In operation, to raise the first wrapper 100, the first-carriage actuator 110, under control of the controller CR, simultaneously rotates each of the drive shafts 112*a* and 112*b* to cause each of the spaced apart upper wheels 116*a* and 116*b* to rotate, which causes each of the drive belts 120*a* and 120*b* to rotate. The rotation of the drive belts 120*a* and 120*b* causes the upward movements of the first carriage connectors 122*a* and 124*a*, and the carriage connectors 122*b* and 124*b* cause the upward movement of the first carriage 102 of the first wrapper 100. This process is reversed to cause the downward movement of the first carriage 102 of the first wrapper 100.

First Wrapper

The first wrapper 100, as best illustrated in FIGS. 1D, 1E, 1F, and 1G, includes: a first carriage 102, a first applicator arm 130 slidably mounted to the first carriage 102, longitudinal and transverse first-applicator-arm actuators 150*a* and 150*b* supported by the first carriage 102 and operably connected to the first applicator arm 130 via a drive train (described below) and configured to move the first applicator arm 130 in the longitudinal and transverse directions relative to a coil C on the coil rotator 500, a second applicator arm 180 slidably mounted to the first carriage 102, and longitudinal and transverse second-applicator-arm actuators 200*a* and 200*b* supported by the first carriage 102 and operably connected to the second applicator arm 180 via a drive train (described below) and configured to move the second applicator arm 180 in the longitudinal and transverse directions relative to the coil C on the coil rotator 500.

First Carriage of the First Wrapper

As best illustrated in FIG. 1F, the first carriage 102 of wrapper 100 has a carriage frame 104 having a first end 103*a*, an opposite second end 103*b*, an interior side 103*c*, and an exterior side 103*d*. The carriage 102 transversely extends (relative to the longitudinal axis LA of the coil C on the coil rotator 500) from the first end 103*a* to the second end 103*b*. The carriage 102 longitudinally extends (relative to the longitudinal axis of the coil) from the interior side 103*c* to the exterior side 103*d*. The carriage frame 104 supports the first applicator arm 130 and associated first-applicator-arm actuators 150*a* and 150*b* and the second applicator arm 180 and associated second-applicator-arm actuators 200*a* and 200*b*. The carriage 102 includes two spaced apart transversely extending tracks 106 and 108 connected to the bottom of the carriage frame 104. The first applicator arm 130 and the second applicator arm 180 are each respectively slidably coupled to the tracks 106 and 108 and are each independently transversely movable along the tracks 106 and 108 as described below.

First Applicator Arm of the First Wrapper

Figure 1G:
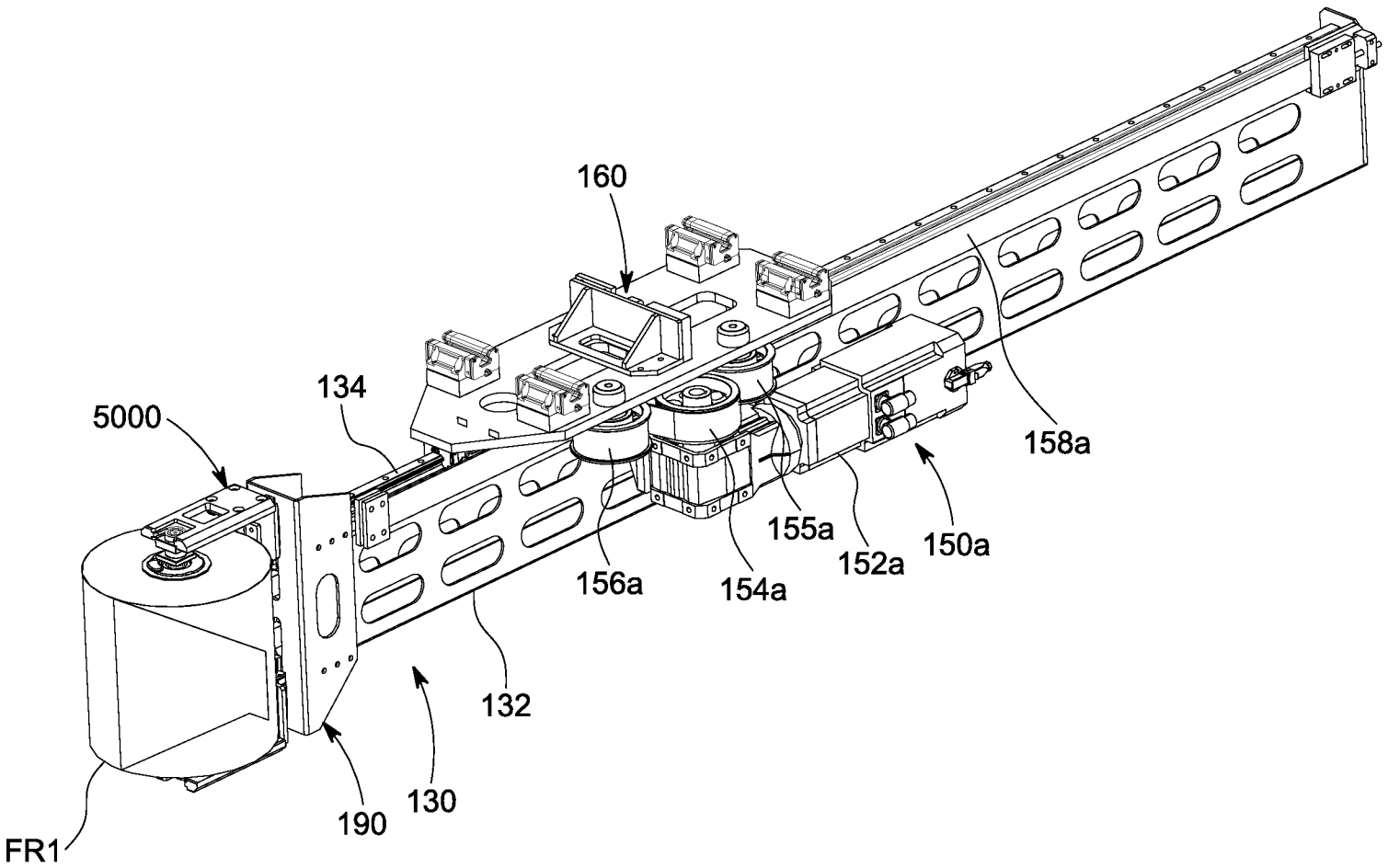
FIG. 1G is a top perspective view of the first applicator arm of the first wrapper of FIG. 1F.

The first applicator arm 130, as best illustrated in FIGS. 1F and 1G, includes an elongated frame 132, an elongated track 134 connected to the top of the elongated frame 132, and a gripper 5000 (described in detail below) connected to an inner end of the elongated frame 132. The first applicator arm 130 is slidably mounted to the carriage 102 via a trolley 160. Specifically, the trolley 160 is slidably mounted to the tracks 106 and 108 such that the trolley 160 can slide transversely relative to the carriage frame 104. The trolley 160 is slidably mounted to the track 134 such that the first applicator arm 130 can slide longitudinally relative to tracks 104 and 106.

The transverse first-applicator-arm actuator 150*b* is connected to the bottom of the carriage frame 104 and operably coupled to the first applicator arm 130. The transverse first-applicator-arm actuator 150*b*, under control of the controller CR, moves the first applicator arm 130 on the tracks 106 and 108 transversely (relative to the coil being wrapped) between an outer position adjacent to the first end 103*a* of the carriage 102 and an eye position aligned with the longitudinal axis of rotation of the coil. In other words, the transverse first-applicator-arm actuator 150*b*, under control of the controller CR, moves the first applicator arm 130 transversely to the coil between an outer position adjacent to the first end 103*a* of the carriage 102 and to an eye position adjacent to the central longitudinal axis of the coil.

Although not shown, the transverse first-applicator-arm actuator 150*b* is similar to the transverse second-applicator-arm actuator 200*b* that is shown in more detail in FIG. 1F.

The longitudinal first-applicator-arm actuator 150*a*, under control of the controller CR, moves the first applicator arm 130 longitudinally relative to the longitudinal axis of the coil C on the coil rotator 500 and the carriage 102 between a transfer position and a retracted position relative to the carriage 102. In other words, the longitudinal first-applicator-arm actuator 150*a*, at each of the outer position, the eye position, and each of the positions therebetween moves the arm 130 longitudinally relative to the coil and the carriage 102 between a transfer position and a retracted position.

More specifically, the longitudinal first applicator-arm actuator 150*a*, as best shown in FIG. 1G, includes an actuator 152*a* controlled by the controller CR and operably connected to a trolley 160 that is slidably connected to the carriage 102, a drive pulley 154*a* controlled by the actuator 152*a*, two control pulleys 155*a* and 156*a*, and a belt 158*a* connected to the frame 132 of the applicator arm 130. In operation, to longitudinally move the applicator arm 130, the actuator 152*a*, under control of the controller CR, rotates the drive pulley 154*a* to engage the belt 158*a* to cause the first applicator arm 130 to move longitudinally relative to the trolley 160. This rotation of the drive pulley 154*a* is reversed to cause the longitudinal movement of the applicator arm 130 in the opposite direction.

Second Applicator Arm of the First Wrapper

Similarly, the movable second applicator arm 180, as best illustrated in FIG. 1F, includes an elongated frame 182, an elongated track 184 connected to the top of the elongated frame 182, and a gripper 5000 connected to an inner end of the elongated frame 182. The second applicator arm 180 is slidably mounted to the carriage 102 via a trolley (not shown) that is slidably mounted to the tracks (not shown) such that the trolley can slide transversely relative to the carriage frame 104. The trolley is slidably mounted to the track 184 such that the second applicator arm 180 can slide longitudinally relative to tracks 104 and 106.

The transverse second-applicator-arm actuator 200*b* is stationary and connected to the bottom of the carriage frame 104 and supported by the carriage frame 104 of the carriage 102. The transverse-applicator-arm actuator 200*b*, under control of the controller CR, moves the second applicator arm 180 on the tracks 106 and 108 transversely relative to a coil on the coil rotator 500 and the carriage 102 between an outer position adjacent to the second end 103*b* of the carriage 102 to an eye position aligned with the longitudinal axis of rotation of the coil. In other words, the transverse second-applicator-arm actuator 200*b*, under control of the controller CR, moves the second applicator arm 180 transversely to the longitudinal axis of the coil and transverse to the carriage 102 and between an outer position adjacent to the second end 103*b* of the carriage 102 and to an eye position aligned with the central longitudinal axis of the coil.

More specifically, the transverse second-applicator-arm actuator 200*b*, as best shown in FIG. 1F, includes an actuator 202*b* connected to the carriage frame 104, and controlled by the controller CR, a first pulley 204*b* connected to the actuator 202*b*, a second pulley 206*b* connected to carriage frame 104, a drive belt 208*b* wrapped around and extending between pulley 204*b* and 206*b*, and a trolley 210 connected to the drive belt 208*a* and coupled to the track 184 of the second arm 180. The trolley 210 thus movably supports the applicator arm 180 for transverse movement while facilitating independent longitudinal movement of the second applicator arm 180. In operation, to transversely move the applicator arm 180, the actuator 202*b*, under control of the controller CR, rotates the pulley 204*b* to cause the drive belt 208*b* to rotate to cause the trolley 210 to move transversely and thus cause the second applicator arm 180 to move transversely. This rotation of the pulley 204*b* and the drive belt 208*b* is reversed to cause the trolley 210 and the second applicator arm 180 to move transversely in the opposite direction.

The longitudinal second-applicator-arm actuator 200*a*, under control of the controller CR, moves the second applicator arm 180 longitudinal relative to the carriage 102 between a transfer position relative to the interior side 103*c* of the carriage 102 to a retracted position relative to the interior side 103*c* of the carriage 102. In other words, the longitudinal second-applicator-arm actuator 200*a* at each of the outer positions, the eye positions, and each of the positions therebetween moves, under control of the controller, the arm 180 perpendicularly (and thus longitudinally) to the carriage 102 between a transfer position and a retracted position.

In alterative embodiments, the first applicator arm 130 and the second applicator arm 180 are movably connected to two or more separate carriages instead of the single carriage 102.

Second Wrapper, Second Carriage of the Second Wrapper, and Second-Carriage Actuator for the Second Wrapper Similar to the first carriage 102, as best shown in FIGS. 1D, 1E, 1H, and 1J, the second carriage 302 of wrapper 300 has a first end (not labeled), an opposite second end (not labeled), an interior side (not labeled), and an exterior side (not labeled). The carriage 302 transversely extends from the first end to the second end. The carriage 302 longitudinally extends from the interior side to the exterior side. The carriage 302 includes a carriage frame 304 that supports the third applicator arm 330 and longitudinal and transverse third applicator arm actuators 350*a* and 350*b*, and the fourth applicator arm 380 and longitudinal and transverse fourth applicator arm actuators 400*a* and 400*b*. The carriage 302 includes two spaced apart transversely extending tracks 306 and 308 connected to the bottom of the frame 304. The third applicator arm 330 and the fourth applicator arm 380 are respectively movably coupled to the tracks 306 and 308 and independently transversely movable along the tracks 306 and 308.

Similar to the first wrapper 100, the second wrapper 300 is vertically movable between a coil-wrapping position and a raised position that is above the coil-wrapping position. Similar to as described above for the first wrapper 100 and the first-carriage actuator 110, the second-carriage actuator 310, under operation of the controller CR, moves the second wrapper 300 upwardly and downwardly to these respective positions.

Similar to the first-carriage actuator 110, the second-carriage actuator 310 and the second drive train 311, as best shown in FIGS. 1E and 1F, are operably connected to the second wrapper 300 and configured to move the second wrapper 300 relative to the machine frame 60 among its raised, coil-wrapping, and film-change positions. The second-carriage actuator 310 includes an electric motor in this example embodiment, though it can include any other suitable actuator in other embodiments. The second drive train 311 includes drive shafts 312*a* and 312*b* connected to the cross bar 76 of the frame 60 and having inner ends connected to the second-carriage actuator 310; spaced apart upper drive wheels 316*a* and 316*b* respectively connected to opposite ends of the drive shafts 312*a* and 312*b* and connected to and rotatably supported by the cross bar 76; spaced apart lower follower wheels 318*a* and 318*b* connected to rotatably supported by the legs 68 and 66, respectively; drive belt 320*a* wrapped around and extending between wheels 316*a* and 318*a*; drive belt 320*b* wrapped around and extending between wheels 316*b* and 318*b*; carriage connectors 322*a* and 324*a* (numbered but not shown for clarity) connecting the drive belt 320*a* to the first end of the carriage 302 of the second wrapper 300; and carriage connectors 322*b* and 324*b* (numbered but not shown for clarity) connecting the drive belt 320*b* to the second end of the carriage 302 of the second wrapper 300. Similar to the first-carriage actuator 110, in operation, the actuator 310, under control of the controller CR, simultaneously rotates the drive shafts 312*a* and 312*b* which causes the spaced apart upper wheels 316*a* and 316*b* to rotate, which causes each of the drive belts 320*a* and 320*b* to rotate. The rotation of the drive belts 320*a* and 320*b* causes the upward movements of the first carriage connectors 322*a* and 324*a*, and the carriage connectors 322*b* and 324*b* which causes the second carriage 302 of the second wrapper 300 to move upwardly. This process is reversed to cause the second carriage 302 of the second wrapper 300 to move downwardly.

Figure 1H:
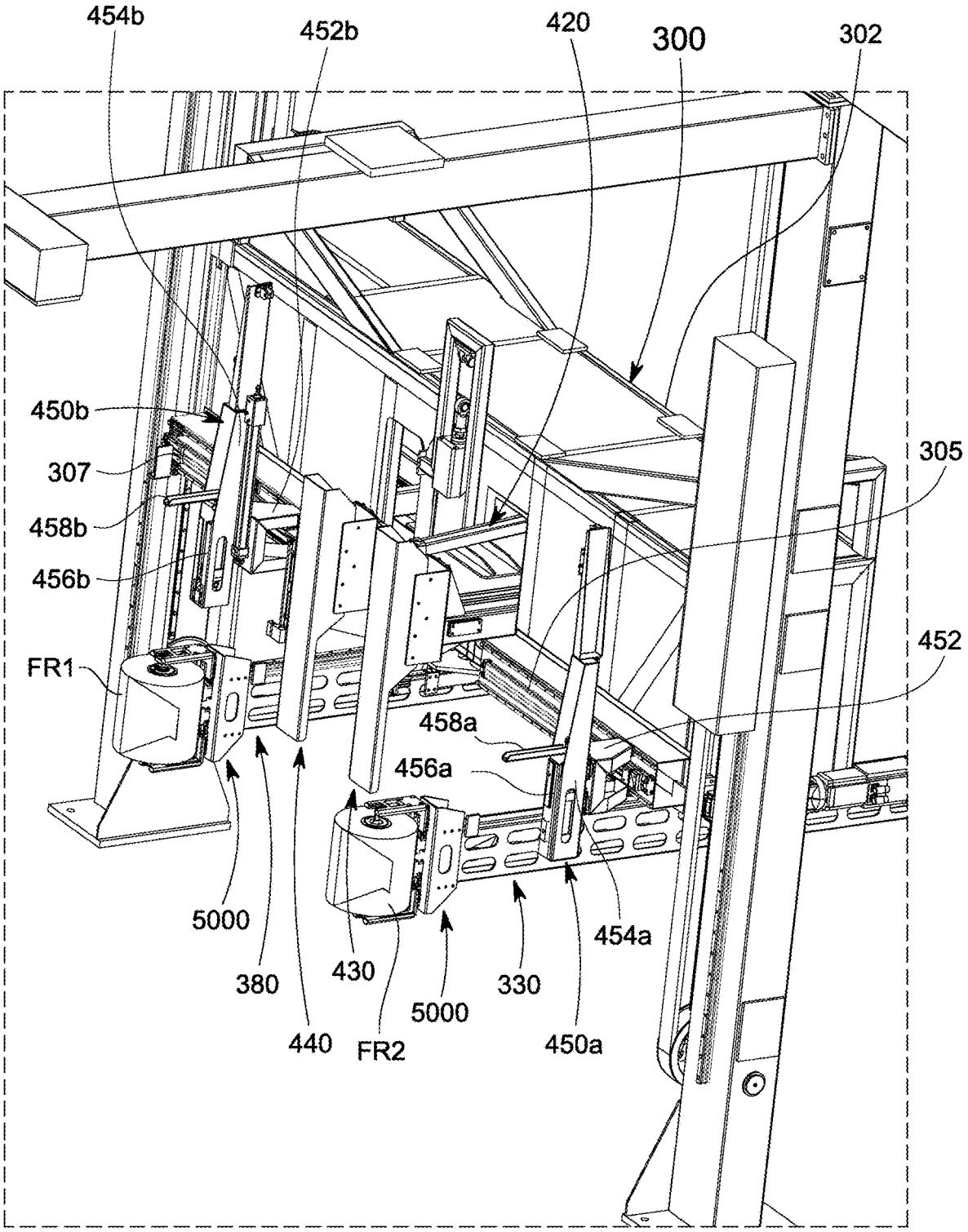
FIG. 1H is a perspective view of the second wrapper of the coil-wrapping apparatus of FIG. 1A; the cut, clamp, and seam system of the second wrapper; and the leading-end holders of the second wrapper.
Figure 1I:
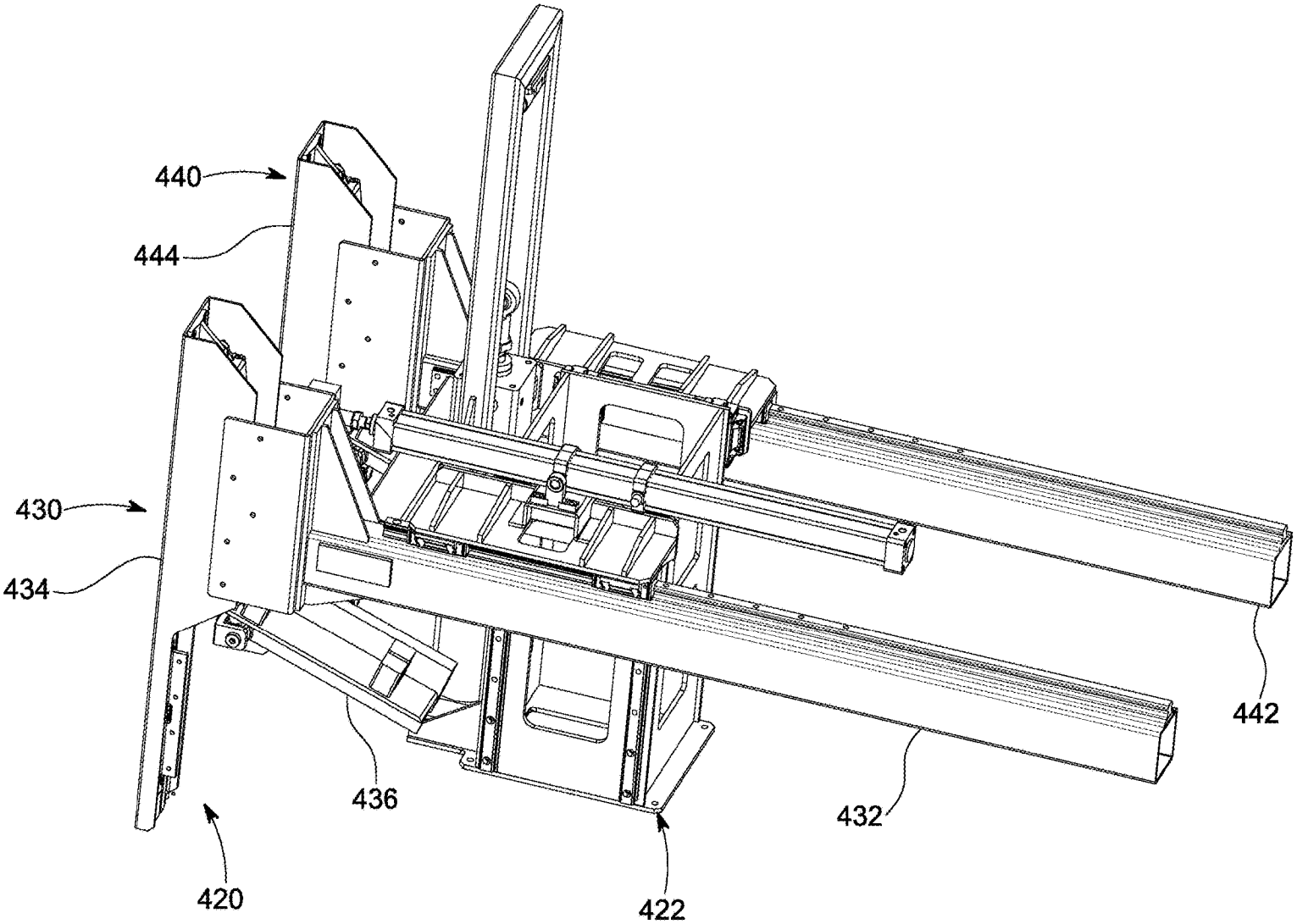
FIG. 1I is a rear perspective view of the cut, clamp, and seam system of the second wrapper of FIG. 1H.

Similar to the first wrapper 100, the second wrapper 300, as best illustrated in FIGS. 1D, 1E, and 1H, includes: a third applicator arm 330 slidably mounted to the second carriage 302; longitudinal and transverse third-applicator-arm actuators 350*a* and 350*b* supported by the second carriage 302 and operably connected to the third applicator arm 330 via a drive train (described below) and configured to move the third applicator arm 330 in the longitudinal and transverse directions relative to a coil C on the coil rotator 500; a fourth applicator arm 380 slidably mounted to the second carriage 302; and longitudinal and transverse fourth-applicator-arm actuators 400*a* and 400*b* supported by the second carriage 202 and operably connected to the fourth applicator arm 380 via a drive train (described below) and configured to move the fourth applicator arm 380 in the longitudinal and transverse directions relative to the coil C on the coil rotator 500.

Third Applicator Arm of the Second Wrapper

The third applicator arm 330, as best illustrated in FIGS. 1D, 1E, and 1H, includes an elongated frame 332, an elongated track 334 connected to the top of the elongated frame 332, and a gripper 5000 (described in detail below) connected to an inner end of the elongated frame 332. The third applicator arm 330 is slidably mounted to the second carriage 302 via a trolley (not shown). Specifically, the trolley is slidably mounted to the tracks (not shown) such that the trolley can slide transversely relative to the carriage frame 304. The trolley is slidably mounted to the track 334 such that the third applicator arm 330 can slide longitudinally relative to tracks.

The transverse third-applicator-arm actuator 350*b* is connected to the bottom of the carriage 302 and operably coupled to the third applicator arm 130. The transverse third-applicator-arm actuator 350*b*, under control of the controller CR, moves the third applicator arm 330 (in a similar manner as described above) transversely (relative to the coil being wrapped) between an outer position adjacent to the a first end of the carriage 302 and an eye position aligned with the longitudinal axis of rotation of the coil. In other words, the transverse third-applicator-arm actuator 350*b*, under control of the controller CR, moves the third applicator arm 330 transversely to a coil C on the coil rotator 500 between an outer position adjacent to the first end of the carriage 302 and to an eye position adjacent to the central longitudinal axis of the coil C.

The longitudinal third-applicator-arm actuator 350*a*, under control of the controller CR, moves the third applicator arm 330 longitudinally relative to the longitudinal axis of the coil C on the coil rotator 500 and the carriage 302 between a transfer position to a retracted position relative to the carriage 302. In other words, the longitudinal third-applicator-arm actuator 350*a*, at each of the outer position, the eye position, and each of the positions therebetween moves, under control of the controller, the arm 330 longitudinally relative to the coil and the carriage 302 between a transfer position and a retracted position.

Fourth Applicator Arm of the Second Wrapper

Similarly, the movable fourth applicator arm 380, as best illustrated in FIGS. 1D and 1E, includes an elongated frame 382, an elongated track 384 connected to the top of the elongated frame 382, and a gripper 5000 connected to an inner end of the elongated frame 382. The fourth applicator arm 380 is slidably mounted to the second carriage 302 via a trolley (not shown). Specifically, the trolley is slidably mounted to the tracks (not shown) such that the trolley can slide transversely relative to the carriage frame 304. The trolley is slidably mounted to the track 384 such that the fourth applicator arm 380 can slide longitudinally relative to tracks.

The transverse fourth-applicator-arm actuator 400*b* is stationary and connected to the bottom of the carriage 302 and supported by the carriage frame thereof (not shown or numbered). The transverse-applicator-arm actuator 400*b*, under control of the controller CR, moves the fourth applicator arm 380 transversely relative to a coil C on the coil rotator 500 and the carriage 102 between an outer position adjacent to the second end of the carriage 302 to an eye position aligned with the longitudinal axis of rotation of the coil C. In other words, the transverse fourth-applicator-arm actuator 400*b*, under control of the controller CR, moves the fourth applicator arm 380 transversely to the longitudinal axis of the coil C and transverse to the carriage 302 and between an outer position adjacent to the second end of the carriage 302 and to an eye position aligned with the central longitudinal axis of the coil.

The longitudinal fourth-applicator-arm actuator 400*a*, under control of the controller CR, moves the fourth applicator arm 380 longitudinal relative to the carriage 302 between a transfer position relative to the interior side of the carriage 302 to a retracted position relative to the interior side of the carriage 302. In other words, the longitudinal fourth-applicator-arm actuator 400*a* at each of the outer positions, the eye positions, and each of the positions therebetween moves, under control of the controller, the arm 380 perpendicularly (and thus longitudinally) to the carriage 302 between a transfer position and a retracted position.

In alterative embodiments, the third applicator arm 330 and the fourth applicator arm 380 are movably connected to two or more separate carriages instead of the single carriage 302.

Cut, Clamp, and Seam System of the Second Wrapper

The second wrapper 300 further includes: a cut, clamp, and seam system 420 (and an associated cut, clamp, and seam system actuator, not shown) operably connected to the second carriage 302. The cut, clamp, and seam system 420, as best shown in FIGS. 1H, 1I, 1J, and 1K, is connected to the second carriage 302 of the second wrapper 300, and under control of the controller CR, clamps, seals, and cuts the films of the film rolls at the end of the coil wrapping process. The cut, clamp, and seam system 420 includes: (i) a sealer/cutter frame 422 connected to and supported by the carriage 302; (ii) a first sealer/cutter 430 movably connected to the sealer/cutter frame 422; (iii) a second sealer/cutter 440 movably connected to the sealer/cutter frame 422; (iv) a first actuator (not shown) operably connected to the sealer/cutter frame 422 and coupled to the first sealer/cutter 430; and (v) a second actuator (not shown) operably connected to the second sealer/cutter frame 422 and coupled to the second cutter/sealer 440. The first sealer/cutter 430 includes a first arm 432, a first coil engager 434 connected to an interior end of the first arm 432, and a first sealing/cutting hand 436 pivotally connected to the first coil engager 434. Similarly, the second sealer/cutter 430 includes a second arm 442, a second coil engager 444 connected to an interior end of the second arm 442, and a second sealing/cutting hand 446 pivotally to the second coil engager 444.

At the end of the coil wrapping process, as described below, when the respective films F1 and F2 of the film rolls FR1 and FR2 are ready to be clamped, sealed, and cut, the first and second actuators of the cut, clamp, and seam system 420, under control of the controller CR, move the first sealer/cutter 430 and the second sealer/cutter 440 into respective engagements with the first and second films F1 and F2 that are adjacent to the side surface SS1 of the coil C. The film is then would around the first coil engager 434 and the second coil engager 444. The first and second actuators of the cut, clamp, and seam system 420, under control of the controller CR, pivot the first sealing/cutting hand 436, and pivot the second sealing/cutting hand 446 into respective engagement with the first and second films F1 and F2 wound around the first coil engager 434 and the second coil engager 444 adjacent to the side surface SS1 of the coil C to seal and cut such films F1 and F2 to seal and cuts such films.

First and Second Film End Holders of the Second Wrapper

The second wrapper 300 further includes first and second film end holders 450*a* and 450*b* (and an associated actuators (not shown)) mounted to the second carriage 302. The first and second film end holders 450*a* and 450*b* of the second wrapper 300, as best shown in FIG. 1H, respectively grip the leading ends of the films of any replacement film rolls that are received from the film-roll suppliers 900 and 1900 for subsequent coil wrapping.

The first film end holder 450*a* includes: (i) a first track mount 452*a* slidably mounted on a transversely extending track 305 of the second carriage 302; (ii) a first film end holder arm 454*a* connected to the first track mount 452*a*; (iii) a first inner film engager 456*a* connected to the first film end holder arm 454*a*; (iv) a first outer film engager 458*a* pivotally connected to the first film end holder arm 454*a*; (v) a first arm actuator (not shown) operably connected to the film end holder arm 454*a* and under control of the controller CR, causes the first film end holder arm 454*a* to move transversely on the track 452*a*; and (vi) a first film engager actuator (not shown) operably connected to the outer film engager 458*a* and, under control of the controller CR, causes the first outer film engager 458*a* to pivot to open the first outer film engager 458*a* to release the leading end of the film. In this example embodiment, the first outer film engager 458*a* is configured to pivotally move into engagement with the first inner film engager 456*a* to hold the leading end of the film. In alternative embodiments, one or both the first inner film engager 456*a* and the first outer film engager 458*a* includes one or more magnets (not shown) that attract the first outer film engager 458*a* to the first inner film engager 456*a*, and maintain these engagers together to hold the leading end of the film. In such embodiments, the first film end holder 450*a* is thus a magnetic holder of the leading end of the film of the film roll.

Similarly, the second film end holder 450*b* includes: (i) a second track mount 452*b* slidably mounted on a transversely extending track 307 of the second carriage 302; (ii) a second film end holder arm 454*b* connected to the second track mount 452*b*; (iii) a second inner film engager 456*b* connected to the first film end holder arm 454*b*; (iv) a second outer film engager 458*b* pivotally connected to the second film end holder arm 454*b*; (v) a second arm actuator (not shown) operably connected to the second film end holder arm 454*b* and, under control of the controller CR, causes the second film end holder arm 454*b* to move longitudinally on the track 452*b*; and (vi) a second film engager actuator (not shown) operably connected to the second outer film engager 458*b* and under control of the controller CR causes the second outer film engager 458*b* to pivot between a film engaging position engaging and a film release position. In this example embodiment, the second outer film engager 458*b* is configured to pivotally move into engagement with the second inner film engager 456*b* to hold the leading end of the film. In alternative embodiments, one or both the second inner film engager 456*b* and the second outer film engager 458*b* includes one or more magnets (not shown) that attract the second outer film engager 458*b* to the second inner film engager 456*b*, and maintain these engagers together to hold the leading end of the film. In these embodiments, the second film end holder 450*b* is thus a magnetic holder of the leading end of the film of the film roll.

Coil Wrapping Method and Wrapping Operation of Coil Wrapping System

Figure 1J:
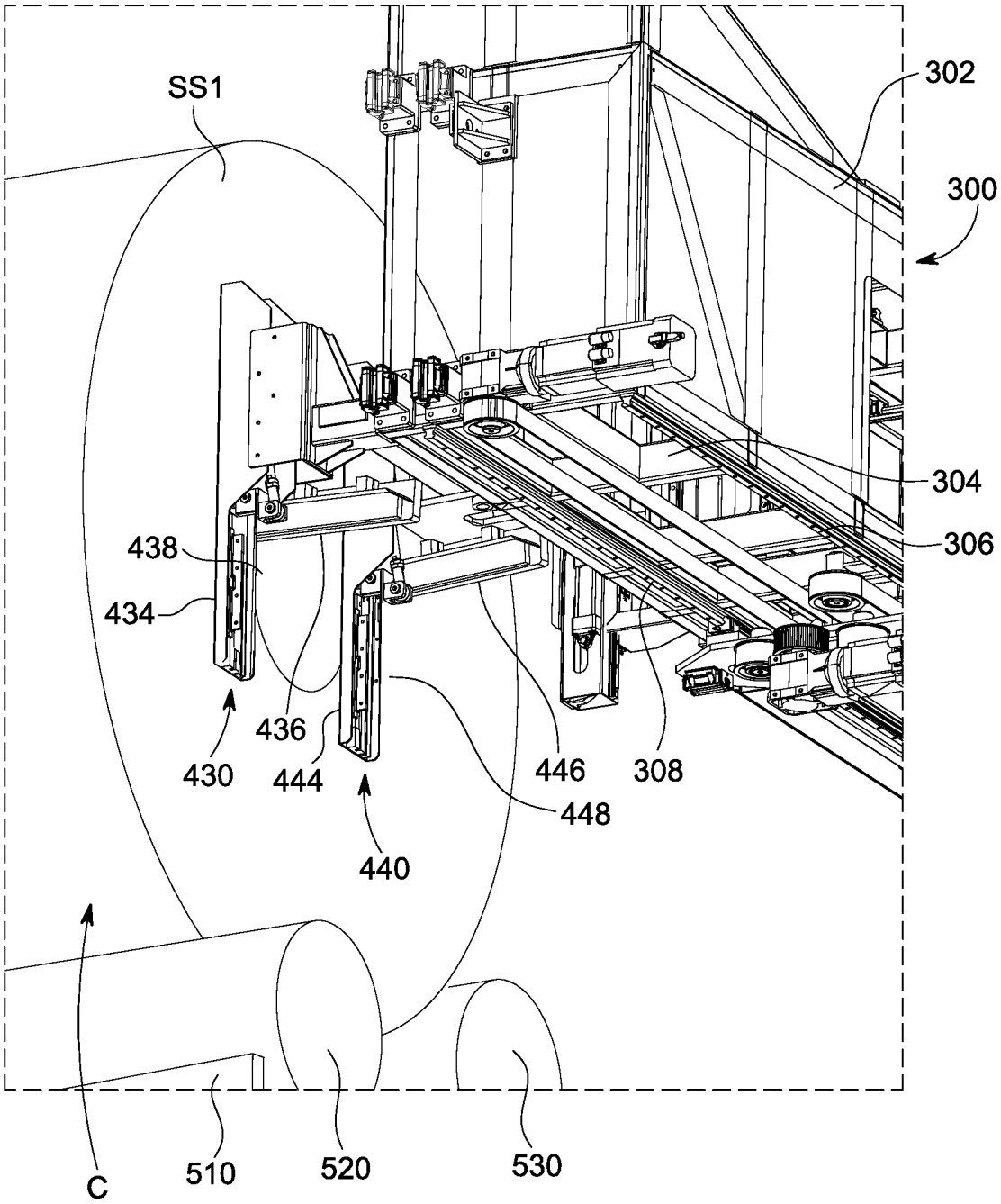
FIG. 1J is a rear perspective view of the second wrapper of the coil-wrapping apparatus of FIG. 1A and the cut, clamp, and seam system of the second wrapper engaging a coil.
Figure 1K:
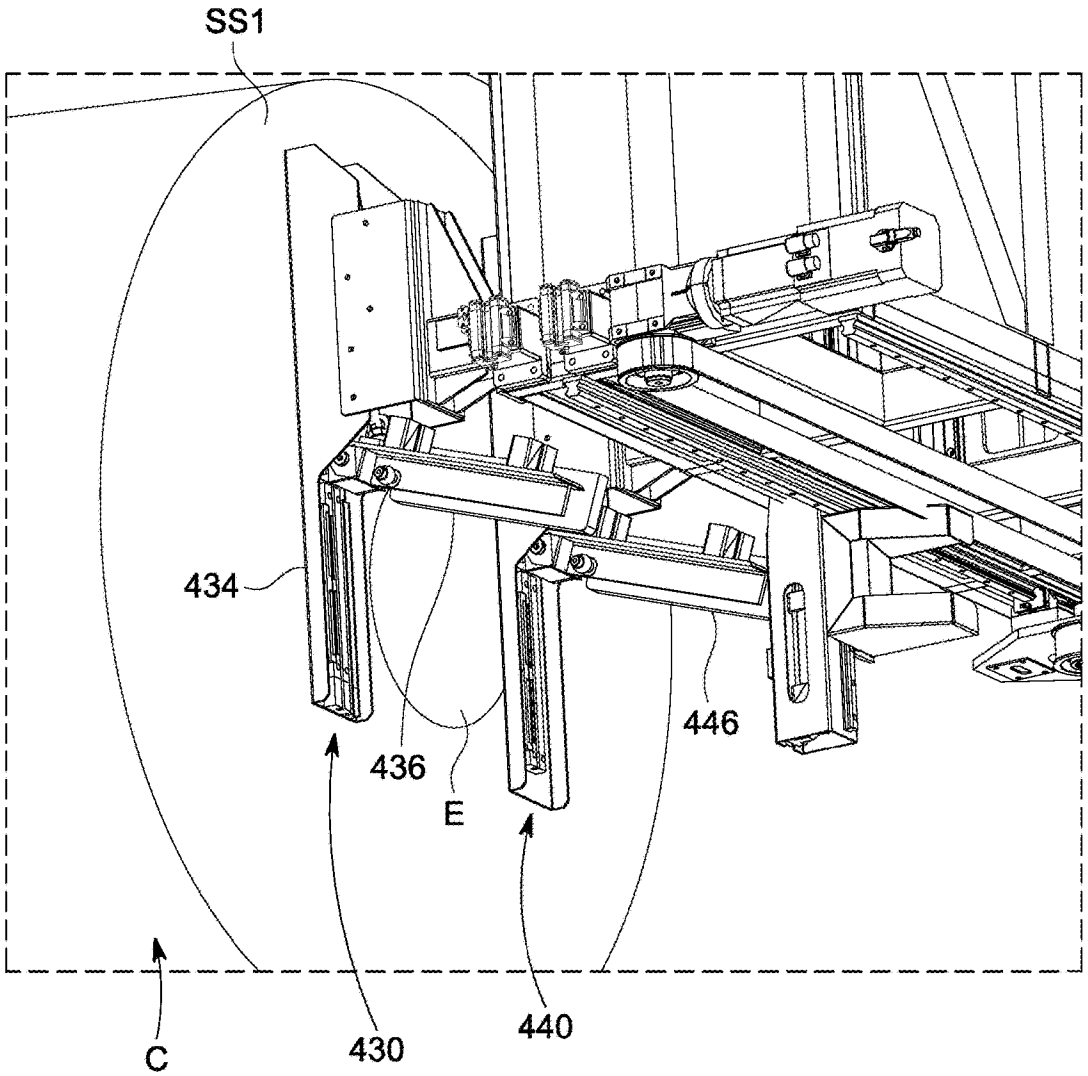
FIG. 1K is a rear perspective view of the cut, clamp, and seam system of second wrapper of the coil-wrapping apparatus of FIG. 1A.
Figure 1L:
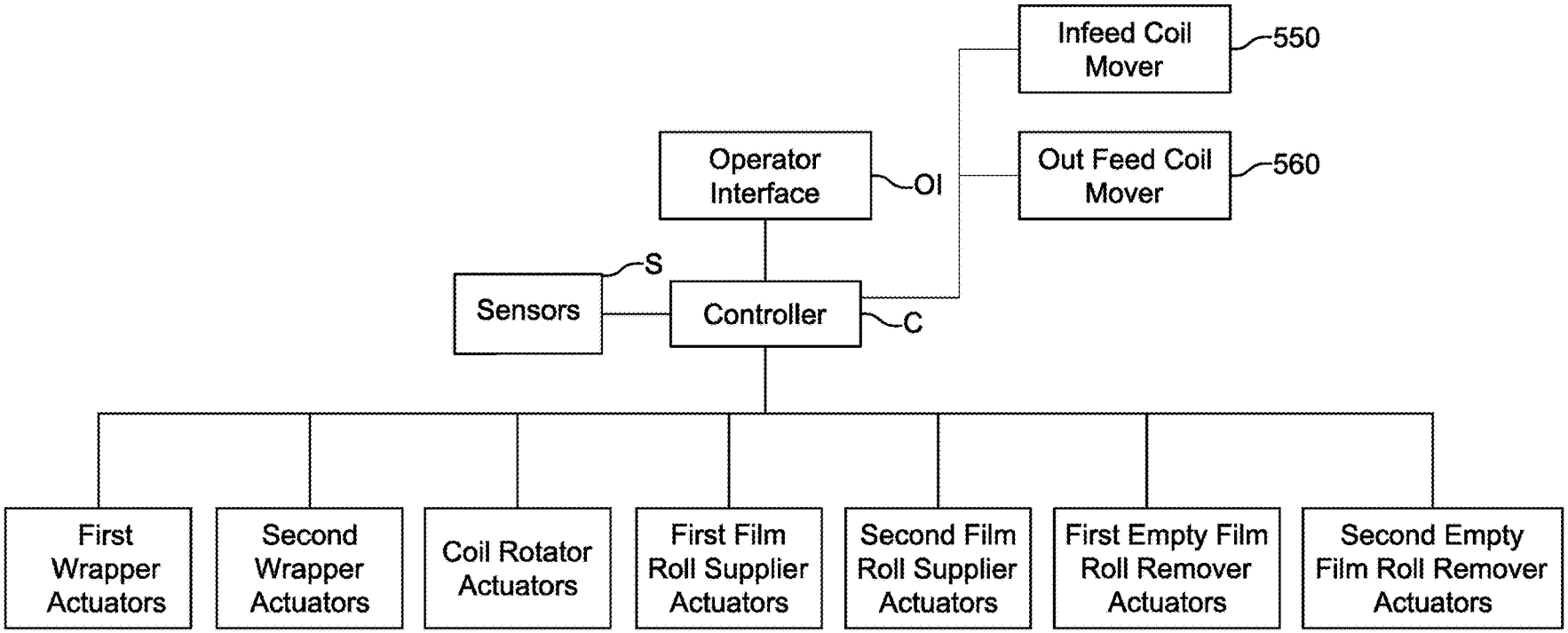
FIG. 1L is a block diagram showing certain components of the coil-wrapping system of FIG. 1A.
Figure 1M:
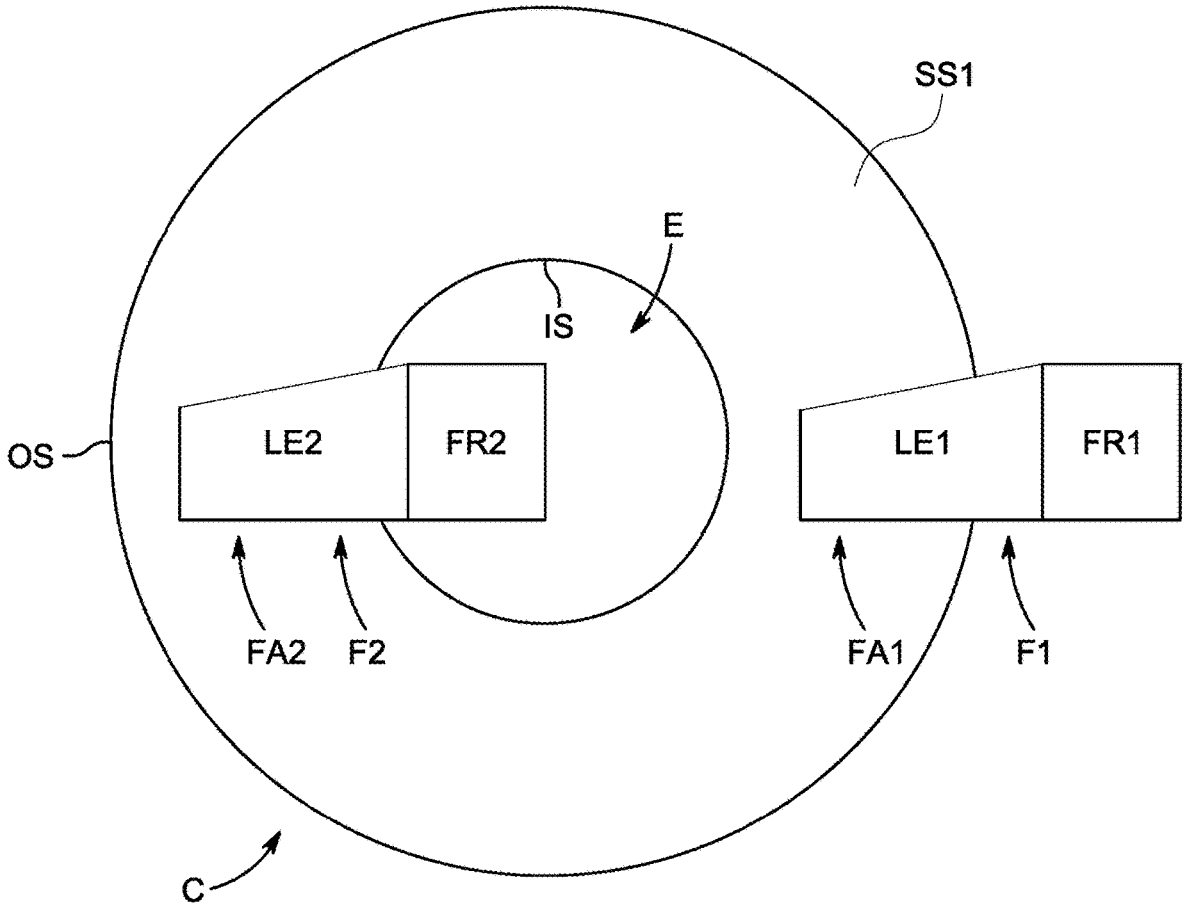
FIG. 1M is a side view of a coil and the positions of the film rolls and leading ends of the film rolls at the start of a coil wrapping process by the coil-wrapping apparatus of the coil-wrapping system of FIG. 1A.
Figure 1N:
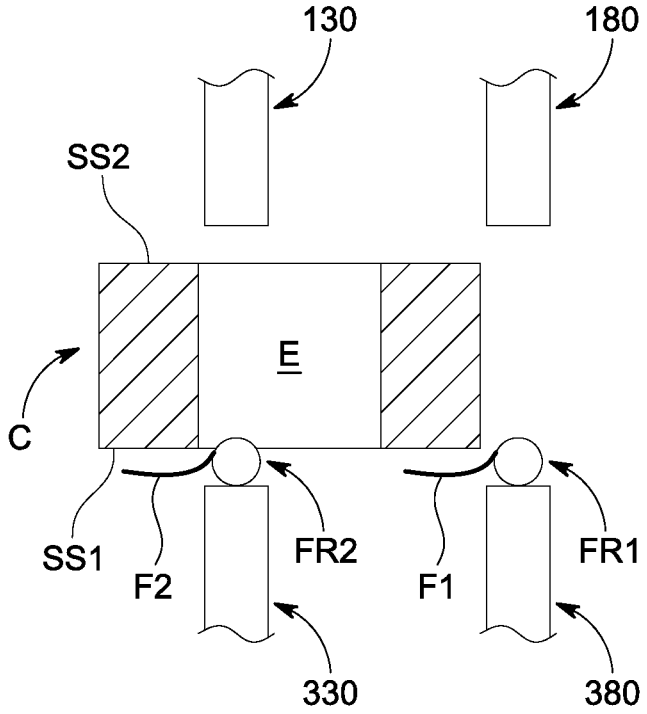
FIGS. 1NA to 1NI show a coil (in cross section) being wrapped by film rolls (shown in a simplified form) carried by applicator arms (shown in simplified form) the coil-wrapping apparatus of the coil-wrapping system of FIG. 1A during a wrapping process.
Figure 1N:
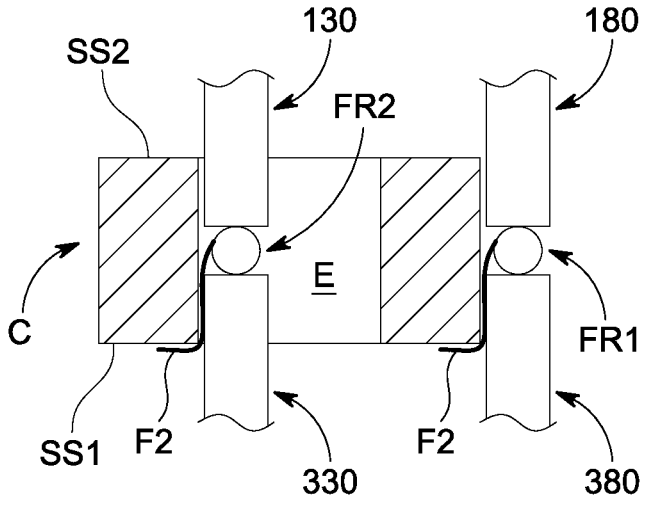
Figure 1N:
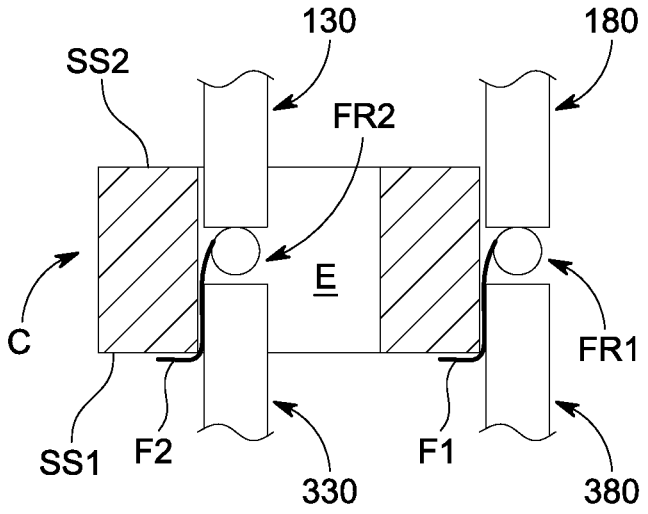
Figure 1N:
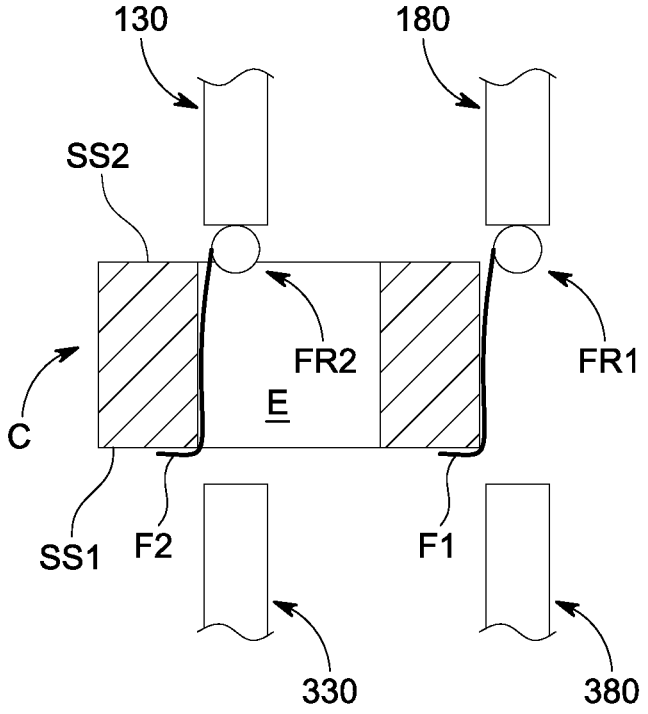
Figure 1N:
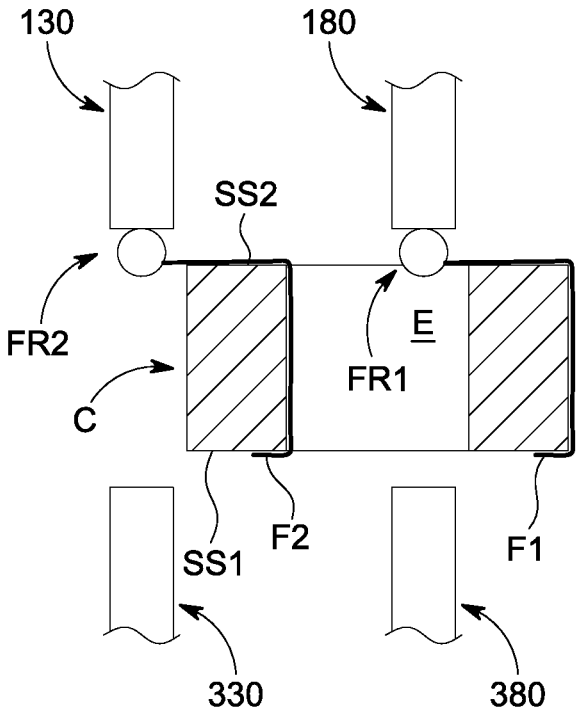
Figure 1N:
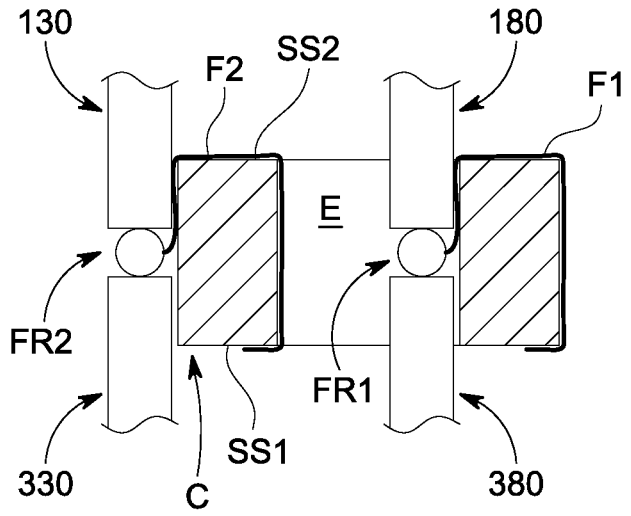
Figure 1N:
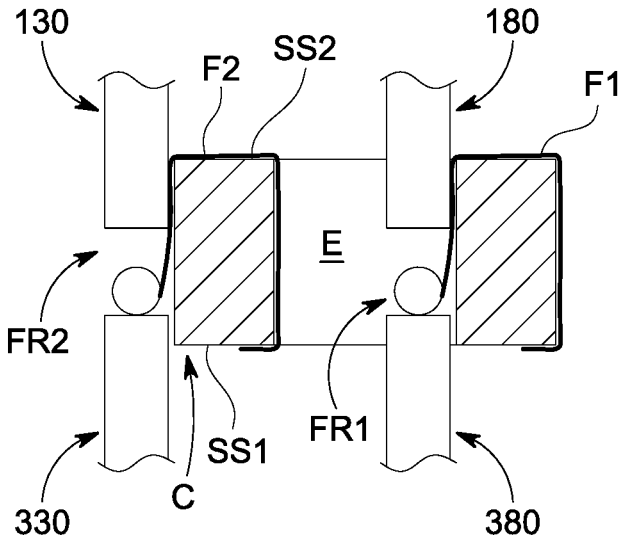
Figure 1N:
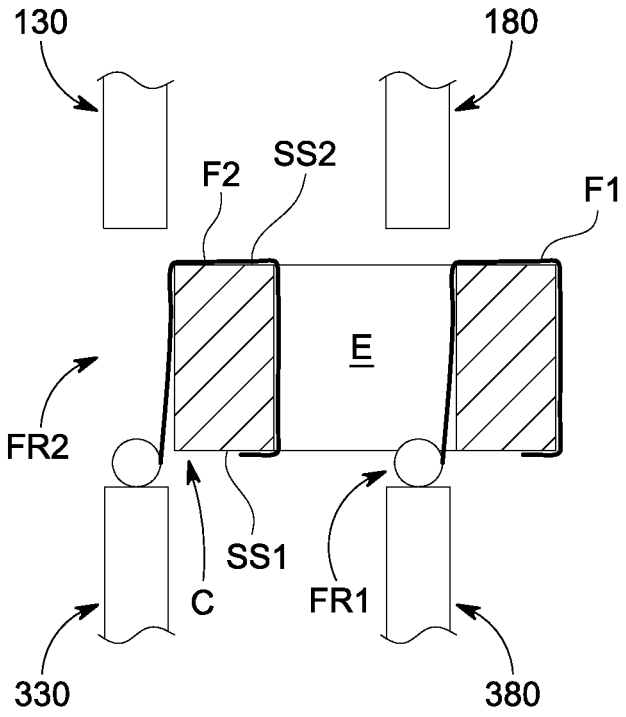
Figure 1N:
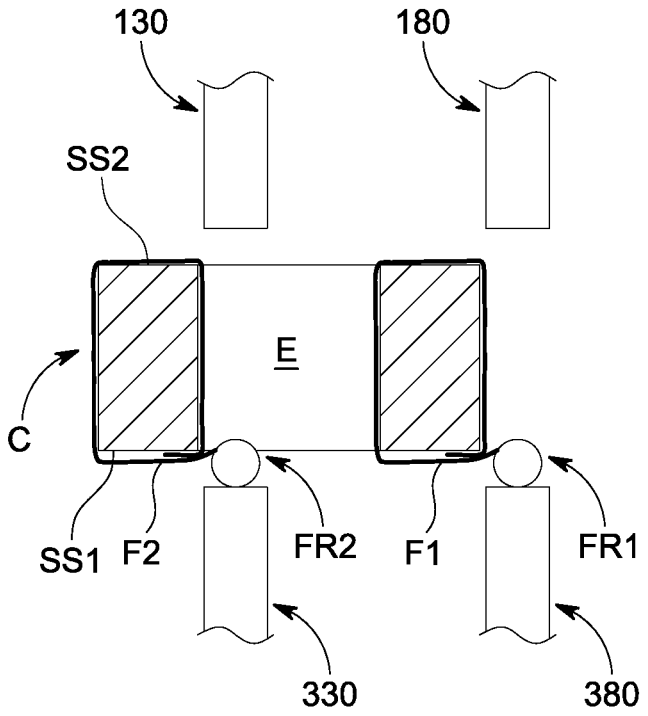
Figure 1N:
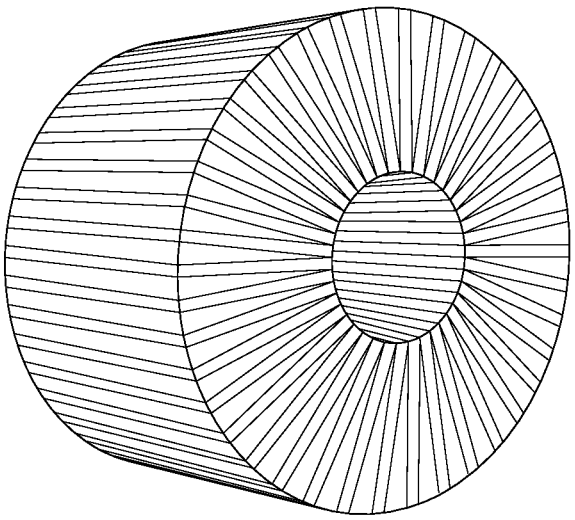
Figure 1O:
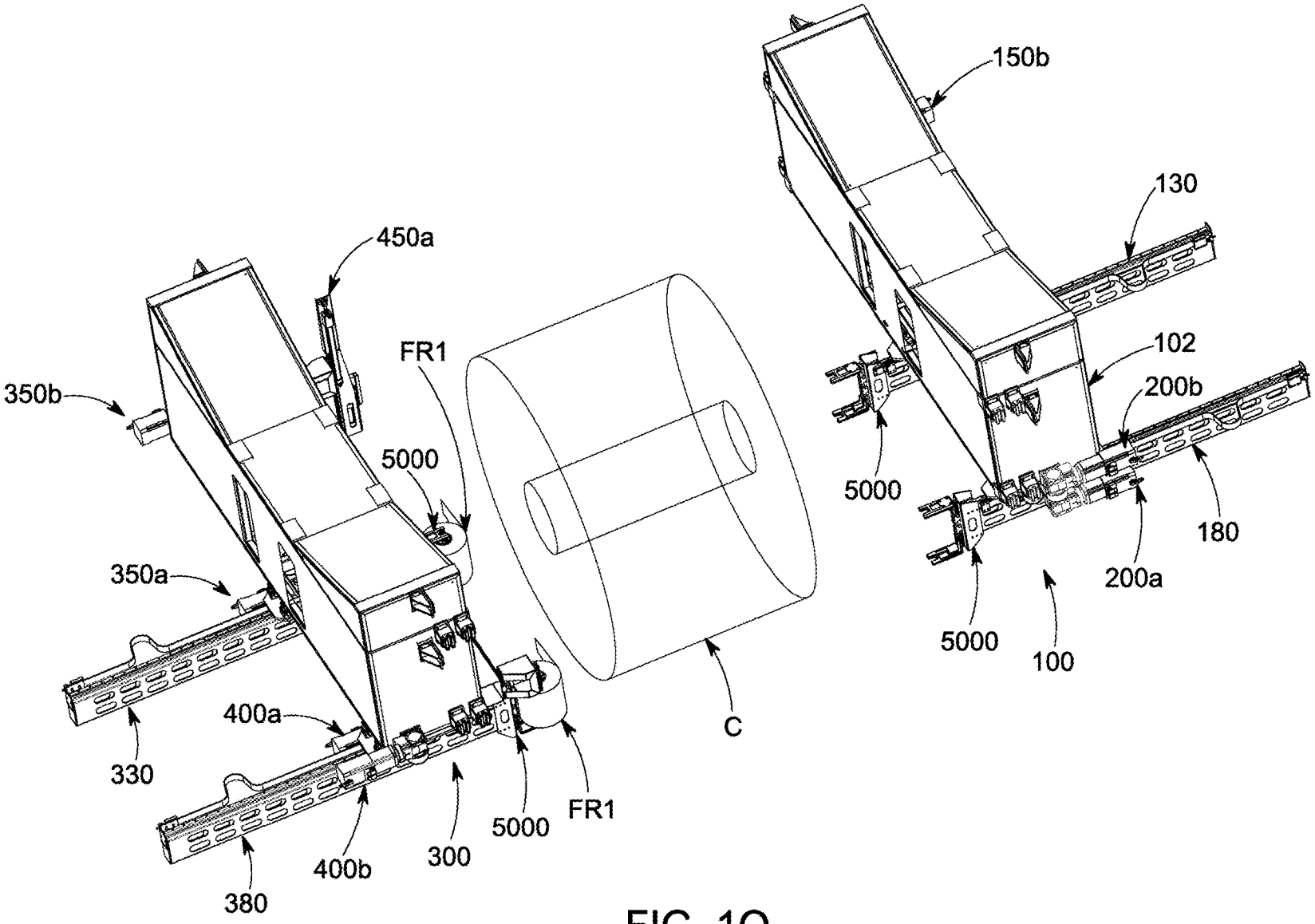
FIG. 1O is a top perspective view of the first and second wrappers of the coil-wrapping apparatus of the coil-wrapping system of FIG. 1A shown before starting to wrap a coil positioned between the first and second wrappers.

The coil wrappers 100 and 300 of the coil-wrapping apparatus 30 of the coil-wrapping system 20, under control of the controller CR, work together to simultaneously use two separate film rolls FR1 and FR2 to simultaneously wrap a single coil C as that coil C is rotated about its longitudinal axis LA by the coil rotator 500. During the wrapping process, as generally shown in FIGS. 1NA to 1NI, the coil-wrapping apparatus 30, under control of the controller CR, for each wrapping cycle: (i) longitudinally moves a first film roll FR1 outside the eye E of the coil C while longitudinally moving a second film roll FR2 though the eye E of the coil C, (ii) then transversely moves the first film roll FR1 outside the eye E of the coil C while transversely moving the second film roll FR2 outside of the eye E of the coil C, (iii) then longitudinally moves the first film roll FR1 though the eye E of the coil C while longitudinally moving the second film roll FR2 outside the eye E the coil C, and (iv) then transversely moves the first film roll FR1 outside the eye E of the coil C while transversely moving the second film roll FR2 outside of the eye E of the coil C. The coil-wrapping system 50, under control of the controller CR, repeats this process alternating the film rolls FR1 and FR2 being longitudinally transferred through the eye E of the coil C while each film F1 and F2 from each film roll FR1 and FR2 is wrapped on the respective outer, side, and inner surfaces of the coil C such that each of the first and second film rolls FR1 and FR2 is used to wrap approximately half of the coil C. This simultaneous wrapping of the coil C with the two film rolls FR1 and FR2 substantially reduces the amount of time need to wrap each coil C and reduces the amount of the film used per roll to wrap each coil, such that each roll lasts a longer amount of time before needing to be replaced.

The coil wrapping method includes the following general steps (and in various embodiments the subsequently described specific sub-steps of each of these general steps): (1) positioning the coil C in the coil wrapping area and positioning the first and second wrappers 100 and 300 to wrap the coil C; (2) initially positioning the film rolls FR1 and FR2 and the leading ends of the respective separate films of the separate film rolls FR1 and FR2 held by the third and fourth applicator arms 330 and 380 of the second wrapper 300 relative to the coil C; (3) simultaneously wrapping the coil C with the separate films F1 and F2 from both film rolls FR1 and FR2 using the respective first, second, third, and fourth applicator arms 130, 180, 330, and 380 of the first and second wrappers 100 and 300; (4) simultaneously sealing, clamping, and cutting the separate films F1 and F2 from both film rolls FR1 and FR2 using the cut, clamp, and seam system 420; and (5) removing the wrapped coil C from the coil area. This method can further include preparing for wrapping of the next coil as further described below.

Positioning the Coil in the Coil Wrapping Area

The step of positioning the coil C in the coil wrapping area and positioning the first and second wrappers 100 and 300 to wrap the coil C includes: (a) lifting the first wrapper 100 to its raised position; (b) longitudinally moving an unwrapped coil C from the coil infeed area, under the first wrapper 100, and onto the coil rotator 500 (thus positioning the unwrapped coil in the coil wrapping area on the coil rotator 500); and (c) lowering the first wrapper 100 to its coil-wrapping position (and if not previously done lowering the second wrapper 300 to its coil-wrapping position). In this position, the applicator arms 130, 180, 330, and 380 are each at a vertical height such that the respective grippers 5000 of each of the arms 130, 180, 330, and 380 are vertically aligned with the longitudinal axis of the coil C on the coil rotator 500 in the coil wrapping area.

Positioning the Film Rolls and Leading Ends of the Films of the Film Rolls

Each step of positioning each of the applicator arms 130, 180, 330, and 380 of the first and second wrappers 100 and 300 that is described below includes the longitudinal movements of the respective applicator arm by the respective longitudinal applicator arm actuator for that applicator arm, and the transverse movements of the respective applicator arm by the respective transverse applicator arm actuator for that applicator arm. All of these movements are controlled by the controller CR based on the specific points in the coil wrapping process. Additionally, one or more of these movements can be monitored by one or more sensors S, and one or more of these movements can be caused by the controller CR based on feedback from one or more of the sensors S.

The following describes this wrapping process after the film rolls have been replaced (such as described below). The step of positioning the film rolls FR1 and FR2 and the leading ends LE1 and LE2 of the films F1 and F2 of the film rolls FR1 and FR2 initially held by the third and fourth applicator arms 330 and 380 of the second wrapper 300 to the coil C, as best shown in FIGS. 1M, 1NA, and 1O, includes: (a) longitudinally and transversely positioning the fourth applicator arm 380 at a first starting wrapping position such that the leading end LE1 of the film F1 of the film roll FR1 held by the fourth applicator arm 380 is positioned generally adjacent to a first area FA1 of the side surface SS1 of the coil C (i.e., the side surface of the coil facing the second wrapper 300) on one side of the eye E of the coil C; and (b) longitudinally and transversely positioning the third applicator arm 330 at a second starting wrapping position such that the leading end LE2 of the film F2 of the film roll FR2 held by the third applicator arm 330 is positioned generally adjacent to a second area FA2 of the side surface SS1 of the coil on the other side of the eye E of the coil C. This includes (c) causing the first film end holder 450*a* to position the leading end LE2 of the film F2 of the film roll FR2 in a first area FA2 adjacent to the side surface SS1 of the coil C; and (d) causing the second film end holder 450*b* to position the leading end LE1 of the film F1 of the film roll FR1 adjacent to the second area FA1 of the side surface SS1 of the coil C. Steps (a), (b), (c), and (d) can be performed simultaneously in the illustrated example embodiment.

This further includes, as best shown in FIGS. 1NA and 1O, (e) longitudinally and transversely positioning the first applicator arm 130 (that at this point does not hold any film roll) adjacent the side surface SS2 of the coil C (i.e., the side surface of the coil facing the first wrapper 100) in transverse alignment with the third applicator arm 330 of the second wrapper 300; and (f) longitudinally and transversely positioning the second applicator arm 180 (that at this point does not hold any film roll) adjacent the side surface SS2 of the coil C in transverse alignment with the fourth applicator arm 380 of the second wrapper. Steps (e) and (f) can be performed simultaneously in the illustrated example embodiment. Steps (e) and (f) can also be performed simultaneously with either steps (a) and (b) and/or steps (c) and (d) in the illustrated example embodiment.

Wrapping the Coil with the Films From the Film Rolls

The steps of simultaneously wrapping the coil C with the films F1 and F2 from both film rolls FR1 and FR2 include the following sets of steps.

The first set of steps includes: (a) causing the coil rotator 500 to start to rotate the coil C about its longitudinal axis LA (if not previously already started); (b) moving the fourth applicator arm 380 and the film roll FR1 held by the gripper thereof longitudinally inwardly in an area adjacent the coil C such that the film F1 of the film roll FR1 is applied to an area of the outer surface OS of the coil C; (c) moving the third applicator arm 330 and the film roll FR2 held by the gripper thereof longitudinally inwardly into the eye E of the coil C such that the film F2 of the film roll FR2 is applied to an area of the inner surface IS of the coil C; (d) moving the second applicator arm 180 (that at this point does not hold any film roll) longitudinally inwardly in an area adjacent the outer surface OS of the coil C; and (e) moving the first applicator arm 130 (that at this point does not hold any film roll) longitudinally inwardly into the eye E of the coil C. Steps (b), (c), (d), and (e) can be performed simultaneously in the illustrated example embodiment.

Figure 1P:
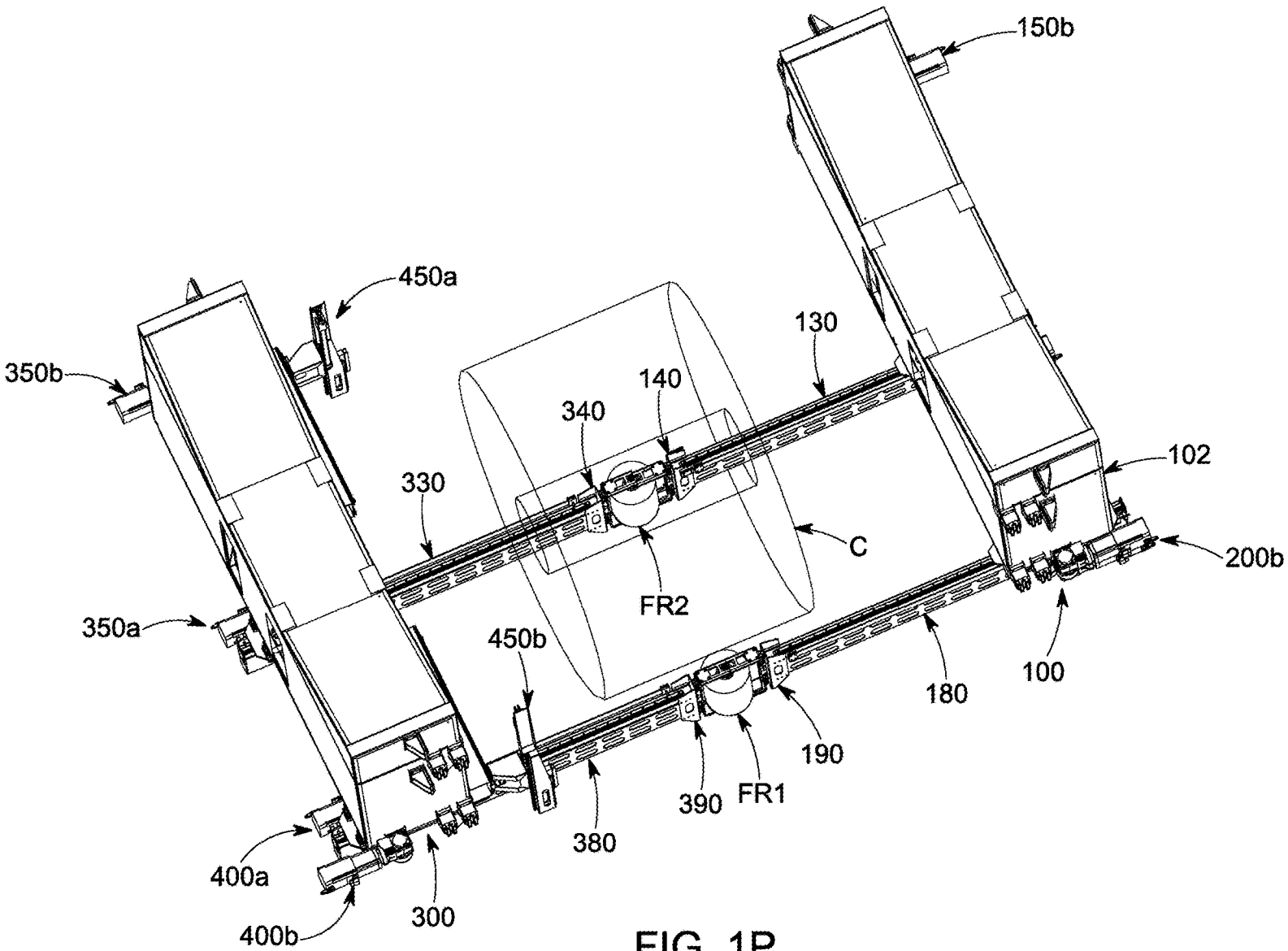
FIG. 1P is a top perspective view of the first and second wrappers of the coil-wrapping apparatus of the coil-wrapping system of FIG. 1A showing a point during the wrapping process when the first and third applicator arms of the first and second wrappers are at their first respective film-roll-transfer positions.

The next set of steps, as best shown in FIG. 1NB, includes: (f) continuing to move the fourth applicator arm 380 and the film roll FR1 held by the gripper thereof longitudinally inwardly to a film-roll-transfer position (while continuing to apply the film F1 of the film roll FR1 to the area of the outer surface OS of the coil C); (g) continuing to move the third applicator arm 330 and the film roll FR2 held by the gripper thereof longitudinally inwardly to a film-roll-transfer position in the eye E of the coil C (while continuing to apply the film F2 of the film roll FR2 to the area of the inner surface IS of the coil C); (h) continuing to move the second applicator arm 180 (that at this point does not hold any film roll) longitudinally inwardly to a film-roll-transfer position in an area adjacent the outer surface OS of the coil C; and (i) continuing to move the first applicator arm 130 (that at this point does not hold any film roll) longitudinally inwardly to a film-roll-transfer position in the eye E of the coil C. These applicator arms and film-roll-transfer positions are also shown in FIG. 1P. Steps (f), (g), (h), and (i) can be performed simultaneously in the illustrated example embodiment.

The next set of steps, as best shown in FIG. 1NC, includes: (j) transferring the film roll FR1 held by the gripper of the fourth applicator arm 380 to the gripper of the second applicator arm 180 at the film-roll-transfer position at the area of the outer surface OS of the coil C); (k) transferring the film roll FR2 held by the gripper of the third applicator arm 330 to the gripper of the first applicator arm 130 at the film-roll-transfer position in the eye E of the coil C. Steps (j) and (k) can be performed simultaneously in the illustrated example embodiment.

The next set of steps, as best shown in FIG. 1ND, includes: (l) moving the second applicator arm 180 and the film roll FR1 now held by the gripper thereof longitudinally outwardly in an area adjacent the coil C such that the film F1 of the film roll FR1 continues to be applied to an area of the outer surface of the coil C; (m) moving the first applicator arm 130 and the film roll FR2 now held by the gripper thereof longitudinally outwardly of the eye E of the coil C such that the film F2 of the film roll FR2 continues to be applied to an area of the inner surface IS of the coil C; (n) moving the fourth applicator arm 380 longitudinally outwardly in an area adjacent the outer surface OS of the coil C; and (o) moving the third applicator arm 330 longitudinally outwardly of the eye E of the coil C. Steps (l), (m), (n), and (o) can be performed simultaneously in the illustrated example embodiment.

The next set of steps, as best shown in FIG. 1NE, includes: (p) moving the second applicator arm 180 and the film roll FR1 held by the gripper thereof transversely adjacent to the side surface SS2 of the coil C such that the film F1 of the film roll FR1 is applied to an area of the side surface SS2 of the coil C, and stopping such transverse movement when the film roll FR1 held by the gripper is in a plane longitudinally aligned with the eye E of the coil C; (q) moving the first applicator arm 130 and the film roll FR2 held by the gripper thereof transversely adjacent to the side surface SS2 of the coil C such that the film F2 of the film roll FR2 is applied to an area of the side surface SS2 of the coil C, and stopping such transverse movement when the film roll FR2 held by the gripper is in a plane longitudinally adjacent the outer surface OS of the coil C; (r) moving the fourth applicator arm 380 transversely adjacent to the side surface SS1 of the coil C, and stopping such transverse movement when the gripper thereof is in a plane longitudinally aligned with the eye E of the coil C; and(s) moving the third applicator arm 330 transversely adjacent to the side surface SS1 of the coil C, and stopping such transverse movement when the gripper thereof is in a plane longitudinally adjacent the outer surface OS of the coil C. Steps (p), (q), (r), and(s) can be performed simultaneously in the illustrated example embodiment.

Figure 1Q:
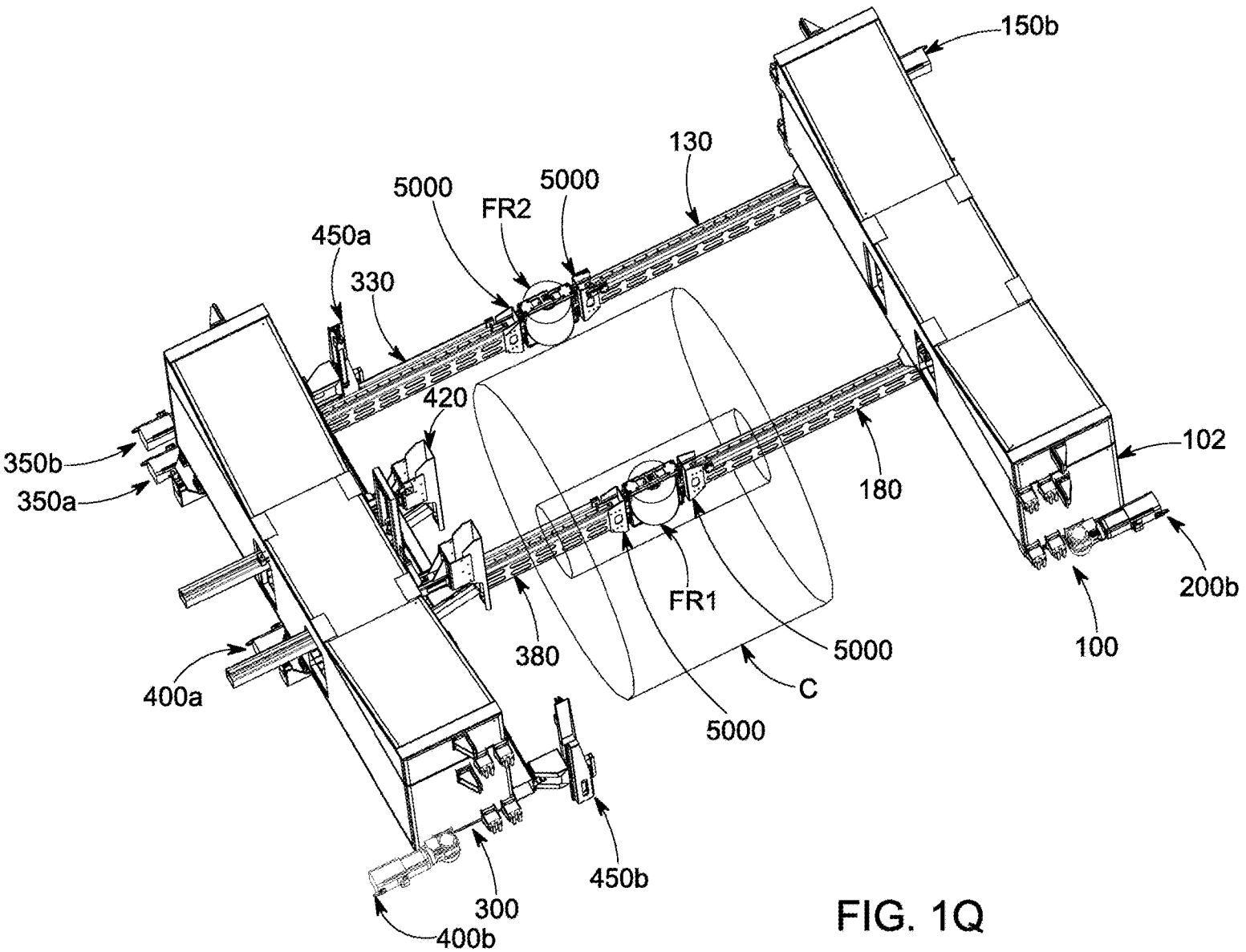
FIG. 1Q is a top perspective view of the first and second wrappers of the coil-wrapping apparatus of the coil-wrapping system of FIG. 1A showing a point during the wrapping process when the first and third applicator arms of the first and second wrappers are at their second respective film-roll-transfer positions.

The next set of steps, as best shown in FIG. 1NF, includes: (t) moving the first applicator arm 130 and the film roll FR2 held by the gripper thereof longitudinally inwardly to a film-roll-transfer position while applying the film F2 of the film roll FR2 to an area adjacent the outer surface OS of the coil C; (u) moving the second applicator arm 180 and the film roll FR1 held by the gripper thereof longitudinally inwardly to a film-roll-transfer position in the eye E of the coil C while applying the film F1 of the film roll FR1 to an area of the inner surface IS of the coil C; (v) moving the fourth applicator arm 380 (that at this point does not hold any film roll) longitudinally inwardly to a film-roll-transfer position in the eye E of the coil C; (w) moving the third applicator arm 330 (that at this point does not hold any film roll) longitudinally inwardly to a film-roll-transfer position in an area adjacent the outer surface OS of the coil C. These applicator arms and film-roll-transfer positions are also shown in FIG. 1Q. Steps (t), (u), (v), and (w) can be performed simultaneously in the illustrated example embodiment.

The next set of steps, as best shown in FIG. 1NG, includes: (x) transferring the film roll FR2 held by the gripper of the first applicator arm 130 to the gripper of the third applicator arm 330 at the film-roll-transfer position at an area adjacent the outer surface OS of the coil C; (y) transferring the film roll FR1 held by the gripper of the second applicator arm 180 to the gripper of the fourth applicator arm 380 at the film-roll-transfer position in the eye E of the coil C. These steps (x) and (y) can be performed simultaneously in the illustrated example embodiment.

The next set of steps, as best shown in FIG. 1NH, includes: (z) moving the third applicator arm 330 and the film roll FR2 now held by the gripper longitudinally outwardly in an area outside the eye E of the coil C such that the film F2 of the film roll FR2 continues to be applied to an area of the outer surface of the coil C; (aa) moving the fourth applicator arm 380 and the film roll FR1 now held by the gripper longitudinally outwardly of the eye E of the coil C such that the film F1 of the film roll FR1 continues to be applied to an area of the inner surface IS of the coil C; (bb) moving the first applicator arm 130 longitudinally outwardly in an area adjacent the outer surface OS of the coil C; and (cc) moving the second applicator arm 180 longitudinally outwardly out of the eye E of the coil C. Steps (z), (aa), (bb), and (cc) can be performed simultaneously in the illustrated example embodiment.

The next set of steps, as best shown in FIG. 1NI, includes: (dd) moving the fourth applicator arm 380 and the film roll FR1 held by the gripper thereof transversely adjacent to the side surface SS1 of the coil C such that the film F1 of the film roll FR1 is applied to an area of the side surface SS2 of the coil C, and stopping such transverse movement when the film roll FR1 held by the gripper is in a plane longitudinally adjacent the outer surface OS of the coil C; (ee) moving the fourth third applicator arm 330 and the film roll FR2 held by the gripper thereof transversely adjacent to the side surface SS1 of the coil C such that the film F2 of the film roll FR2 is applied to an area of the side surface SS2 of the coil C, and stopping such transverse movement when the film roll FR2 held by the gripper is in a plane longitudinally aligned with the eye E of the coil C; (ff) moving the second applicator arm 180 transversely adjacent to the side surface SS2 of the coil C, and stopping such transverse movement when the gripper thereof is in a plane longitudinally adjacent the outer surface OS of the coil C; (gg) moving the first applicator arm 130 transversely adjacent to the side surface SS2 of the coil C, and stopping such transverse movement when the gripper thereof is in a plane longitudinally aligned with the eye E of the coil C. Steps (dd), (ee), (ff) and (gg) can be performed simultaneously in the illustrated example embodiment. As somewhat shown in FIG. 1NI, a this point, the films F1 and F2 overlap themselves.

The respective sets of steps of (b) through (gg) are then repeated while the coil C continues to be rotated about it longitudinal axis until approximately half of the coil C is wrapped by film F1 and approximately the other half of the coil is wrapped by film F2. After steps (b) through (gg) are repeated a suitable quantity of times such as two or three times, the films F1 and F2 are able to hold the respective leading ends LE1 and LE2 of the films F1 and F2 such that the film end holders 450*a* and 450*b* can release the leading ends LE1 and LE2 of the films F1 and F2.

Sealing, Clamping, and Cutting Both Films from Both Film Rolls

After the above process is repeated numerous times such that the coil C is completely wrapped by the two films F1 and F2, the step of sealing, clamping, and cutting both films F1 and F2 from both film rolls FR1 and FR2 begins. After the last implementation of steps (dd), (ee), (ff) and (gg) are performed, the method includes positioning the cut, clamp, and seam system 420 in an active position adjacent to the side surface SS2 of the coil C, such as shown in FIGS. 1J and 1K.

More specifically, this includes: (i) positioning the first coil engager 434 at a first sealing/cutting position such that the first coil engager 434 engages the film F2 of the film roll FR2 positioned on the first area of the side surface SS1 of the coil C adjacent to the eye E of the coil C, and with the sealer/cutter 436 in the open position, such as shown in FIGS. 1J and 1K; and (ii) positioning the second coil engager 444 at a second sealing/cutting position such that the second coil engager 444 engages the film F1 of the film roll FR1 positioned on the second area of the side surface SS1 of the coil C adjacent to the eye E of the coil C, and with the sealer/cutter 446 in the open position, such as shown in FIGS. 1J and 1K. Steps (i) and (ii) can be performed simultaneously in the illustrated example embodiment.

This further includes: (iii) causing the first sealer/cutter 436 to pivot inwardly and engage, seal, and cut the film F2 of the film roll FR2 positioned on the first area of the side surface SS1 of the coil C adjacent the eye E of the coil C; and (iv) causing the second sealer/cutter 446 to pivot inwardly and engage, seal, and the film F1 of the film roll FR1 positioned on the first area of the side surface SS1 of the coil C adjacent the eye E of the coil C. This also includes: (v) holding the leading end of the film F2 of the film roll FR2; and (vi) and holding the leading end of the film F1 of the film roll FR1. Steps (v) and (vi) can be performed simultaneously in the illustrated example embodiment. Steps (iii) and (iv) can be performed simultaneously in the illustrated example embodiment. Steps (v) and (vi) are performed before or simultaneously with the steps (iii) and (iv).

This process can includes raising the second wrapper 300 such that the wrapped coil can be move under the second wrapper 300. This process also or alternatively include: (vii) retracting the first coil engager 434 from the first sealing/cutting position; and (viii) retracting the second coil engager 444 from the second sealing/cutting position. These steps (vii) and (viii) can be performed simultaneously in the illustrated example embodiment. At this point, the end of the films F1 and F2 are held for being applied to a subsequent coil.

FIG. 1NJ shows a coil after it has been fully wrapped.

Removing the Wrapped Coil from the Coil Wrapping Area

The method of removing the wrapped coil from the coil wrapping area includes: (a) causing the coil rotator 500 to stop rotating the coil C (if not previously done); (b) lifting the second wrapper 300 to its raised position; (c) longitudinally moving the fully wrapped coil from being on the coil rotator 500 in the coil wrapping area, under the second wrapper 300, and to the coil outfeed area (and thereafter enabling the wrapped coil to be transported as desired); and (d) lowering the second wrapper 300 to its coil-wrapping position for wrapping of the next coil.

The example film-roll-change system 50, the example method for preparing for wrapping a next coil, the example mandrel 4000, and the example mandrel grippers 5000 of this illustrated example embodiment of the present disclosure are now described.

Film-Roll-Change System

The film-roll-change system 50 removes empty or near-empty film rolls from the coil-wrapping apparatus 30 and supplies new film rolls to the coil-wrapping apparatus 30. The film-roll-change system 50, as shown in FIGS. 1A, 1B, 1C, 2A-2D, and 3A-3F, includes a first replacement-film-roll holder 600, a first replacement-film-roll-holder track 610, a first empty-film-roll holder 800, a first empty-film-roll-holder track 810, a first film-roll supplier 900, a first empty-film-roll remover 1000, a second replacement-film-roll holder 1600, a second replacement-film-roll-holder track 1610, a second empty-film-roll holder 1800, a second empty-film-roll-holder track 1810, a second film-roll supplier 1900, and a second empty-film-roll remover 2000.

The first replacement-film-roll-holder track 610 and the first empty-film-roll-holder track 810 are positioned adjacent to a first exterior area of the machine frame 60 and each extend transversely to the coiler rotator 500. The first replacement-film-roll-holder track 610 is aligned with the second wrapper 300, and the first empty-film-roll-holder track 810 is generally transversely aligned with the first wrapper 100. The first replacement-film-roll holder 600 is slidably mounted on the first replacement-film-roll-holder track 610 and transversely moveable thereon from a supply position (FIG. 1A) to a reloading position (FIG. 1B). FIG. 1B is shown after replacement rolls have been loaded on the first replacement-film-roll holder 600 and before the first replacement-film-roll holder 600 has been returned to the supply position shown in FIG. 1A, The first empty-film-roll holder 800 is slidably mounted on the first empty-film-roll-holder track 810 and transversely moveable thereon from an empty-film-roll-receiving position (FIG. 1A) to an empty-film-roll-unloading position (FIG. 1B).

Likewise, the second replacement-film-roll-holder track 1610 and the second empty-film-roll-holder track 1810 are positioned adjacent to an opposite second exterior area of the machine frame 60 and each extend transversely to the coiler rotator 500. The second replacement-film-roll-holder track 1610 is generally aligned with the second wrapper 300, and the second empty-film-roll-holder track 1810 is transversely aligned with the first wrapper 100. The second replacement-film-roll holder 1600 is slidably mounted on the second replacement-film-roll-holder track 1610 and transversely moveable thereon from a supply position (FIG. 1A) to a reloading position (FIG. 1B). The second empty-film-roll holder 1800 is slidably mounted on the second empty-film-roll-holder track 1810 and transversely moveable thereon from an empty-film-roll-receiving position (FIG. 1A) to an empty-film-roll-unloading position (FIG. 1B).

Suitable protective structures such as fences (not shown) can be employed around components of the coil-wrapping system 20 to create a protective barrier around the various components thereof to limit people from entering the working areas of the coil-wrapping system 20. The above described loading positions and unloading positions can be exterior to such protective structures to enable an operator to load replacement film rolls on the respective replacement-film-roll holders 600 and 1600 and to unload empty film rolls from the respective empty-film-roll holders 800 and 1800 without entering such protected working areas.

Each of the first replacement-film-roll holder 600, the first empty-film-roll holder 800, the second replacement-film-roll holder 1600, and the second empty-film-roll holder 1800 can be respectively: (i) manually movable and lockable on the respective tracks 610, 810, 1610, and 1810 toward and away from the respective wrappers 100 and 300 and inside/outside of the protective structures, or (ii) automatically moveable and lockable on the respective tracks 610, 810, 1610, and 1810 toward and away from the respective wrappers 100 and 300 and inside/outside of the protective structures, under the control of the controller CR via respective actuators such as by the example actuators described below. Each of the first replacement-film-roll holder 600, the first empty-film-roll holder 800, the second replacement-film-roll holder 1600, and the second empty-film-roll holder 1800 can be manually lockable in the respective positions on the respective tracks 610, 810, 1610, and 1810, or can be automatically lockable under the control of the controller CR via respective actuators such as by the example actuators described below.

The first film-roll supplier 900 and the first empty-film-roll remover 1000 are positioned adjacent to the first exterior area of the machine frame 60 and each extend transversely to the coiler rotator 500. The first film-roll supplier 900 and the first empty-film-roll-remover 1000 are positioned between the first replacement-film-roll-holder track 610 and the first empty-film-roll-holder track 810, and thus positioned between the first replacement-film-roll holder 600 and the first empty-film-roll holder 800 when those holders are positioned in their respective supply and empty-film-roll-receiving positions, such as shown in FIGS. 1A and 1C. The first film-roll supplier 900 is also aligned with the first replacement-film-roll holder 600 (when that holder is in the film-roll-supply position) such that, under control of the controller CR, the first film-roll supplier 900 can obtain an replacement film roll (on a mandrel 4000) from the first replacement-film-roll holder 600 and provide that replacement film roll (on the mandrel 4000) to the third applicator arm 330 of the second wrapper 300. The first empty-film-roll remover 1000 is also aligned with the first empty-film-roll holder 800 (when that holder is in the empty-film-roll-receiving position) such that, under control of the controller CR, the first empty-film-roll remover 1000 can obtain an empty film roll (on a mandrel 4000) from the first applicator arm 130 of the first wrapper 100 and provide that empty fill roll (on the mandrel 4000) to the first empty-film-roll holder 800. Since the first empty-film-roll remover 1000 obtains empty film rolls from the first applicator arm 130 of the first wrapper 100, responsive to the controller CR determining that a film roll held by the third applicator arm 330 is empty, the controller CR causes the third applicator arm 330 to transfer the empty film roll to the first applicator arm 130 of the first wrapper 100 for removal as described below.

Likewise the second film-roll supplier 1900 and the second empty-film-roll remover 2000 are positioned adjacent to the second exterior area of the machine frame 60 and each extend transversely to the coiler rotator 500. The second film-roll supplier 1900 and the second empty-film-roll remover 2000 are positioned between the second replacement-film-roll-holder track 1610 and the second empty-film-roll-holder track 1810, and thus positioned between the second replacement-film-roll holder 1600 and the second empty-film-roll holder 1800 when those holders are positioned in their respective supply and empty-film-roll-receiving positions, such as shown in FIGS. 1A and 1C. The second film-roll supplier 1900 is also aligned with the second replacement-film-roll holder 1600 (when that holder is in the film-roll-supply position) such that, under control of the controller CR, the second film-roll supplier 1900 can obtain an replacement film roll (on a mandrel 4000) from the second replacement-film-roll holder 1600 and provide that replacement film roll (on the mandrel 4000) to the fourth applicator arm 380 of the second wrapper 300. The second empty-film-roll remover 2000 is also aligned with the second empty-film-roll holder 1800 (when that holder is in the empty-film-roll-receiving position) such that, under control of the controller CR, the second empty-film-roll remover 2000 can obtain an empty film roll (on a mandrel 4000) from the second applicator arm 180 of the first wrapper 100 and provide that empty fill roll (on the mandrel 4000) to the second empty-film-roll holder 1800. Since the second empty-film-roll remover 2000 obtains empty film rolls from the second applicator arm 180 of the first wrapper 100, responsive to the controller CR determining that a film roll held by the fourth applicator arm 380 is empty, the controller CR causes the fourth applicator arm 380 to transfer the empty film roll to the second applicator arm 180 of the first wrapper 100 for removal.

First Replacement-Film-Roll Holder

More specifically, the first replacement-film-roll holder 600, as best illustrated in FIGS. 2A, 2B, 2C, and 2D, is configured to hold replacement film rolls RFR that are individually and separately providable by the first film-roll supplier 900 to the third applicator arm 330 of the second wrapper 300 when the controller CR determines to replace each empty film roll held by the third applicator arm 330 of the second wrapper 300 (and transferred to the first applicator arm 130 of the first wrapper 100 for removal). The first replacement-film-roll holder 600 includes a replacement-film-roll-holder frame 620 movably coupled to the track 610. The replacement-film-roll-holder frame 620 includes a lower portion 630 and an upper portion 640. The lower portion 630 includes a plurality of legs (not labeled) that have feet (not labeled) coupled to the track 610 and that are slidably moveable on the track 610. The upper portion 640 includes a plurality of upright and longitudinal frame members (not labeled) that support a plurality of film-roll holders 700 as described below. The track 610 is fixed in a position on a supporting surface (such as a floor), and as mentioned above, extends transversely outwardly in the first area adjacent the machine frame 60 and is transversely aligned with the second wrapper 300. The replacement-film-roll-holder frame 620 is moveable by the replacement-film-roll holder actuator 650, under control of the controller CR, on the track 610 from a supply position shown in FIG. 1A to a reloading position shown in FIG. 1B outwardly of the supply position. In the supply position, the replacement-film-roll holder 600 is configured to supply, when needed, replacement film rolls on mandrels to third applicator arm 330 of the second wrapper 300 via the first film-roll supplier 900. In the reloading position, the replacement-film-roll holder 600 is configured to be reloaded with additional replacement film rolls on mandrels. The replacement-film-roll-holder actuator 650 is connected to the replacement-film-roll-holder frame 620. The replacement-film-roll-holder actuator 650, under control of the controller CR, causes the replacement-film-roll-holder frame 620 to move on the track 610 between the supply position and the reloading position. This example embodiment additionally includes a replacement-film-roll-holder locking actuator 660 connected to the replacement-film-roll-holder frame 620. The replacement-film-roll-holder locking actuator 660, under control of the controller CR, is configured to move a locking pin 665 into engagement with the track 610 to lock the replacement-film-roll-holder frame 620 in the supply position or in the reloading position.

Figure 2A:
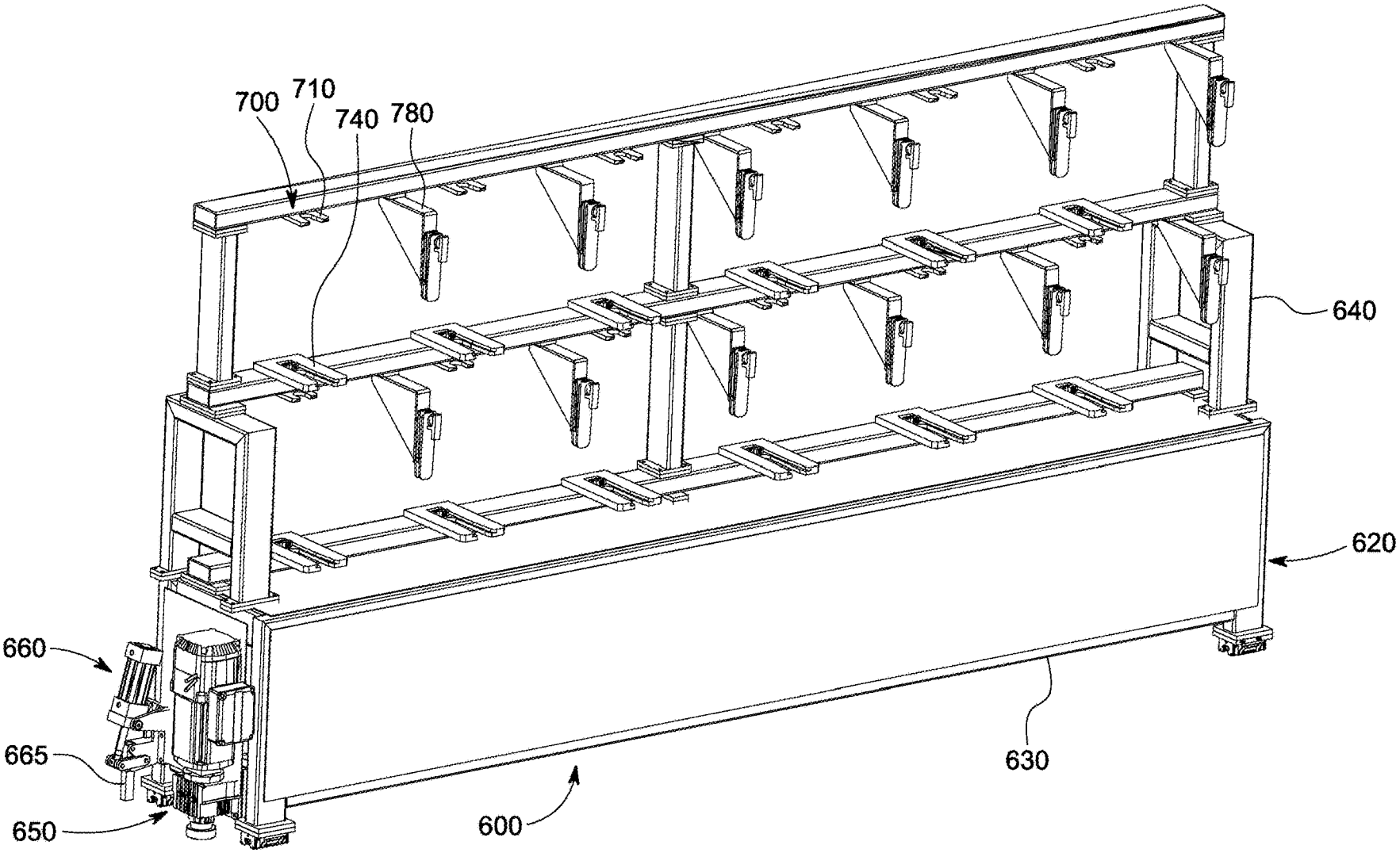
FIG. 2A is a perspective view of the first replacement-film-roll holder of the film-change system of the coil-wrapping system of FIG. 1A without any replacement film rolls.
Figure 2B:
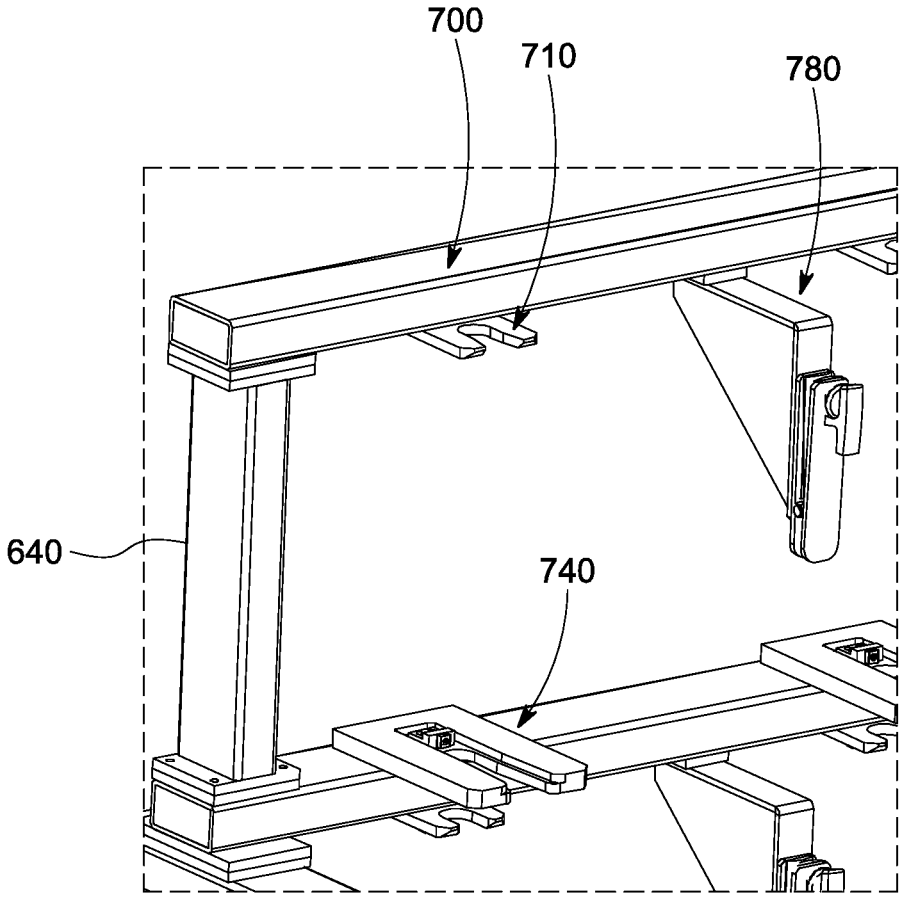
FIG. 2B is a perspective view of one of the replacement-film-roll supporters of the first replacement-film-roll holder of FIG. 2A without a replacement film roll.
Figure 2C:
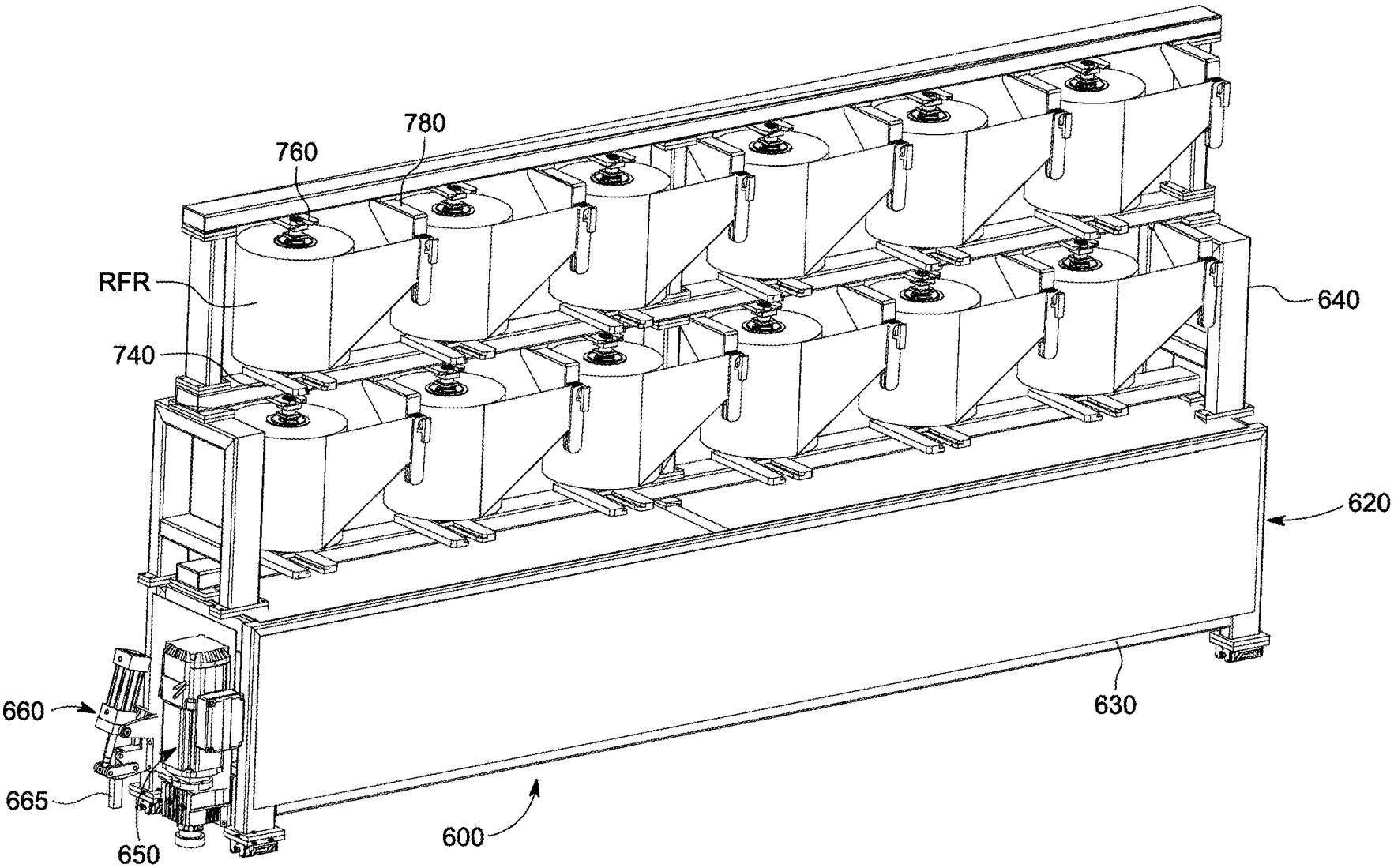
FIG. 2C is a perspective view of the first replacement-film-roll holder of FIG. 2A holding replacement film rolls.

FIG. 2A shows twelve film-roll holders 700 not holding any film rolls. FIG. 2C shows the film-roll holders 700 holding twelve replacement film rolls (each mounted on a mandrel 4000). In this example embodiment, the twelve film-roll holders 700 are arranged in two rows of six film-roll holders. The first replacement-film-roll holder 600 is thus able to hold twelve replacement film rolls, as shown in FIG. 2C, before having to be reloaded with additional replacement film rolls. The quantity and arrangement of the film-roll holders can vary.

Figure 2D:
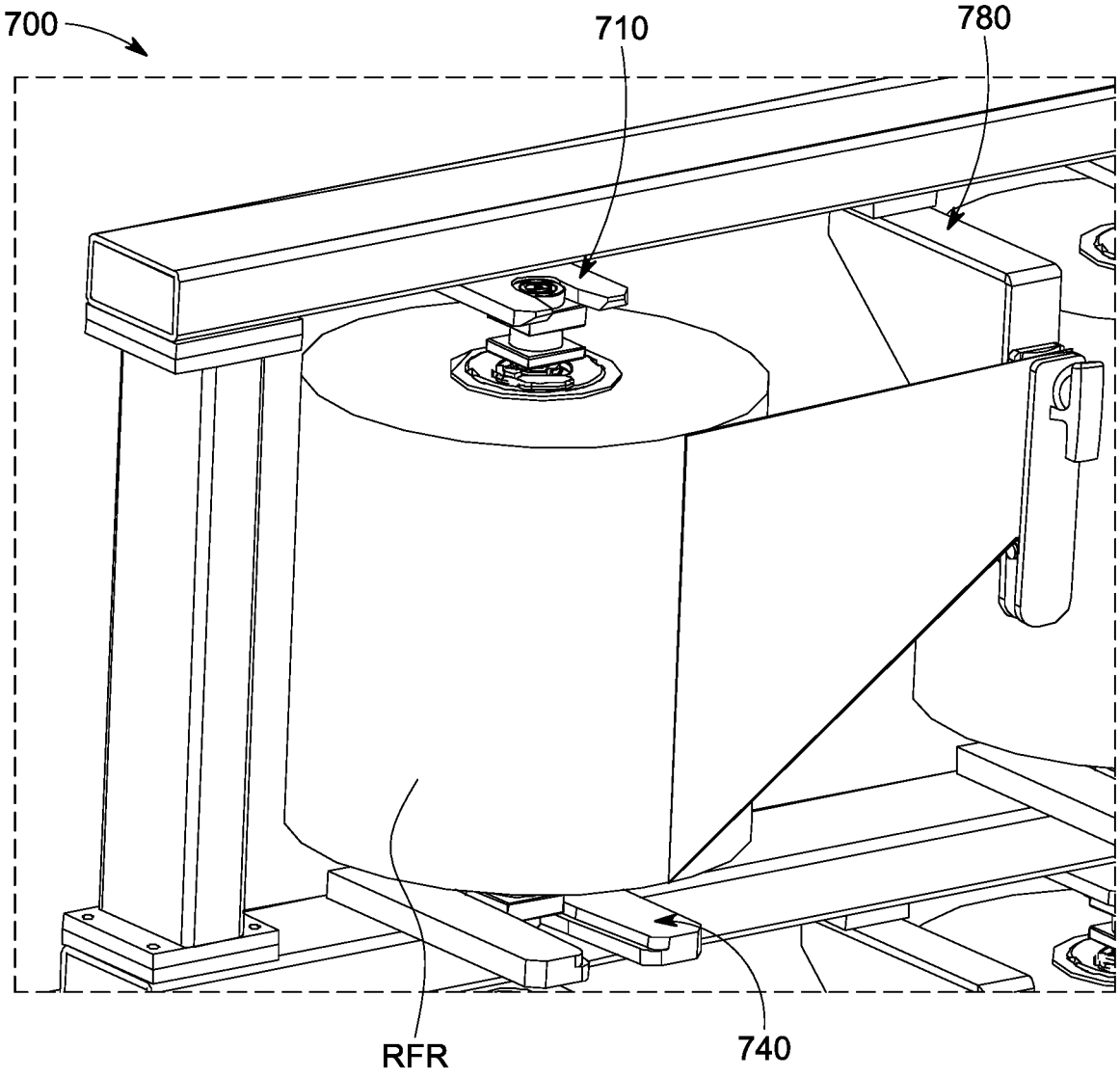
FIG. 2D is an enlarged perspective view of one of the replacement-film-roll supporters of the first replacement-film-roll holder of FIG. 2A holding a replacement film roll.

Each film-roll holder 700 includes a top mandrel holder 710, a bottom mandrel holder 740, and a film-end holder 780. The top mandrel holder 710 is connected to the upper portion 640 of the frame 620 and includes a bracket shaped and sized to receive, hold, and release a top handle 4116 of a top handle assembly 4110 of a mandrel 4000 (described below). The bottom mandrel holder 740 is connected to the upper portion 640 of the frame 620 below, aligned with, and spaced apart from the top mandrel holder 710. The bottom mandrel holder 740 includes a bracket shaped and sized to receive, hold, and release the bottom handle 4156 of the bottom handle assembly 4150 of a mandrel 4000. The bottom mandrel holder 740 also includes one or more magnets (not labeled) that hold the mandrel in place. The film-end holder 780 is connected to the upper portion 640 of the frame 620 at the same level as, aligned with, and spaced-apart from the top mandrel holder 710. The film-end holder 780 includes a first film engager 782 connected to the frame 600 and a second film engager 790 pivotally connected to the first film engager 782. The second film engager 790 is pivotable between a film holding position shown in FIGS. 2A, 2B, 2C, 2D, and a film release position (not shown). The second film engager 790 is biased toward the film holding position by a biasing member (not shown). In certain embodiments, one or more magnets can hold the second film engager 790 in the closed position. The film-end holder 780 is configured to hold a leading end of the replacement film roll such as shown in FIGS. 2C and 2D, while the replacement film roll is held by the first replacement-film-roll holder 600. The film-end holder 780 is configured to release that leading end of the replacement film roll when the replacement film roll is removed from the first replacement-film-roll holder 600 by the first replacement-film-roll supplier 900.

Second Replacement-Film-Roll Holder

The second replacement-film-roll holder 1600 is a mirror image of the first replacement-film-roll holder 600, and is thus not described in detail herein for brevity. Generally, the second replacement-film-roll holder 1600, as best illustrated in FIGS. 1A, 1B, and 1C, is configured to hold replacement film rolls that are individually provided by the second film-roll supplier 1900 to the fourth applicator arm 380 of the second wrapper 300 when the controller CR determines to replace an empty film roll held by the fourth applicator arm 380 (that is then transferred to the second applicator arm 180 of the first wrapper 100 for removal). Similar to as described above, a replacement-film-roll-holder actuator (not shown) connected to the replacement-film-roll-holder frame of the second replacement-film-roll holder 1600, causes, under control of the controller CR, the replacement-film-roll-holder frame to move on the track 1610 between a supply position (shown in FIG. 1A) and a reloading position (shown in FIG. 1B). This example embodiment additionally includes a replacement-film-roll-holder locking actuator (not shown) connected to the replacement-film-roll-holder frame. The replacement-film-roll-holder locking actuator, under control of the controller CR, is configured to move a locking pin (not shown) into engagement with the track 1610 to lock the replacement-film-roll-holder frame in the supply position or in the reloading position.

First Empty-Film-Roll Holder

The first empty-film-roll holder 800, as best illustrated in FIGS. 1A, 1B, and 1C, is configured to hold empty film rolls (on mandrels 4000) that are individually obtained by the first empty-film-roll remover 1000 from the first applicator arm 130 of the first wrapper 100 when the controller CR determines to replace that empty film roll held by the third applicator arm 330 or the first applicator arm 130, as explained above. The first empty-film-roll holder 800 is substantially a mirror image of the empty first replacement-film-roll holder 600 (but it initially does not hold any replacement film rolls on mandrels), and thus the first empty-film-roll holder 800 is not described in detail herein for brevity. The first replacement-film-roll holder 600 can include, but does not need to include any film-end holders (such as the film-end holder 780 of first replacement-film-roll holder 600) because the first empty-film-roll holder 800 does not need to hold the leading ends of the films of such empty film rolls. Similar to as described above, an empty film-roll-holder actuator (not shown) connected to the empty film-roll-holder frame, causes, under control of the controller CR, the empty film-roll-holder frame to move on the track 810 between an empty-film-roll-receipt position (shown in FIG. 1A) and an unloading position (shown in FIG. 1B). This example embodiment additionally includes an empty-film-roll-holder locking actuator (not shown) connected to the empty-film-roll-holder frame. The empty-film-roll-holder locking actuator, under control of the controller CR, is configured to move a locking pin (not shown) into engagement with the track 810 to lock the empty-film-roll-holder frame in the empty-film-roll-receipt position or in the unloading position.

Second Empty-Film-Roll Holder

The second empty-film-roll holder 1800 is likewise a mirror image of the first empty-film-roll holder 1800 and is thus not described herein for brevity. The second empty-film-roll holder 1800, as best illustrated in FIGS. 1A, 1B, and 1C, is configured to hold empty film rolls that are individually obtained by the second empty-film-roll remover 2000 from the second applicator arm 180 of the first wrapper 100 when the controller CR determines to replace that empty film roll held by the fourth applicator arm 380 and transferred to the second applicator arm 180 for removal, as explained above. Similar to as described above, an empty film-roll-holder actuator (not shown) connected to the empty film-roll-holder frame, causes, under control of the controller CR, the empty film-roll-holder frame to move on the track 1810 between the empty-film-roll-receipt position and the unloading position. This example embodiment additionally includes an empty-film-roll-holder locking actuator (not shown) connected to the empty-film-roll-holder frame. The empty-film-roll-holder locking actuator, under control of the controller CR, is configured to move a locking pin (not shown) into engagement with the track 1810 to lock the empty-film-roll-holder frame in the empty-film-roll-receipt position or in the unloading position.

First Film-Roll Supplier

The first film-roll supplier 900, as best shown in FIGS. 3A-3E, is positioned between the first replacement-film-roll holder 600 and the first empty-film-roll remover 1000 and transversely extends partially within the interior area of the machine frame 60. The first film-roll supplier 900 includes a supplier frame 920 and a film-roll mover 950 supported by the supplier frame 920.

The supplier frame 920 is stationary and includes a lower section 922 and a track 924 attached to the top of the lower section 922. The supplier frame 920 is aligned in a longitudinal direction with the first replacement-film-roll holder 600 such that the film-roll mover 950 can reach each of the replacement-film-roll holder supporter positions of the first replacement-film-roll holder 600. The supplier frame 920 also transversely extends into an area within the machine frame 60 to enable the film-roll mover 950 to be longitudinally aligned with the third applicator arm 330 of the second wrapper 300 to transfer a replacement film roll to the third applicator arm 330.

The film-roll mover 950 includes an upright support arm 952 movably coupled to the track 924 attached to the supplier frame 920 and a support arm actuator 956 operably connected to the support arm 952 and movable on the track 924. The support arm actuator 956, under control of the controller CR, transversely moves the support arm 952 (and the components its supports as described herein) along the track 924. This enables the film-roll mover 950 to interact with the first replacement-film-roll holder 600 and to interact with the third applicator arm 330. The support arm actuator 956, under control of the controller CR, thus causes the support arm 952 and the entire film-roll mover 950 to move along the track 924 to be longitudinally aligned with different film holder supporter positions of the first replacement-film-roll holder 600 and to be longitudinally aligned with the third applicator arm 330 when the third applicator arm 330 is in a film roll receipt position such as shown in FIG. 1A.

The film-roll mover 950 further includes a longitudinally extending film roll transfer arm 960 longitudinally movably coupled to the support arm 952 and a transfer arm actuator 966 connected to the support arm 952 and operably coupled to the transfer arm 960. The transfer arm actuator 966, under control of the controller CR, longitudinally moves the film roll transfer arm 960 longitudinally inwardly and outwardly relative to the support arm 952. The film-roll mover 950 further includes a gripper 5000 (described below) connected to the end the film roll transfer arm 960. The film-roll mover 950 further includes a film roll leading-end holder 980 and film-roll mover actuator 986 that is configured to pivot the finger 984 of the holder 980. 950 further includes a film roll leading-end holder 980 fixedly connected to the film roll transfer arm 960. The film-roll mover 950 further includes a film roll leading-end holder 980 and film-roll mover actuator 986 are fixedly connected by bracket 981 to the arm 960 and thus moveable longitudinally therewith. The film roll leading-end holder 980 is otherwise similar to the film roll leading-end holder 450*a* described above and is thus not described herein for brevity. The film-roll mover 950 includes an actuator 976 configured to move the film roll transfer arm 960 and the film roll leading-end holder 980 upwardly and downwardly along tracks 958 attached to the support arm 952.

The first film-roll supplier 900 is configured to, responsive to the controller CR determining that a film roll held by the third applicator arm 330 is empty and needs to be replaced, and after that empty film roll has been transferred by the third applicator arm 330 to the first applicator arm 130 for removal, under control of the controller CR, obtains a replacement film roll from the first replacement-film-roll holder 600 and moves that replacement film roll to the third applicator arm 330 of the second wrapper 300.

Second Film-Roll Supplier

The second film-roll supplier 1900 is positioned between the second replacement-film-roll holder 1600 and the second empty-film-roll remover 2000 and transversely extends partially within the interior area of the machine frame 60. The second film roll first film-roll supplier 1900 includes is a mirror image of the first film roll first film-roll supplier 900 and is thus not described herein for brevity.

The second film-roll supplier 1900 is configured to, responsive to the controller CR determining that a film roll held by the fourth applicator arm 380 is empty and needs to be replaced, and after that empty film roll has been transferred by the fourth applicator arm 380 to the second applicator arm 180 for removal, under control of the controller CR obtain a replacement film roll from the second replacement-film-roll holder 1600 and move that replacement film roll to the fourth applicator arm 380 of the second wrapper 300.

First Empty-Film-Roll Remover

The first empty-film-roll remover 1000 is substantially similar to the first film-roll supplier 900, and is thus only briefly described herein for brevity.

The second empty-film-roll remover 1000 includes a remover frame 1020 and a film-roll mover 1050 (shown in FIGS. 1B and 1C) supported by the remover frame 1020. The remover frame 1010 is stationary and similar to the supplier frame 920. The remover frame 1020 is aligned in a longitudinal direction with the first empty-film-roll holder 800 such that the film-roll mover 1050 can reach each of the empty-film-roll holder supporter positions of the first empty-film-roll holder 800. The remover frame 1020 also transversely extends into an area within the machine frame 60 to enable the film-roll mover 1050 to be longitudinally aligned with the first applicator arm 130 of the first wrapper 100 such that the first applicator arm 130 can transfer an empty film roll to the film-roll mover 1050. The film-roll mover 1050 is substantially similar to the film-roll mover 950 except that: its longitudinally extending film roll transfer arm is longitudinally movable, under control of the controller CR, longitudinally inwardly and outwardly toward in an opposite direction; and it does not need to include a film roll leading-end holder.

Second Empty-Film-Roll Remover

The second empty-film-roll remover 2000 is substantially similar to the first empty-film-roll remover 1000, and is thus only briefly described herein for brevity.

The second empty-film-roll remover 2000 includes a remover frame 2020 and a film-roll mover 2050 (shown in FIG. 1C) supported by the remover frame 2020. The remover frame 2010 is stationary and similar to the remover frame 1010. The remover frame 2020 is aligned in a longitudinal direction with the second empty-film-roll holder 1800 such that the film-roll mover 2050 can reach each of the empty-film-roll holder supporter positions of the second empty-film-roll holder 1800. The remover frame 2020 also transversely extends into an area within the machine frame 60 to enable the film-roll mover 2050 to be longitudinally aligned with the second applicator arm 180 of the first wrapper 100 such that the second applicator arm 180 can transfer an empty film roll to the film-roll mover 2050. The film-roll mover 2050 is substantially similar to the film-roll mover 950 except that: its longitudinally extending film roll transfer arm is longitudinally movable, under control of the controller CR, longitudinally inwardly and outwardly toward in an opposite direction; and it does not need to include a film roll leading-end holder.

Preparing for Wrapping of a Coil and Film Roll Change Method

The method for preparing for wrapping a coil and changing empty film rolls with replacement film rolls using the film-roll-change system 50 is now described in more detail.

The method of preparing for wrapping of the next coil (i.e., before the next coil wrapping process begin), includes the controller CR determining if both of the film rolls FR1 and FR2 to be used by the first and second wrappers 100 and 300 to wrap a next coil have enough film for wrapping that next coil. If either one of those film rolls FR1 or FR2 do not have sufficient film to wrap the next coil, the controller CR causes a replacement of that insufficient film coil with a replacement film roll from the respective one of the replacement-film-roll holders 600 or 1600. Such insufficient film rolls are deemed or considered to be empty as mentioned above.

These determinations can be made based on data received by the controller CR from one or more sensors S and/or data related to when each film roll FR was previously replaced and the quantity of coils C that have been wrapped since each film roll FR began to be used. In various embodiments, the controller CR makes the determinations based on signals received from sensors S mounted on the respective grippers 5000 of the respective applicator arms 330 and 380 of the second wrapper 300, wherein the signals indicate readings of the amounts of film F left on the respective film F1 and F2 of the film rolls FR1 and FR2 (after the previous coil C has been wrapped). In other embodiments, the controller CR makes these determinations based on usage data that the controller CR tracks and maintains regarding each of the currently employed film rolls FR1 and FR2 and the quantity and sizes of the coils C previously wrapped using such currently employed film rolls FR1 and FR2 (as well as the amount or length of the film of each film roll). In other embodiments, the controller CR makes these determinations based on signals received from the sensors S and based on such usage data.

Responsive to the controller CR determining that the film roll FR2 held by the third applicator arm 330 is insufficient to wrap the next coil, the controller CR generally causes: (1) the third applicator arm 330 to transfer the empty film roll FR2 to the first applicator arm 130, (2) the first applicator arm 130 to transfer the empty film roll FR2 to the first empty-film-roll remover 1000, (3) the first empty-film-roll remover 1000 to transfer the empty film roll FR2 to the first empty-film-roll holder 800, (4) the first film-roll supplier 900 to obtain a replacement film roll RFR from the first replacement-film-roll holder 600, and (5) the first film-roll supplier 900 to transfer that obtained replacement film roll RFR to the third applicator arm 330. Steps (2) and (3) can be performed simultaneously with steps (4) and (5) in this example embodiment.

Similarly, responsive to controller CR determining that the film roll FR1 held by the fourth applicator arm 380 is insufficient to wrap the next coil, the controller CR generally causes: (A) the fourth applicator arm 380 to transfer the empty film roll FR1 to the second applicator arm 180, (B) the second applicator arm 180 to transfer the empty film roll FR1 to the second empty-film-roll remover 2000, (C) the second empty-film-roll remover 2000 to transfer the empty film roll FR1 to the second empty-film-roll holder 1800, (D) the second film-roll supplier 1900 to obtain a replacement film roll RFR from the second replacement-film-roll holder 1600, and (E) the second film-roll supplier 1900 to transfer that obtained replacement film roll to the fourth applicator arm 380. Steps (B) and (C) can be performed simultaneously with steps (D) and (E) in this example embodiment. Additionally, Steps (B) and (C), (2) and (3), (C) and (D), and (4) and (5) can be performed simultaneously in this example embodiment.

Since the methods for replacing film rolls FR1 and FR2 are substantially identical in this example embodiment, only the method for replacing empty film roll FR2 is described in more detail herein for brevity. The method for replacing empty film roll FR2 as described below includes positioning each of the first and second wrappers 100 and 300, the applicator arms 130 and 330 of the first and second wrappers 100 and 300, and the film-roll movers 950 and 1050. This positioning can include any necessary vertical, longitudinal, and/or transverse movements of these respective components by the respective actuators described above. All of these movements are controlled by the controller CR based on the specific points in the film roll change process. Additionally, one or more of these movements can be monitored by one or more sensors S, and one or more of these movements can be caused by the controller CR based on feedback from one or more of the sensors S.

More specifically, this method of replacing empty film roll FR2 first includes vertically moving, if necessary, each of the first wrapper 100 and the second wrapper 300 to their respective vertical film-change positions. In these film change positions, the third applicator arm 330 is vertically aligned (i.e., at the same vertical height) with the first applicator arm 130, the third applicator arm 330 is vertically aligned (i.e., at the same vertical height) with the film-roll mover 950, and the first applicator arm 130 is vertically aligned (i.e., at the same vertical height) with the film-roll mover 1050.

This method then includes causing the third applicator arm 330 transferring the empty film roll FR2 to the first applicator arm 130 which includes: (a) longitudinally inwardly moving the third applicator arm 330 to position its gripper 5000 and the film roll FR2 held by that gripper to a film-roll-transfer position; (b) longitudinally inwardly moving the first applicator arm 130 to position its gripper 5000 (which is not holding any film roll at this point) at the film-roll-transfer position; (c) transferring the film roll FR2 from the gripper 5000 of the third applicator arm 330 to the gripper 500 of the first applicator arm 130 at the film-roll-transfer position; (d) longitudinally outwardly moving the third applicator arm 330 with its gripper 5000 now being empty; and (e) longitudinally outwardly moving the first applicator arm 130 with its gripper 5000 now holding the film roll FR2. Steps (a) and (b) can be performed simultaneously and steps (d) and (e) can be performed simultaneously in this embodiment.

This method then includes causing the first applicator arm 130 to transfer the empty film roll FR2 to the first empty-film-roll remover 1000 and causing the first empty-film-roll remover 1000 to transfer the empty film roll FR2 to the first empty-film-roll holder 800. This include: (f) transversely moving the film-roll mover 1050 of the first empty-film-roll remover 1000 such that the gripper thereof is longitudinally aligned with the first applicator arm 130; (g) longitudinally outwardly moving the gripper 5000 of the film-roll mover 1050 to a film-roll-transfer position; (h) longitudinally inwardly moving, if necessary, the first applicator arm 130 to position its gripper 5000 and the film roll FR2 at the film-roll-transfer position; (i) transferring the film roll FR2 from the gripper 5000 of the first applicator arm 130 to the gripper of the film-roll mover 1050; (j) longitudinally outwardly moving the first applicator arm 130 with its gripper 5000 now being empty; (k) longitudinally inwardly moving the film-roll mover 1050 with its gripper 5000 now holding the film roll FR2; (l) transversely moving (and if necessary vertically moving) the film-roll mover 1050 with its gripper 5000 holding the film roll FR2 to a position aligned with one of the empty film roll supporters of the first empty-film roll holder 800; (m) longitudinally moving the film-roll mover 1050 outwardly to position its gripper to transfer the empty film roll FR2 to the selected empty film roll supporter of the first empty-film-roll holder 800; (n) transferring the empty film roll FR2 from the gripper of the film-roll mover 1050 to the selected empty film roll supporter of the first empty-film-roll holder 800; and (o) longitudinally moving the film-roll mover 1050 inwardly with its gripper now empty.

Figure 3A:
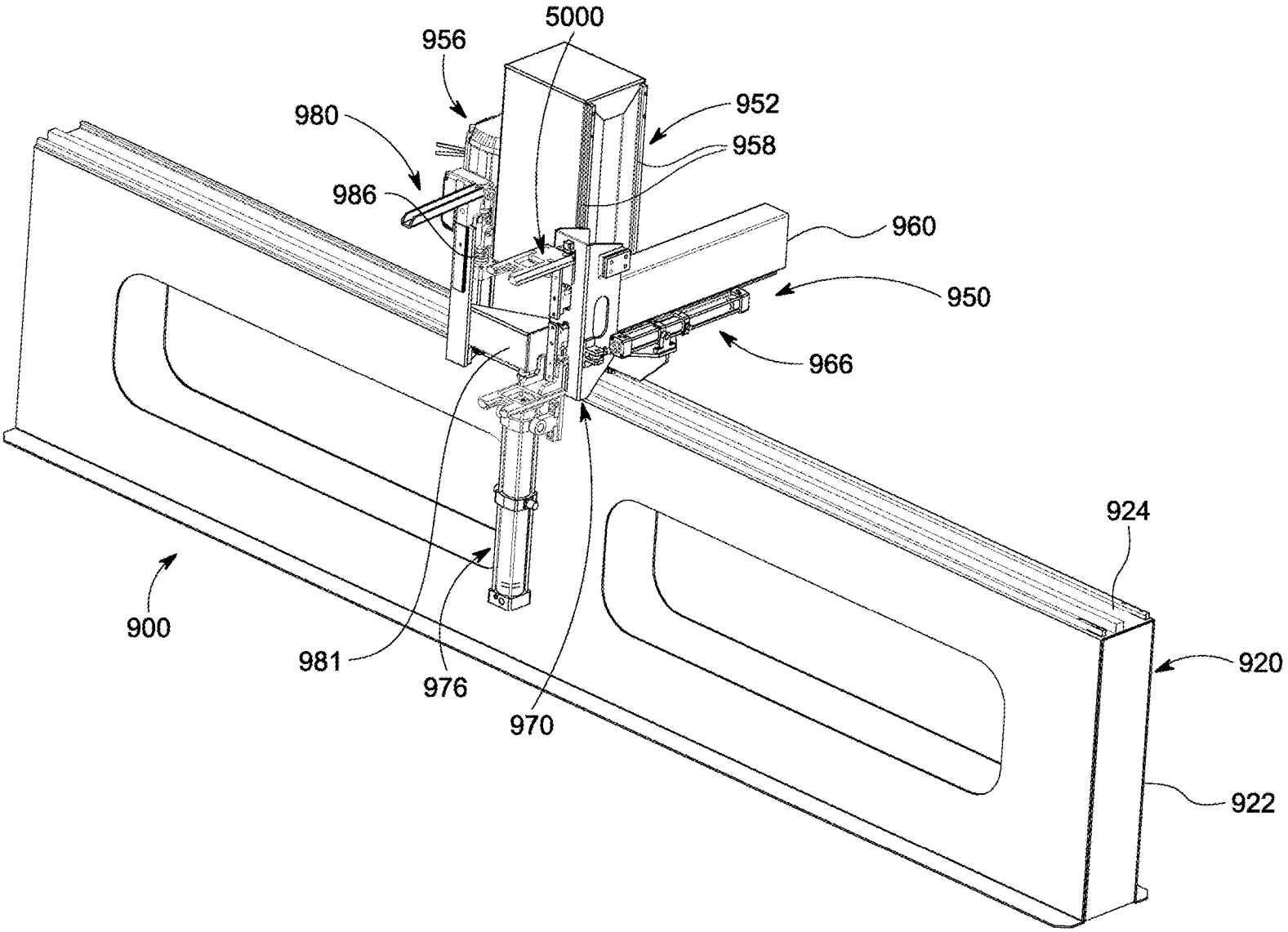
FIG. 3A is a perspective view of the first film-roll supplier of the film-change system of the coil-wrapping system of FIG. 1A.
Figure 3B:
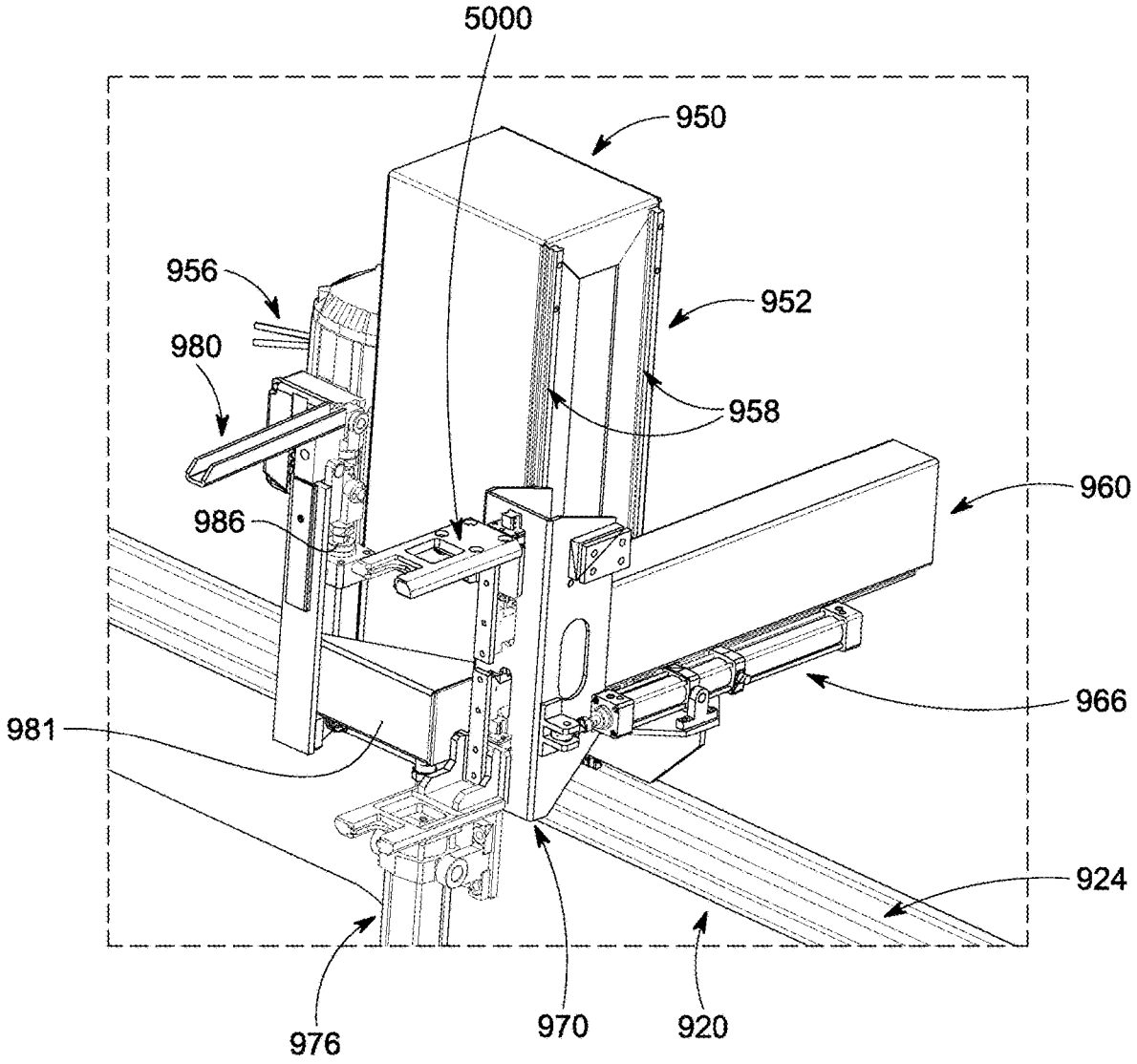
FIG. 3B is a fragmentary perspective view of the first film-roll supplier of FIG. 3A showing the film-roll mover thereof.
Figure 3C:
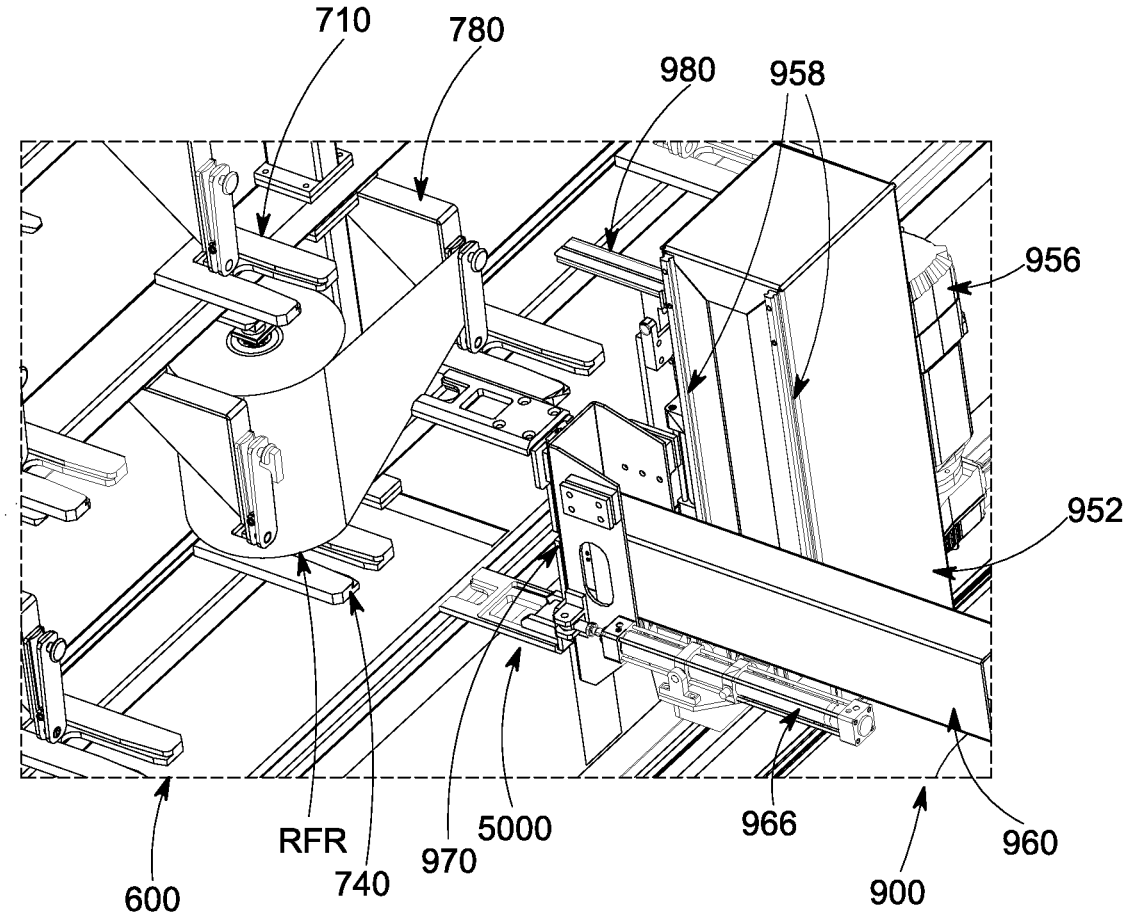
FIG. 3C is a fragmentary perspective view of the first replacement-film-roll holder and the first film-roll supplier of the film-change system of FIG. 3A showing the film-roll mover aligned with an positioned to remove a replacement coil from a supporter of the first replacement-film-roll holder.
Figure 3D:
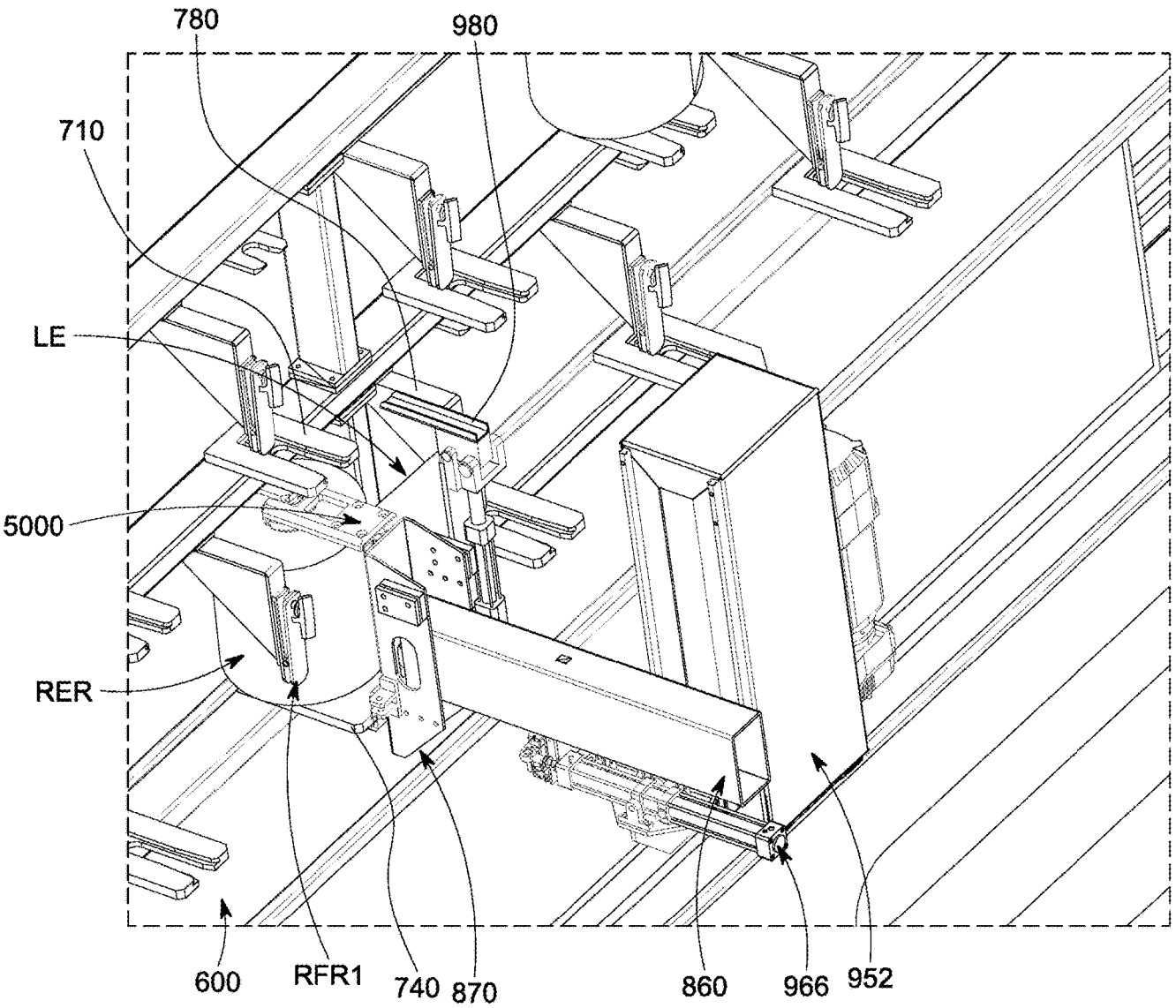
FIG. 3D is an enlarged fragmentary perspective view of the first replacement-film-roll holder and the first film-roll supplier of the film-change system of FIG. 3A, showing the film-roll mover at an initial point in the process of removing a replacement coil from a supporter of the first replacement-film-roll holder.
Figure 3E:
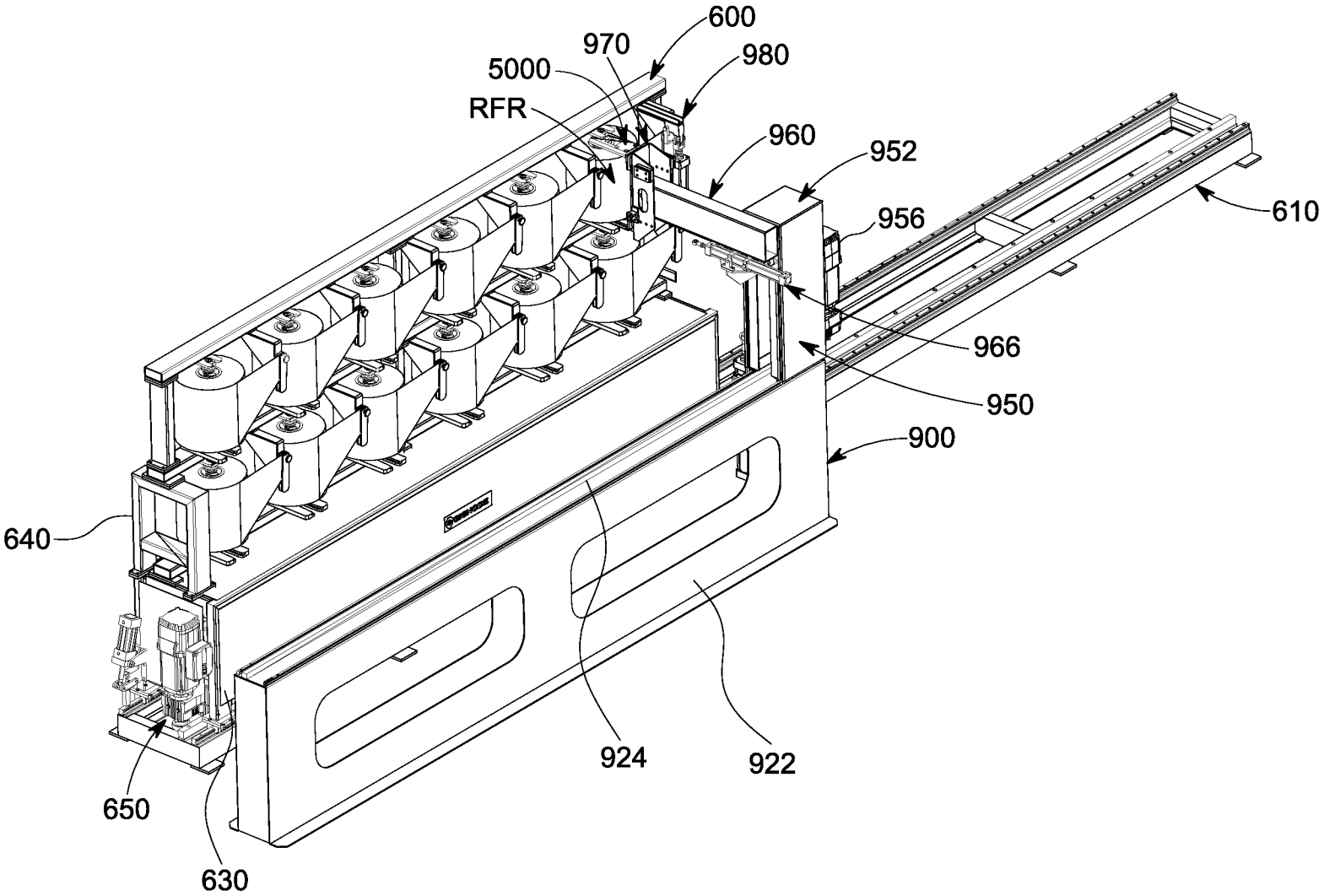
FIG. 3E is a perspective view of the first replacement-film-roll holder and the first film-roll supplier of the film-change system of FIG. 3A showing the film-roll mover at an initial point in the process of removing a replacement coil from a supporter of the first replacement-film-roll holder.
Figure 3F:
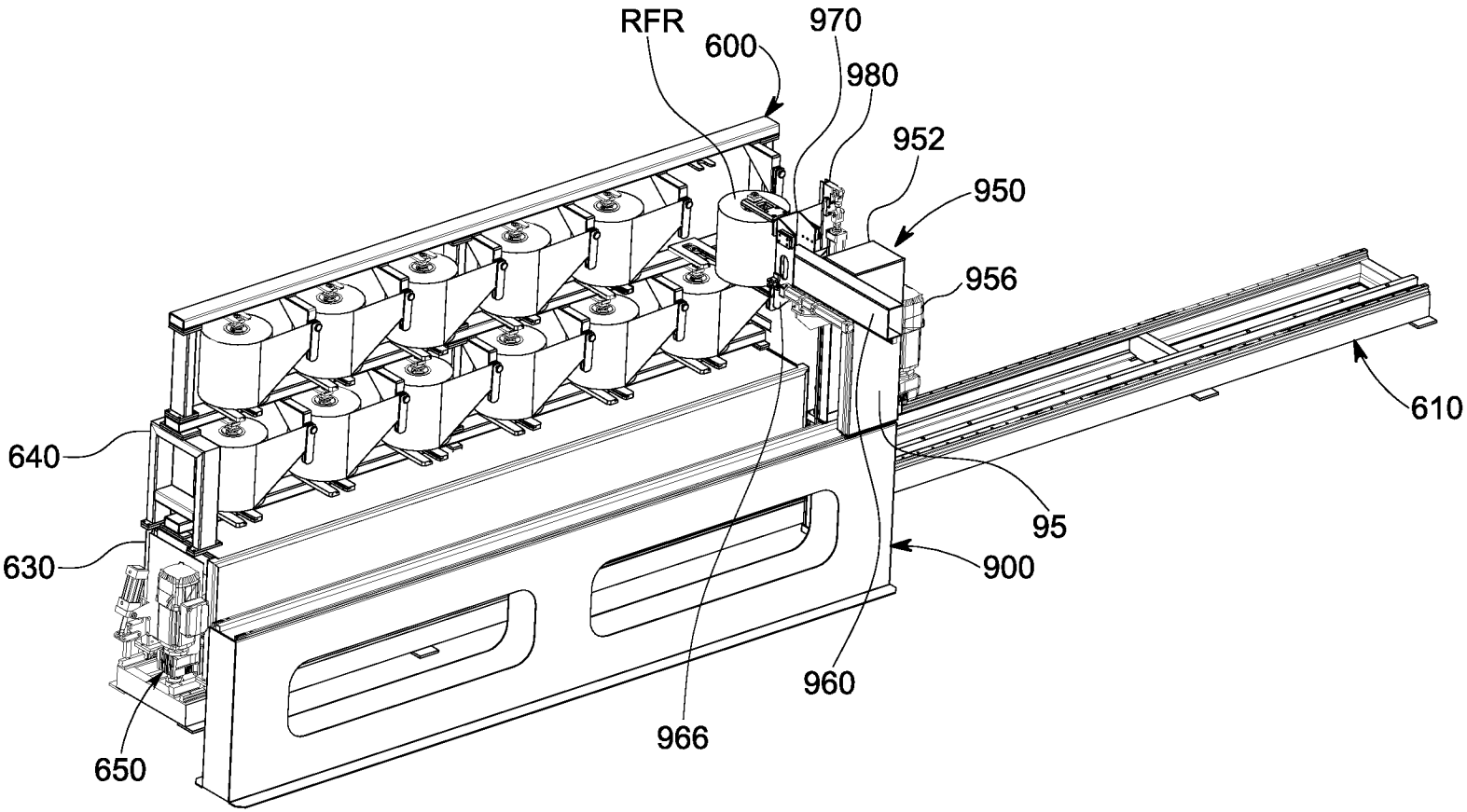
FIG. 3F is an enlarged perspective view of the first replacement-film-roll holder and the first film-roll supplier of the film-change system of FIG. 3A showing the film-roll mover after removing a replacement coil from a supporter of the first replacement-film-roll holder.

This method also includes causing the first film-roll supplier 900 to obtain a replacement film roll RFR from the first replacement-film-roll holder 600 and the first film-roll supplier 900 to transfer that obtained replacement film roll from to the third applicator arm 330. This includes: (q) moving the film roll transfer arm 960 of the film-roll mover 950 and its gripper 5000 (which at this point is not holding any film roll) to a position longitudinally aligned with one of the film roll supporters 700 of the replacement-film-roll holder 600 that is holding a replacement film roll RFR (which can also include vertically moving the film roll transfer arm 960), such as shown in FIG. 3C; (r) longitudinally moving the film roll transfer arm 960 outwardly to position the gripper 5000 thereof for the transfer (here the grabbing) of the replacement film roll RFR from the film roll supporter of the first replacement-film-roll holder 600(s) and longitudinally moving the film roll leading-end holder 980 attached to the film roll transfer arm 960 for the transfer (here the grabbing) of the leading end of the replacement film roll from the first replacement-film-roll holder 600, such as shown in FIG. 3D or 3E; (s) transferring (here grabbing) the replacement film roll RFR from the first replacement-film-roll holder 600 and transferring (here grabbing) the leading end of the replacement film roll RFR from the leading-end holder 780 of the first replacement-film-roll holder 800, such as shown in FIG. 3D or 3E; (t) longitudinally inwardly moving the film roll transfer arm 960 with its gripper 5000 now holding the replacement film roll RFR and simultaneously longitudinally inwardly moving the film roll leading-end holder 980 now holding the leading end of the replacement film roll RFR, such as shown in FIG. 3F; (u) transversely moving the film roll transfer arm 960 with it gripper 5000 holding the replacement film roll RFR and transversely moving the film roll leading-end holder 980 holding the leading end of the replacement film roll RFR to positions respectively longitudinally aligned with the third applicator arm 330 and the first leading end holder 450*a* (which can also include, in necessary vertically moving these components); (v) longitudinally inwardly moving, if necessary, the third applicator arm 330 to position its gripper 5000 to a film-roll-transfer position; (w) longitudinally inwardly moving, if necessary, the first leading end holder 450*a* to a film-leading-end-transfer position; (x)

transferring the replacement film roll RFR from the gripper 5000 of the film-roll mover 950 to the gripper 5000 of the third applicator arm 330; (y) transferring the leading end of the film of the replacement film roll RFR from the film roll leading-end holder 980 to the first leading end holder 450*a*; (z) longitudinally outwardly moving the third applicator arm 330 with its gripper 5000 now holding the replacement film roll RFR and longitudinally outwardly moving the first leading end holder 450*a* now holding the leading end of the replacement film roll RFR; (aa) longitudinally inwardly moving the film-roll mover 950 with its gripper 5000 and film roll holder 980 now empty; and (bb) transversely moving the film-roll mover 950 with its gripper 5000 and film roll holder 980 now empty.

Mandrel

FIGS. 4A-4L illustrate a mandrel 4000 configured to support a film roll in accordance with one example embodiment of the present disclosure. As indicated above, numerous film rolls are employed for use with the coil-wrapping system 50. Each film roll is mounted on a mandrel such as the mandrel 4000. The mandrel 4000 includes an inner mandrel assembly 4100 and an outer mandrel assembly 4200. While the inner mandrel assembly 4100 and outer mandrel assembly 4200 are rotatable with respect to each other, when the inner mandrel assembly 4100 is held stationary by a mandrel gripper such as mandrel gripper 5000 described below, the outer mandrel assembly 4200 and the film roll mounted on the outer mandrel assembly 4200 are rotatable under tension (as described below) to release film from the film roll onto a coil such as in the manner described above. The mandrel 4000 maintains the film under tension as the film is applied to the coil by the respective applicator arms. The mandrel 4000 is additionally configured to be held by the respective mandrel grippers of the applicator arms and to be transferred from one applicator arm to another applicator arm as described above.

Inner Mandrel Assembly

The inner mandrel assembly 4100 includes: a top handle assembly 4110, a shaft 4130, an inner rotation assembly 4140, and a bottom handle assembly 4150.

Top Handle Assembly

The top handle assembly 4110 includes: a top handle retaining screw 4112, a top handle retaining washer 4114, a top handle 4116, a top handle locknut 4126, and a top handle lock washer 4128.

The top handle retaining screw 4112 and the top handle retaining washer 4114 secure the top handle 4116 to the shaft 4130 such that the top handle 4116 and the shaft 4130 are rotationally locked together.

The top handle 4116 is sized, shaped, positioned, oriented, and otherwise configured to be removably engaged by the upper mandrel claw 5210 of the mandrel gripper 5000 as described below. The top handle 4116 is fixed to the shaft 4130 via a keyed connection such that the top handle 4116 and the shaft 4130 rotate together. The top handle 4116 includes: an outer handle cylinder 4118, an outer handle block 4120, an inner handle cylinder 4122, and an inner handle block 4124. The outer handle cylinder 4118 is cylindrical, and is aligned with a longitudinal axis 4130A of the shaft 4130. The outer handle cylinder 4118 is sized, shaped, positioned, oriented, and otherwise configured to be engaged by the mandrel engager 5230 of the upper mandrel claw 5210. The outer handle block 4120 is rectangular in shape, and includes a top surface (not labeled) and a bottom surface (not labeled). The top surface is sized, shaped, positioned, oriented, and otherwise configured to be engaged by the fingers 5520 and 5520 of the upper mandrel claw 5210. The inner handle cylinder 4122 can be similar or identical to the outer handle cylinder 4118, in that it is cylindrical in shape and is coaxial with the central axis of the shaft 4130. The inner handle cylinder is also sized, shaped, positioned, oriented, and otherwise configured to be engaged by the upper mandrel claw 5210. The inner handle block 4124 can be similar or identical to the outer handle block 4120, in that it is square in shape, and includes a top surface (not labeled) and a bottom surface (not labeled). The top surface is sized, shaped, positioned, oriented, and otherwise configured to be engaged by the fingers 5520 and 5520 of the upper mandrel claw 5210.

The top handle locknut 4126 and the top handle lock washer 4128 secure the top handle 4116 to the shaft 4130, such that the top handle 4116 and shaft 4130 are locked in rotation together.

The top handle assembly 4110 is rotationally locked to the fingers 5520 and 5520 of the upper mandrel claw 5210 of the mandrel gripper 5000 when the mandrel 4000 is grabbed by the mandrel gripper 5000.

Shaft

The shaft 4130 of the inner mandrel assembly 4100 provides a central support structure to which the top handle assembly 4110, the inner rotation assembly 4140, and the bottom handle assembly 4140 are attached. The shaft 4130 is cylindrical. The shaft 4130 includes a top section, a middle section, and a bottom section having different diameters. The top diameter is smaller than the middle diameter, such that the transition between the top section and the middle section of the shaft 4130 defines a top shelf 4132. The top shelf 4132 is configured to engage the top handle assembly 4110. Similarly, the bottom diameter is smaller than the middle diameter, such that the transition between the bottom section and the middle section of the shaft 4130 defines a bottom shelf 4134. The bottom shelf 4134 is configured to engage the bottom handle assembly 4140. The shaft 4130 is fixed to the top handle assembly 4110, the inner rotation assembly 4140, and the bottom handle assembly 4140. The shaft 4130 is sized, shaped, positioned, oriented, and otherwise configured to engage various bearings of the outer mandrel assembly 4200, including the top bearing 4240, the bottom bearing 4242, and the slew-axial bearing 4244.

Inner Rotation Assembly

The inner rotation assembly 4140 includes: a fixed clutch disc 4142, a fixed disc butting plate 4144, and top and bottom disc springs 4146A and 4146B, respectively.

The fixed clutch disc 4142 is attached to the shaft 4130 via a keyed, splined, or other suitable connection such that they are both rotationally fixed to the top handle assembly 4110. The fixed clutch disc 4142 includes a top surface (not labeled) and bottom surface (not labeled). The top surface of the fixed clutch disc 4142 is sized, shaped, positioned, oriented, and otherwise configured to engage a bottom surface of the rotary clutch disc 4238 of the outer mandrel assembly 4200 to provide a force resisting rotation of the outer mandrel assembly 4200 relative to inner mandrel assembly 4100 about the longitudinal axis 4130A.

The fixed disc butting plate 4144 provides support for the fixed clutch disc 4142, and is sized, shaped, positioned, oriented, and otherwise configured to engage the bottom surface of the fixed clutch disc 4142. The fixed disc butting plate 4144 is attached to the shaft 4130 such that it is rotationally fixed to the top handle assembly 4110. The fixed disc butting plate 4144 includes a top surface (not labeled)

that engages the fixed clutch disc 4142, and a bottom surface (not labeled) that is engaged by the top disc spring member 4146A.

The top and bottom disc springs 4146A and 4146B comprise a two part spring. The top disc spring 4146A is sized, shaped, positioned, oriented, and otherwise configured to engage the bottom surface of the fixed disc butting plate 4144, and the bottom disc spring 4146B is sized, shaped, positioned, oriented, and otherwise configured to be engage by the bottom handle lock washer 4152.

During operation of the mandrel 4000, the inner rotation assembly 4140 is rotationally fixed to the top handle assembly 4110. The inner rotation assembly 4140 is sized, shaped, positioned, oriented, and otherwise configured to engage with the outer mandrel assembly 4200 via contact between the fixed clutch disc 4142 of the inner rotation assembly 4140 and the rotary clutch disc 4238 of the outer mandrel assembly 4200, to provide a desired amount of resistance to rotation of the outer mandrel assembly 4200 with respect to the inner mandrel assembly 4100.

Bottom Handle Assembly

The bottom handle assembly 4150 includes: a bottom handle lock washer 4152, a bottom handle locknut 4154, a bottom handle 4156, a bottom handle retaining washer 4158, and a bottom handle retaining screw 4160.

The bottom handle lock washer 4152 is sized, shaped, positioned, oriented, and otherwise configured to engage the bottom disc spring 4146B to provide a force that is transferred through the disc springs 4146A and 4146B to the fixed clutch disc 4142. Along with the bottom handle locknut 4154, the bottom handle lock washer 4152 secures the bottom handle 4156 to the shaft 4130, such that the bottom handle 4156 and the shaft 4130 are rotationally fixed to the top handle assembly 4110.

The bottom handle 4156 can be similar or identical to the top handle 4116. Thus, only the top handle is described in detail herein for brevity.

The bottom handle retaining washer 4158 and the bottom handle retaining screw 4160 secure the bottom handle 4156 to the shaft 4130, such that the bottom handle 4156 and shaft 4130 are rotationally fixed to the top handle assembly 4110. To increase or decrease tension on the disc springs 4146A and 4146B (and thus on the fixed clutch disc 4142), the bottom handle retaining screw 4160 can be screwed in or out to increase or decrease the force on the disc springs 4146A and 4146B. This, in turn, can increase or decrease the friction between the fixed clutch disc 4142 and the rotary clutch disc 4238.

Outer Mandrel Assembly

The outer mandrel assembly 4200 includes: a film roll retainer assembly 4210, an outer mandrel body 4220, an outer rotation assembly 4230, and a plurality of bearings and support structures (not labeled).

Outer Mandrel Body

The outer mandrel body 4220 includes: a top surface 4222 and a lower lip 4224, and defines a rotation stopper slot 4226.

The top surface 4222 is a surface of the outer mandrel body 4220 to which the retainer core 4216 is affixed. The lower lip 4224 extends from a bottom of the outer mandrel body 4220, and provides a surface on which a bottom of a film roll rests. The lower lip 4224 prevents the film roll from sliding off the bottom of the mandrel 4000.

The rotation stopper slot 4226 is an opening defined by the outer mandrel housing 4220 that accepts the rotation stopper 4232 of the outer rotation assembly 4230, as described below.

The outer mandrel body 4220 rotates with respect to the inner mandrel assembly 4100.

Film Roll Retainer Assembly

The film roll retainer assembly 4210 includes: a retainer core screw 4212, a spring holding pin 4214, and a retainer core 4216.

The retainer core screw 4212 rotatably secures the retainer core 4216 to the outer mandrel body 4220, and in particular to a top surface (not labeled) of the outer mandrel body 4220. The spring holding pin 4214 is sized, shaped, positioned, oriented, and otherwise configured to engage a first end (not labeled) of a spring (not shown), wherein a second end of the spring (not shown) is attached to the outer mandrel body 4220. The spring holding pin 4214 is attached to the retainer core 4216. The retainer core 4216 is rotatably attached to the outer mandrel body 4220 by the retainer core screw 4212, and is biased by the spring (not shown) to a first position extending radially out from the outer mandrel body 4220.

During operation, the retainer core screw 4212, spring holding pin 4214, spring (not shown), and retainer core 4216 bias the retainer core 4216 to the first position extending radially outward from the outer mandrel body 4220. When a film roll is positioned on mandrel 4000, a bottom surface of the retainer core 4216 prevents the film roll from sliding upward. To remove a film roll from or to add a film roll to the mandrel 4000, the retainer core 4216 is pivoted to a second position in which the retainer core 4216 extends along the curve of the outer mandrel body 4220. In the second position, the retainer core 4216 is rotated inward and does not prevent a roll from sliding on or off the mandrel 4000.

Outer Rotation Assembly

The outer rotation assembly 4230 includes: a rotation stopper 4232, a tension spring 4234, a spring housing 4236, and a rotary clutch disc 4238.

The rotation stopper 4232 is attached to a first end of the tension spring 4234, and is positioned in the rotation stopper slot 4226 of the outer mandrel body 4220. The positioning of the rotation stopper 4232 in the rotation stopper slot 4226 causes the rotation stopper 4232 to rotate along with the rotation of the outer mandrel body 4220.

The tension spring 4234 is attached at a first send to the rotation stopper 4232, extends within the spring housing 4236, and is attached to the spring housing 4236 at a second end. The tension spring 4234 provides a biasing force between the rotation stopper 4232 and the spring housing 4236.

The spring housing 4236 defines an opening for the tension spring 4234 to extend circumferentially around the inside of the outer mandrel body 4220. The spring housing 4236 includes a top surface (not labeled) that is sized, shaped, positioned, oriented, and otherwise configured to engage the slew-axial bearing 4244, and a bottom surface (not labeled) that is sized, shaped, positioned, oriented, and otherwise configured to engage the rotary clutch disc 4238.

The rotary clutch disc 4238 is sized, shaped, positioned, oriented, and otherwise configured to engage the fixed clutch disc 4142. The rotary clutch disc 4238 includes a top surface (not labeled) and bottom surface (not labeled). The top surface of the rotary clutch disc 4238 is sized, shaped, positioned, oriented, and otherwise configured to engage the spring housing 4236. The bottom surface of the rotary clutch disc 4236 is sized, shaped, positioned, oriented, and otherwise configured to engage the fixed clutch disc 4142, to provide a force resisting rotation of outer mandrel assembly 4200 relative to inner mandrel assembly 4100 about the longitudinal axis 4130A.

Bearings and Support Structures

The outer mandrel assembly 4200 includes: several bearings and support structures, including: a top bearing 4240, a bottom bearing 4242, a slew axial bearing 4244, a plurality of leaf springs 4246A-H, and a retainer ring 4248.

The top bearing 4240 and the bottom bearing 4242 each comprise a ball bearing disposed between the shaft 4130 and the outer mandrel body 4220. The top bearing 4240 and bottom bearing 4242 enable rotation of the outer mandrel assembly 4200 with respect to inner mandrel assembly 4100.

The slew-axial bearing 4244 is positioned between the shaft 4130 and the outer mandrel body 4220. The slew-axial bearing 4244 enables rotation of the outer mandrel assembly 4200 with respect to inner mandrel assembly 4100. The slew-axial bearing 4244 also provides vertical support to the outer mandrel body 4220 with respect to shaft 4130.

The leaf springs 4246A-H are each attached to the outer surface of the outer mandrel body 4220. Leaf springs 4246A-H are positioned in pairs vertically, and spaced apart around a circumference of outer mandrel body 4220. This illustrated example embodiment includes eight leaf springs, however more or less leaf springs can be employed. Additionally, other types of springs can be used as employed. Leaf springs 4246A-H push outward against an inner surface of a film roll, to rotationally fix the film roll to the outer mandrel body 4220.

The retainer ring 4248 is sized, shaped, positioned, oriented, and otherwise configured to engage the bottom bearing 4242, and secures the bottom bearing 4242 in place with respect to the outer mandrel body 4220.

Together, the inner mandrel assembly 4100 and the outer mandrel assembly 4200 provide rotational forces with respect to the film of the film roll, to enable the film to be applied to and wrapped on a coil under a relatively constant tension (or tension within a designated range).

The spring housing 4236 is rotationally fixed to the rotary clutch disc 4238, which ensures that the spring housing 4236 (and the second end of the tension spring 4234 that is attached thereto) rotates along with the rotary clutch disc 4238. The first end of the tension spring 4234 is fixed to the rotation stopper 4232, and the rotation stopper 4232 is positioned in the rotation stopper slot 4226 of the outer mandrel housing 4220 such that the first end of the tension spring 4234, rotation stopper 4232, and outer mandrel housing 4220 are all rotationally fixed to each other.

Thus, there are three separate groupings of components that are rotationally fixed to the other components within their respective group: (1) the inner mandrel assembly 4100, which is rotationally holdable by the upper mandrel claw 5210 and the lower mandrel claw 5250 of the mandrel gripper 5000, (2) the rotary clutch disc 4238 and the spring housing 4236, and (3) the remaining components of the outer mandrel assembly 4200. There are also three bearings that are each connected to two of these three groups, including: (1) the top bearing 4240 disposed between the shaft 4130 of the inner mandrel assembly 4100 and the outer mandrel body 4220, (2) the bottom bearing 4242 disposed between the shaft 4130 of the inner mandrel assembly 4100 and the outer mandrel body 4220, and (3) the slew-axial bearing 4244 disposed between the spring housing 4236 and the outer mandrel body 4210.

FIGS. 4H, 4I, 4J, 4K, and 4L show cross-sections of the rotation stopper 4232, tension spring 4234, and spring housing 4236. FIGS. 4H, 4I, 4J, 4K, and 4L illustrate the position of these parts at rest and during the process of wrapping film around the coil.

Figure 4A:
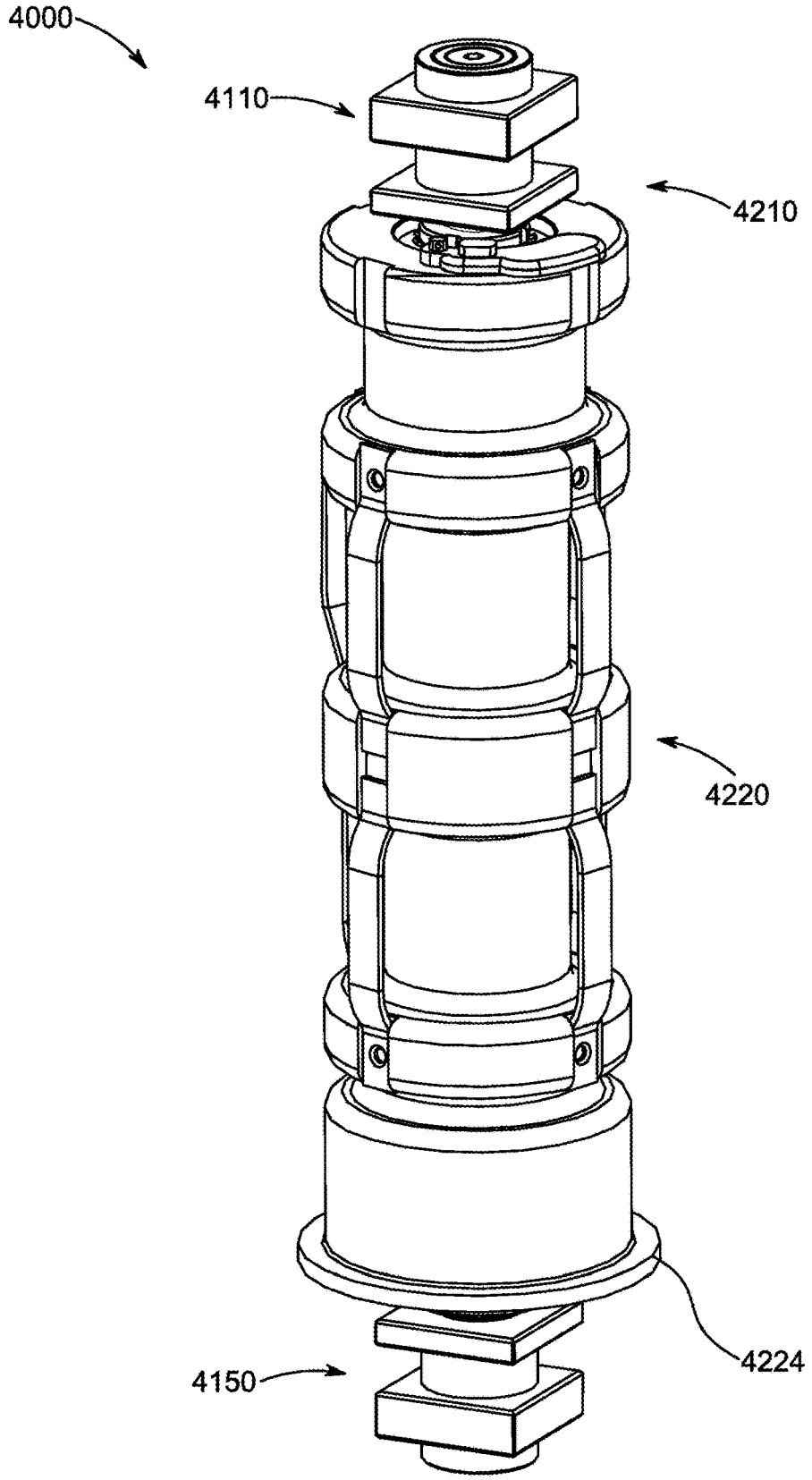
FIG. 4A is a top perspective view of one example mandrel of the present disclosure that serves as a mount for a film roll.
Figure 4B:
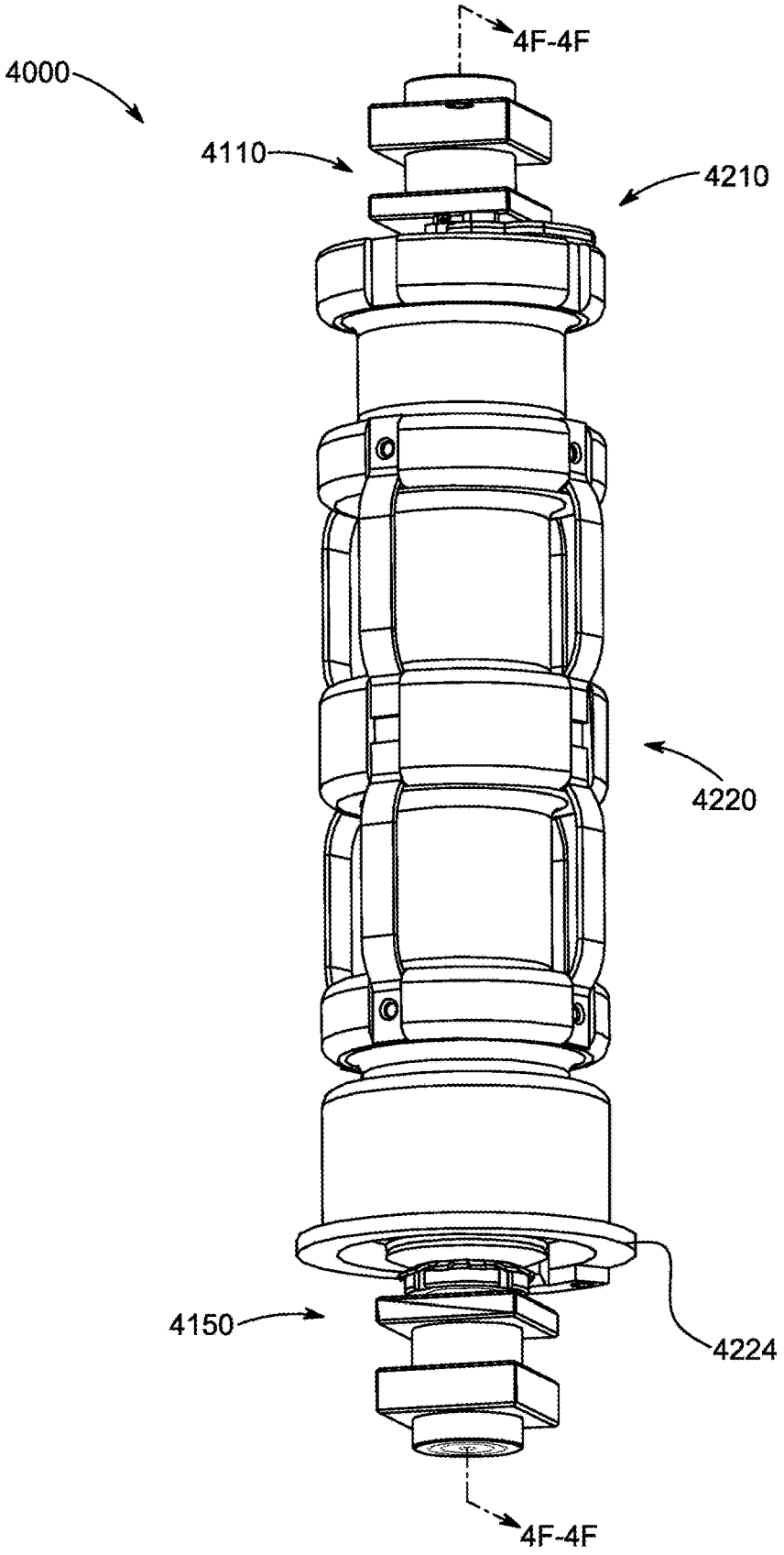
FIG. 4B is a bottom perspective view of the mandrel of FIG. 4A.
Figure 4C:
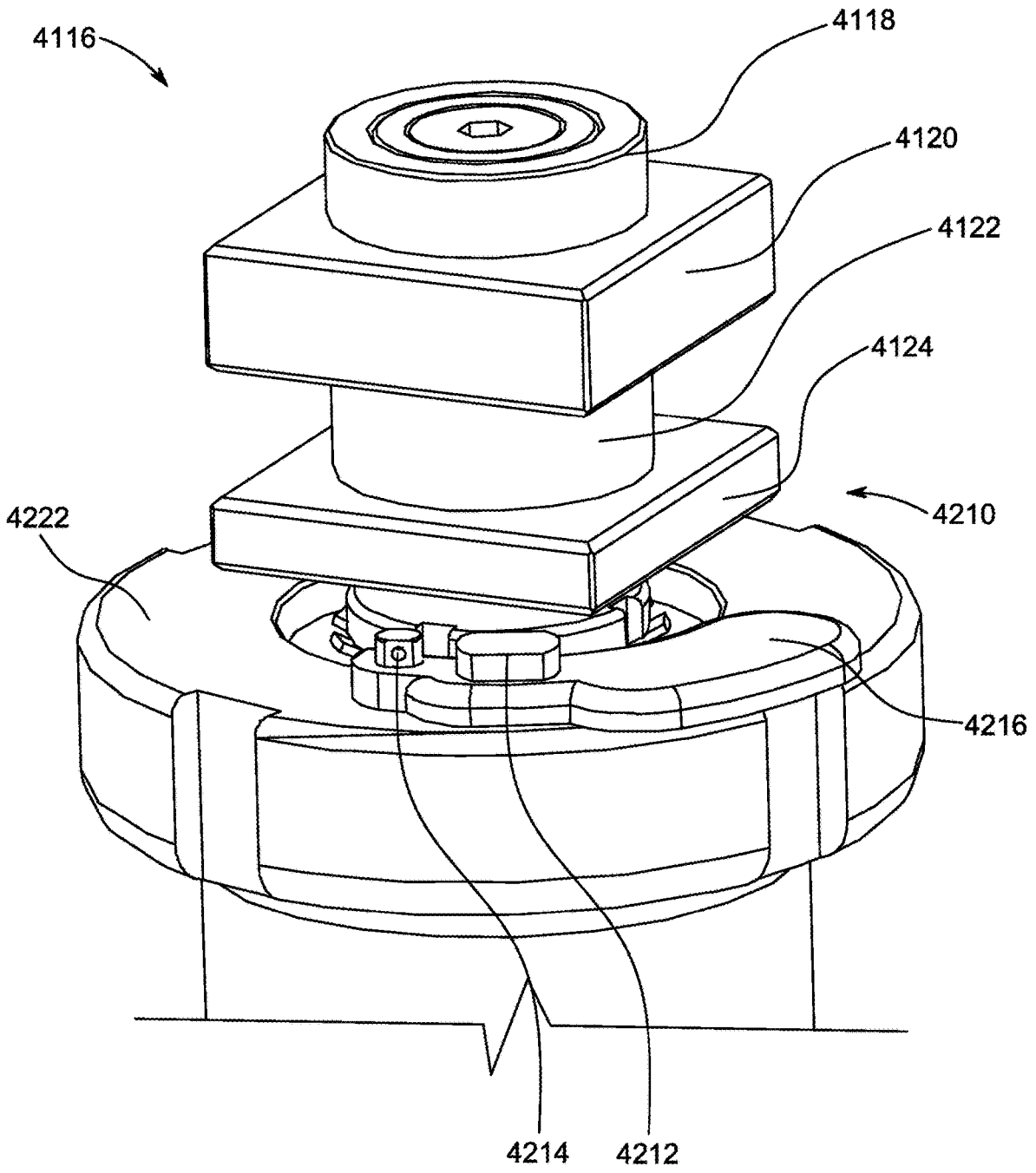
FIG. 4C is a perspective view of the top of mandrel of FIG. 4A.
Figure 4D:
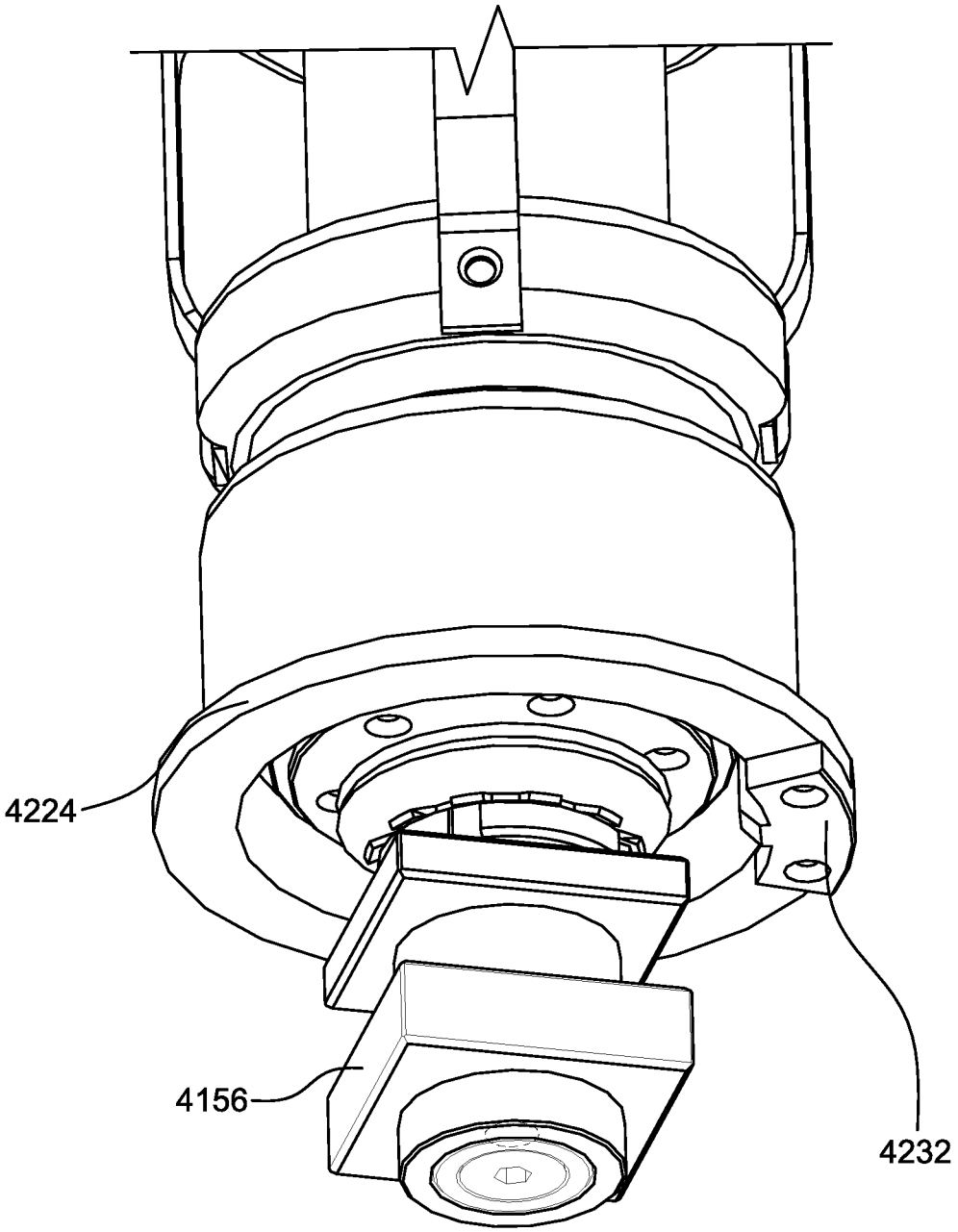
FIG. 4D is a perspective view of the bottom mandrel of FIG. 4A.
Figure 4E:
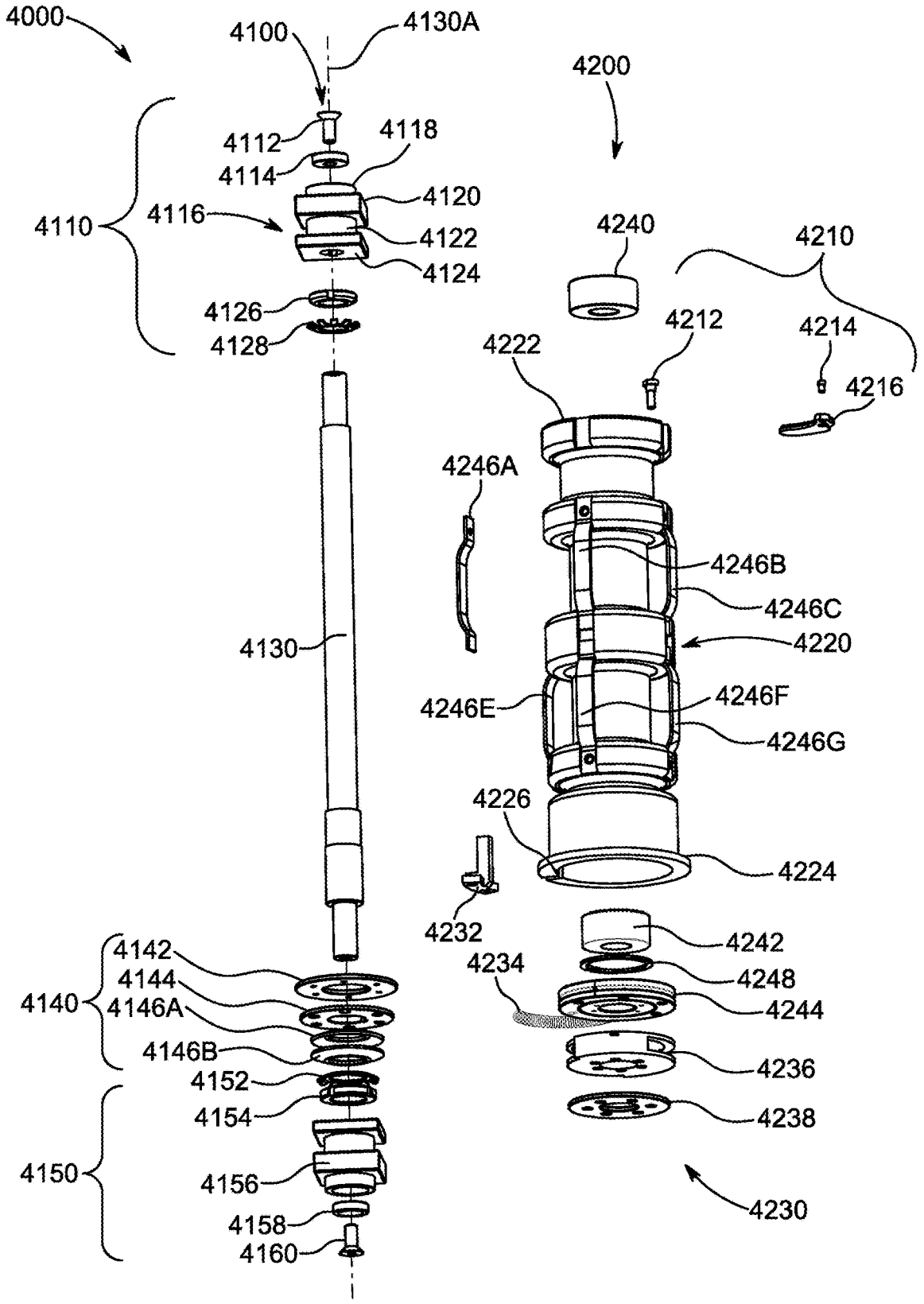
FIG. 4E is a partially exploded view of the mandrel of FIG. 4A.
Figure 4F:
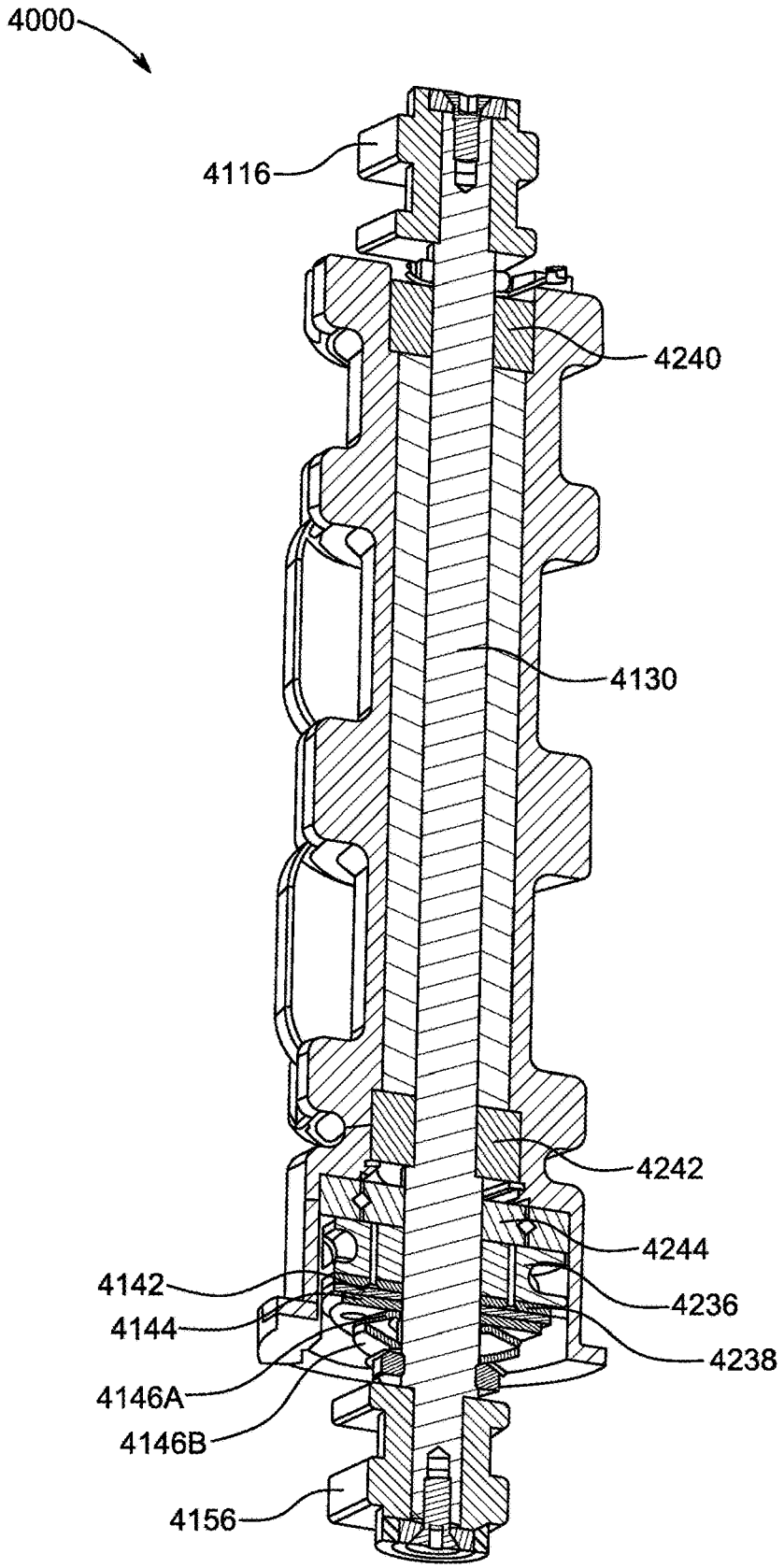
FIG. 4F is a cross-sectional perspective view of the mandrel of FIG. 4A taken along line 4F-4F of FIG. 4B.
Figure 4G:
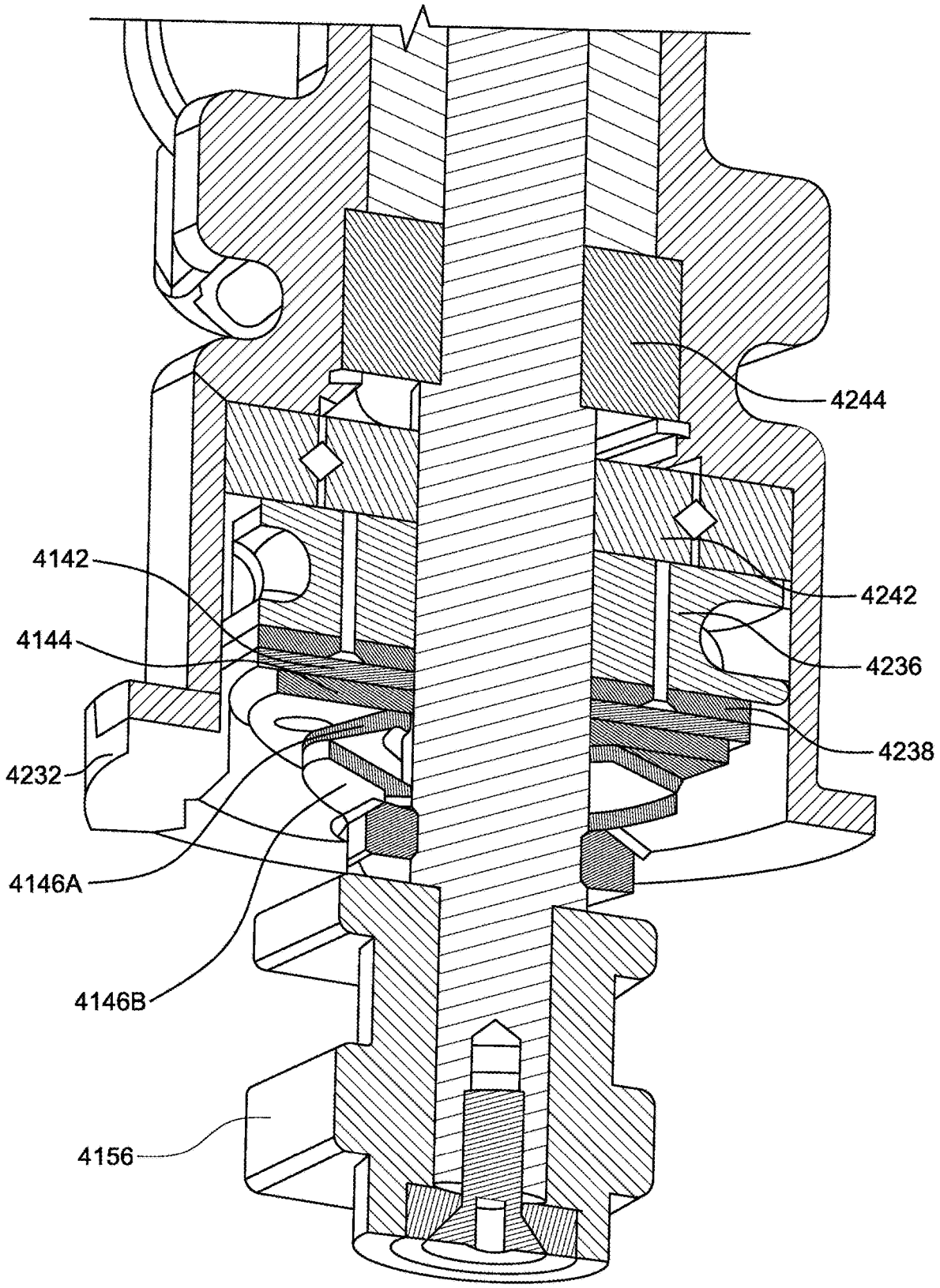
FIG. 4G is a cross-sectional side view of bottom portion of the mandrel of FIG. 4A.
Figure 4H:
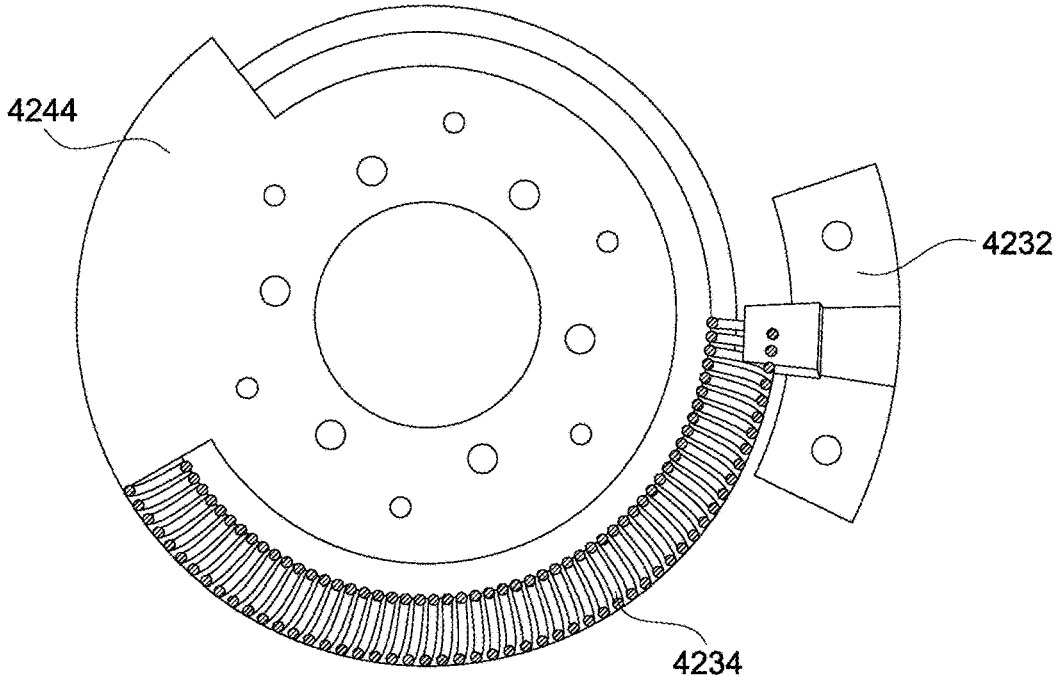
FIGS. 4H, 4I, 4J, 4K, and 4L are cross-sectional plan views of the spring housing of the mandrel of FIG. 4A at various stages of film application.

FIG. 4H illustrates the rotation stopper 4232, tension spring 4234, and spring housing 4236 at rest. The film roll can be mounted on the mandrel in this rest state. No external rotational force is applied. In this state, the spring housing 4236 is held in place and prevented from rotating by the rotary clutch disc 4238. The tension spring 4234 is in equilibrium, forcing the rotation stopper 4232 to the rest position as shown in FIG. 4H.

Figure 4I:
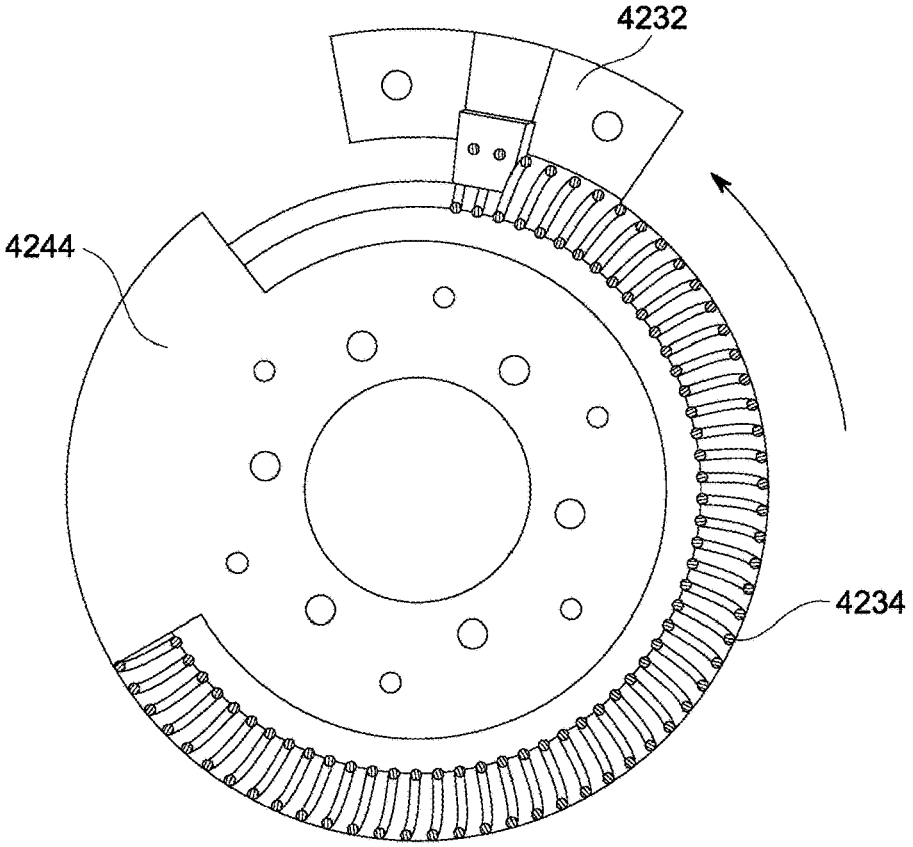

FIG. 4I illustrates the position of the rotation stopper 4232 after the rotation stopper 4232 has rotated counterclockwise. The counterclockwise rotation of the rotation stopper 4232 is caused by the film being pulled off the film roll as the film is wrapped around a coil. As seen in FIG. 4I, the spring housing 4236 remains stationary, while the tension spring 4234 and the rotation stopper 4232 extend and move in the counterclockwise direction in response to the external torque.

Figure 4J:
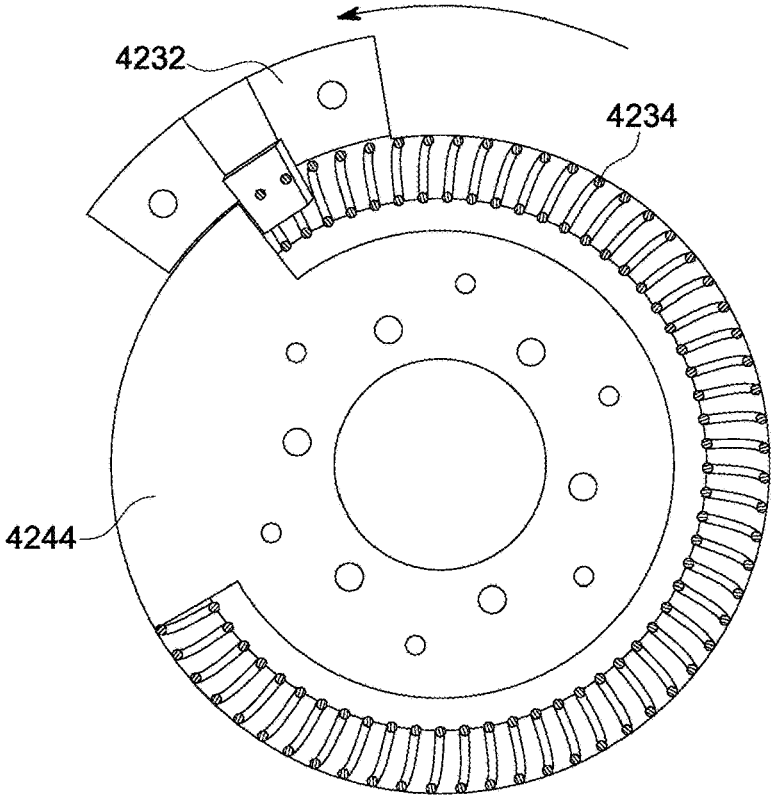

FIG. 4J illustrates the position of the rotation stopper 4232 when the external torque continues to be applied. The rotation stopper 4232 reaches the end of the spring housing 4236, causing the rotation stopper 4232 to stop moving. The spring housing 4236 is still held stationary by the rotary clutch disc 4238.

Figure 4K:
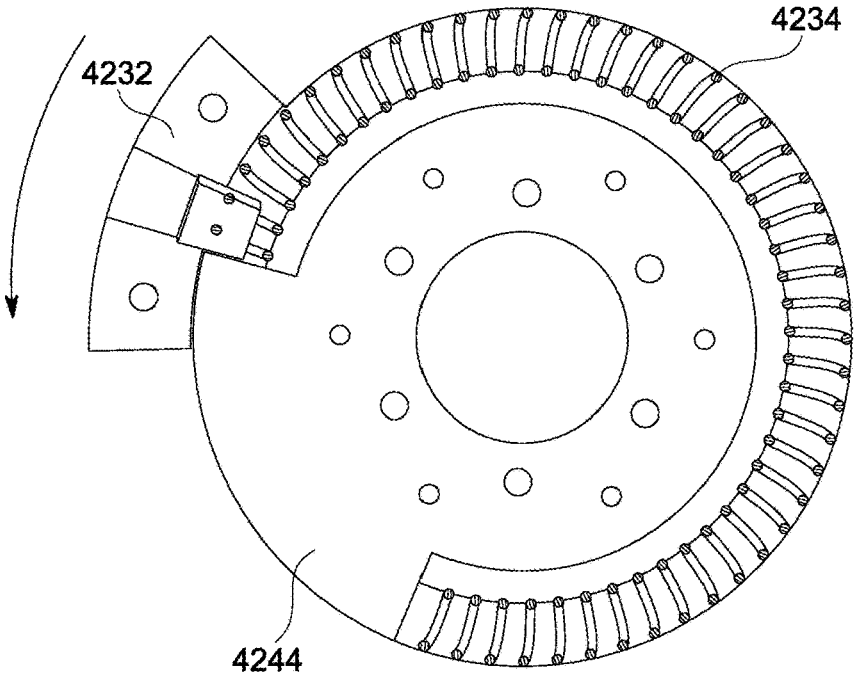

FIG. 4K illustrates the position of the rotation stopper 4232, tension spring 4234, and spring housing 4236 when the external torque continues to be applied after the rotation stopper 4232 has reached the end of the spring housing 4236. The spring housing 4236 begins to rotate counterclockwise. The rotation stopper 4232 remains in contact with the end of the spring housing 4236, and the tension spring 4234 remains fully extended. Rather than causing the rotation stopper 4232 and the tension spring 4234 to continue to extend, the external torque causes the spring housing 4236, tension spring 4234, and rotation stopper 4232 to all simultaneously rotate counterclockwise.

During the process of wrapping a coil, the positioning of the film roll with respect to the coil follows a path that causes the force on the film roll to be inconsistent. For example, when the film roll moves from wrapping the outer side of the coil to wrapping the surface that forms the eye of the coil, the path taken by the film roll causes slack to be introduced in the film that has been pulled off the film roll. To ensure that a consistent tension is applied to the film roll, the mandrel is configured to rotate clockwise to re-roll the slack film (i.e., rotate opposite the direction that causes film to be pulled off the film roll).

Figure 4L:
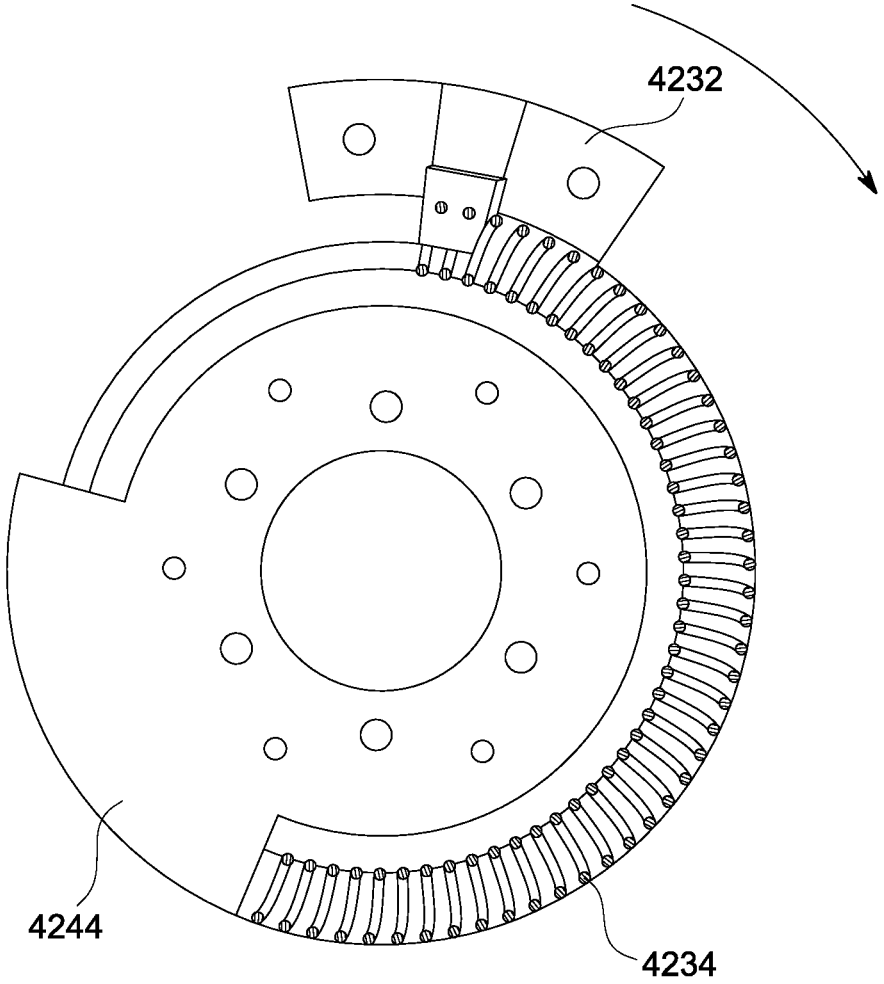

FIG. 4L illustrates the position of the rotation stopper 4232, tension spring 4234, and spring housing 4236 after the external torque has reduced and the film has gone slack. The spring housing 4236 remains in the same position as shown in FIG. 4K, held in place by the rotary clutch disc 4238. The tension spring 4234 pulls the rotation stopper 4232 in the clockwise direction. Clockwise rotation of the rotation stopper 4232 causes the outer mandrel body 4220 to also rotate in a clockwise direction, thereby re-rolling the slack film onto the film roll.

In this example, the tension spring 4234 has a spring constant that results in a threshold force that must be overcome to extend the tension spring. The rotary clutch disc 4238 also has a threshold torque that must be applied to cause the spring housing 4236 to rotate. In this example, the rotary clutch disc torque is greater than the spring force. As a result, the external torque caused by the film being pulled off the film roll first overcomes the spring force and causes the spring to extend, and then over overcomes the rotary clutch disc 4238 torque and causes the spring housing 4236 to rotate.

In certain examples, the travel distance of the tension spring 4234 can be approximately 90-100 degrees of rotation around the spring housing 4236. This rotation enables approximately 90-100 degrees of clockwise rotation (i.e., 90-100 degrees of re-rolling the slack film back onto the film roll).

Mandrel Grippers

Each mandrel gripper 5000 is connected to the respective frame of the respective applicator arm (such as frame 132 of applicator arm 130) and configured to hold and release a mandrel such as the mandrel 4000 described above and on which a film roll is mounted. The grippers can be alternatively configured in accordance with the present disclosure.

Figure 5A:
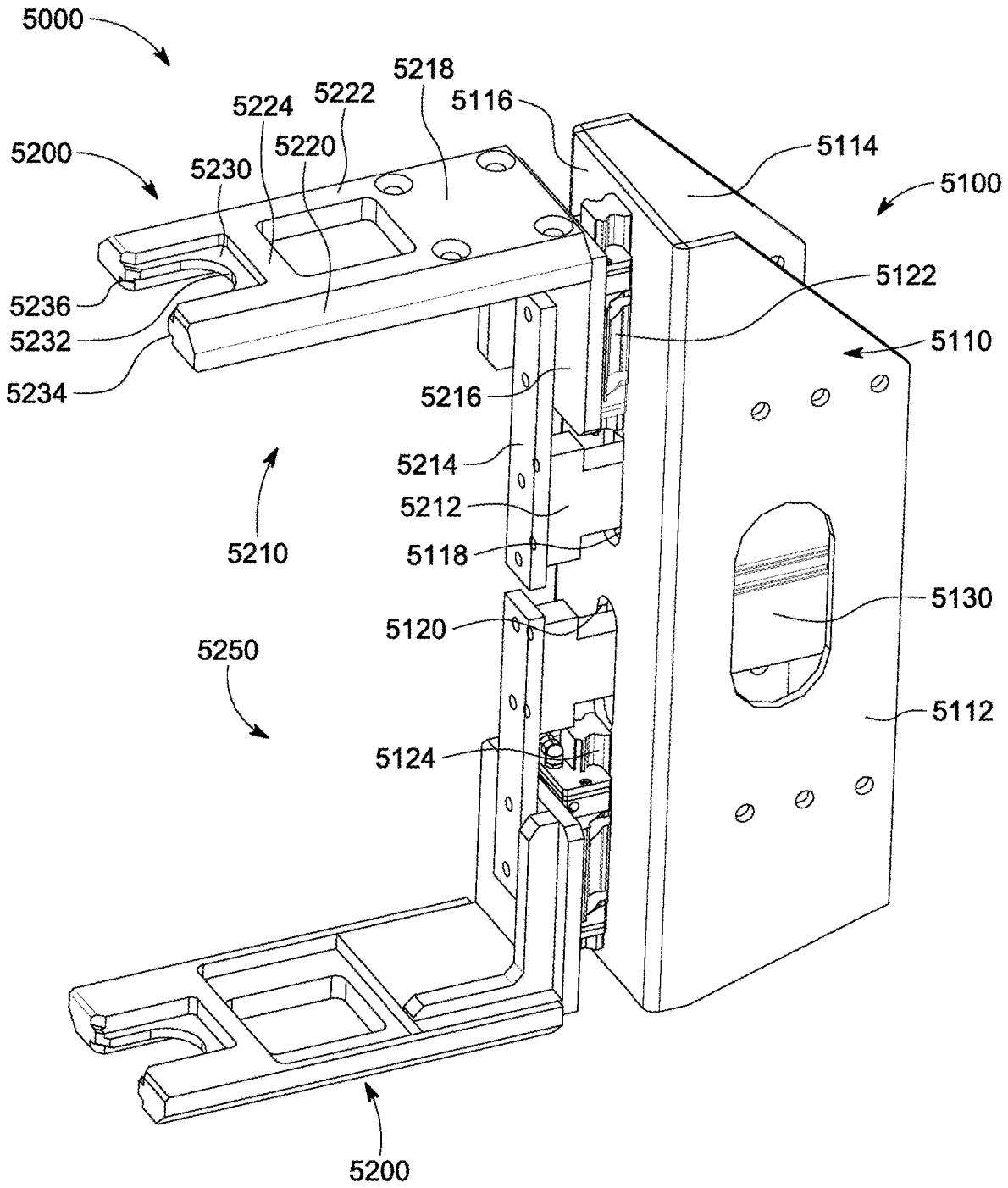
FIG. 5A is an enlarged perspective view of a mandrel gripper of the coil-wrapping system of FIG. 1A.
Figure 5C:
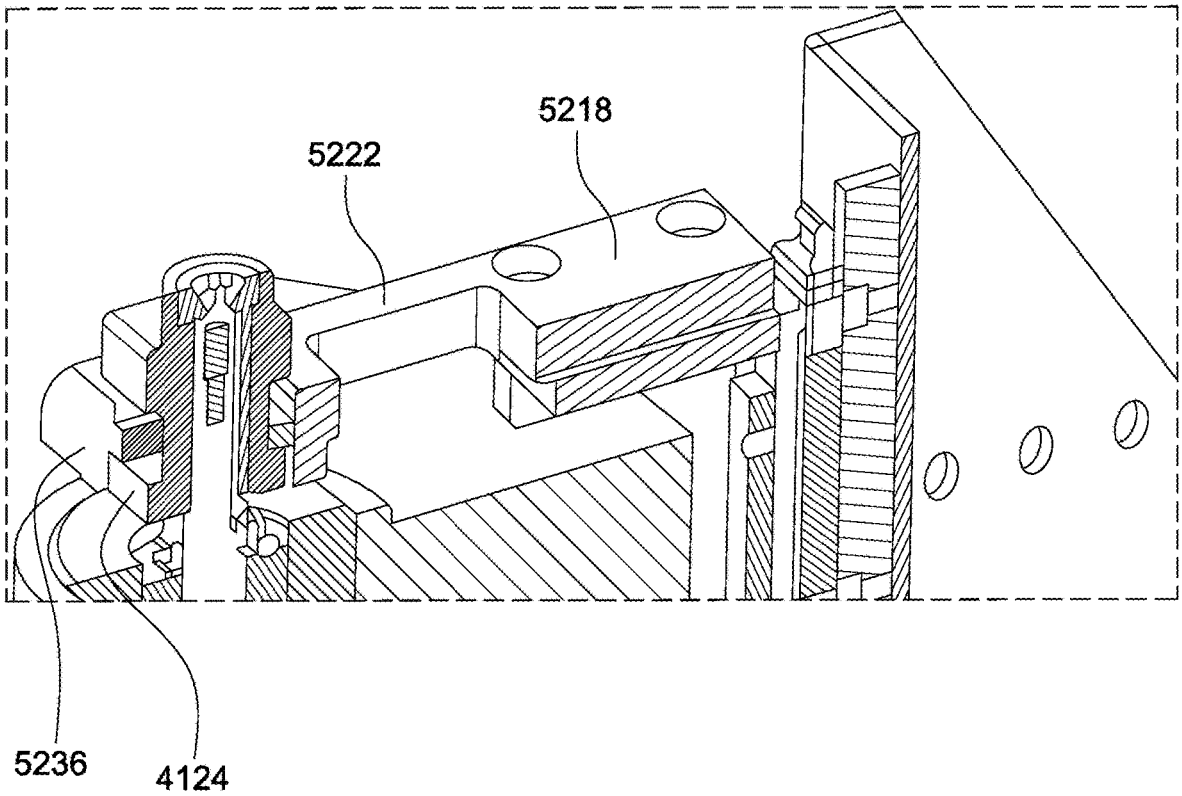
FIG. 5C is a cross-sectional perspective view of part of the upper mandrel claw of the mandrel gripper of FIG. 5A holding a film roll that is mounted on a mandrel of FIG. 4A taken partially along line 5C-5C of FIG. 5D.
Figure 5D:
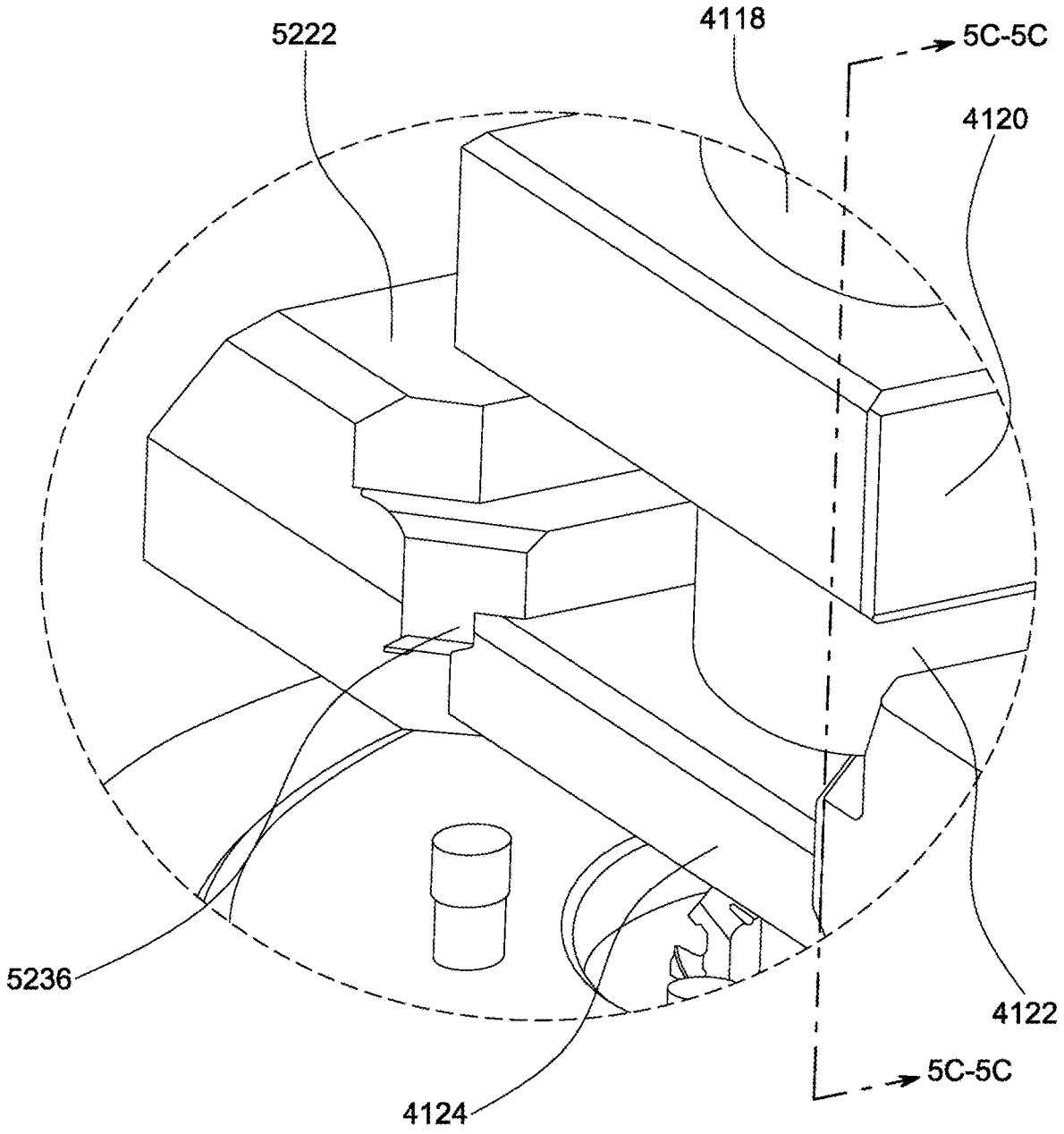
FIG. 5D is a fragmentary view of part of the upper mandrel claw of the mandrel gripper of FIG. 5A holding a film roll mounted on a mandrel of FIG. 4A.
Figure 6:
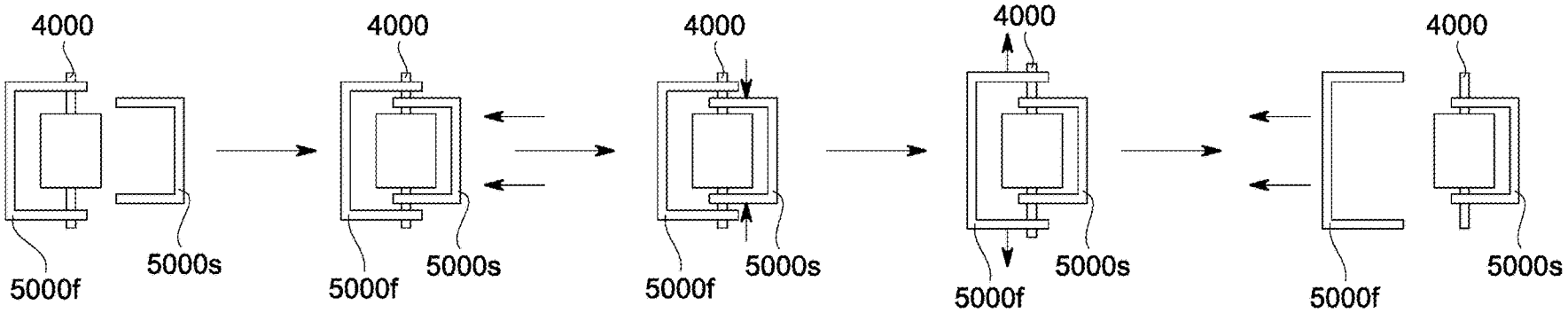
FIG. 6 are diagrammatic views of two mandrel grippers of the coil-wrapping system of FIG. 1 and showing a film roll mounted on a mandrel being transferred from one of the mandrel grippers to the other mandrel gripper.

FIGS. 5A, 5C, and 5D illustrate mandrel gripper 5000 of one example embodiment of the present disclosure configured to receive, hold, and release a mandrel such as mandrel 4000. FIG. 6 illustrates a transfer of a mandrel 4000 (and film roll thereon) from a first mandrel gripper 5000 to a second mandrel gripper 5000, as further described below.

The mandrel gripper 5000 includes a base 5100, an actuator 5130 attached to the base 5100, and a mandrel engager 5200. The base 5100 is sized, shaped, positioned, oriented, and otherwise configured to be connected to a respective frame of a respective applicator arm such that the applicator arm can move the mandrel gripper 5000 as needed to perform the various functions described herein. The mandrel engager 5200 includes an upper mandrel claw 5210 and a lower mandrel claw 5250 that, under control of the controller, co-act to grip a mandrel such as mandrel 4000 described above.

More specifically, the base 5100 includes an arm connection bracket 5110.

The arm connection bracket 5110 includes: a first side panel 5112, a second side panel 5114, and a center panel 5116. The first side panel 5112 and the second side panel 5114 are each sized, shaped, positioned, oriented, and otherwise configured to be connected to the respective frame of the respective applicator arm that moves the mandrel gripper 5000. The first side panel 5112 and the second side panel 5114 are parallel to each other, and are also each connected to the center panel 5116.

The center panel 5116 defines an upper mandrel claw opening 5118, a lower mandrel claw opening 5120, and includes an upper mandrel claw track 5122 and a lower mandrel claw track 5124. The upper mandrel claw opening 5118 and the lower mandrel claw opening 5120 are each elongated openings extending in a direction of movement of the upper mandrel claw 5210 and lower mandrel claw 5250 during operation. The upper mandrel claw opening 5118 and the lower mandrel claw opening 5120 enable part of the upper mandrel claw 5210 and the lower mandrel claw 5250 respectively to extend therethrough for operable connection to the actuator 5130, as described below. The upper mandrel claw track 5122 and the lower mandrel claw track 5124 are positioned above and below the upper mandrel claw opening 5118 and the lower mandrel claw opening 5120 respectively, as best shown in FIG. 5A. The upper mandrel claw track 5122 is sized, shaped, positioned, oriented, and otherwise configured to engage the track engaging support member 5216 of the upper mandrel claw 5210. Similarly, the lower mandrel claw track 5124 is sized, shaped, positioned, oriented, and otherwise configured to engage the track engaging support member of the lower mandrel claw 5250.

In the illustrated Figures, the actuator 5130 is attached to the base 5100, and is positioned between the first side panel 5112 and the second side panel 5114, on a side of the center panel 5116 opposite the mandrel engager 5200. Alternatively, the actuator 5130 can be attached to the applicator arm, or another component. The actuator 5130 operably engages and enables movement of the upper mandrel claw 5210 and the lower mandrel claw 5250. The actuator 5130 enables the upper mandrel claw 5210 and the lower mandrel claw 5250 to maintain central positioning in an upright direction, such that a vertical center point between the upper mandrel claw 5210 and the lower mandrel claw 5250 remains constant. The actuator 5130 enables mirrored movement of the upper mandrel claw 5210 and the lower mandrel claw 5250, such that the claws either move apart from each other or toward each other.

The upper mandrel claw 5210 and the lower mandrel claw 5250 are similar or identical mirrored images of each other. Thus, only the upper mandrel claw 5210 is described in detail herein for brevity.

The upper mandrel claw 5210 includes: an actuator engager arm 5212, a vertical support bracket 5214, a track engaging support member 5216, and a lateral mandrel engaging member 5218.

The actuator engager arm 5212 extends through the upper mandrel claw opening 5118, and is sized, shaped, positioned, oriented, and otherwise configured to engage the actuator 5130 at a first end of the actuator engager arm 5212. A second end of the actuator engager arm 5212 is connected to the vertical support bracket 5214. The vertical support bracket 5214 is connected on a first end to the actuator engager arm 5212. The vertical support bracket 5214 extends upwardly, and on a second end is connected to the track engaging support member 5216.

The track engaging support member 5216 is sized, shaped, positioned, oriented, and otherwise configured to engage the upper mandrel claw track 5122, which together provide lateral support to the upper mandrel claw 5210. The track engaging support member 5216 and upper mandrel claw track 5122 also enable smooth movement of the upper mandrel claw 5210 in a vertical direction. The track engaging support member 5216 is also connected to the lateral mandrel engaging member 5218.

The lateral mandrel engaging member 5218 includes: a first finger 5220, a second finger 5222, a finger connection bar 5224, and a U-shaped mandrel engager 5230. The first finger 5220 and the second finger 5222 are shaped and sized to engage one of the outer handle block 4120 or the inner handle block 5124 of the mandrel 4000. The finger connection bar 5224 extends between and connects the first finger 220 to the second finger 5222.

The U-shaped mandrel engager 5230 extends inward from the first finger 5220 and the second finger 5222. The U-shaped mandrel engager 5230 is positioned such that the open end of the U-shape is oriented away from the base 5100. The U-shaped mandrel engager includes a mandrel facing surface 5232, a first handle locking catch 5234, and a second handle locking catch 5236. The mandrel facing surface 5232 extends along the inner side of the U-shaped mandrel engager 5230, and is sized, shaped, positioned, oriented, and otherwise configured to engage the outer handle cylinder 4118 or the inner handle cylinder 4122 of the mandrel 4000. The first handle locking catch 5234 and the second handle locking catch 5235 are positioned on the underside of the U-shaped mandrel engager 5230 proximate the first finger 5220 and the second finger 5222 respectively. The first handle locking catch 5234 and the second handle locking catch 5236 are both sized, shaped, positioned, oriented, and otherwise configured to engage/receive either the outer handle block 4120 or the inner handle block 4124 when the mandrel 4000 is positioned such that it is held by the gripper 5000.

To move the upper mandrel claw 5210 and the lower mandrel claw 5250, the actuator 5130 actuates both claws at the same time and in opposite directions. To move the claws apart, the actuator actuates in a first direction, causing the upper mandrel claw 5210 to move upward, and simultaneously causing the lower mandrel claw 5250 to move downward. To move the claws together, the actuator actuates in a second direction opposite the first direction, causing the upper mandrel claw 5210 to move downward, and simultaneously causing the lower mandrel claw 5250 to move upward. The actuator can include a piston or other mechanism configured to cause the claws to move as indicated herein.

Operation of the Mandrel Grippers

When operating the gripper 5000, the upper mandrel claw 5210 and the lower mandrel claw 5250 are each sized, shaped, positioned, oriented, and otherwise configured to respectively engage the top handle 4116 and the bottom handle 4156 of the mandrel 4000. As described above, the top handle 4116 and bottom handle 4156 each include an inner handle block and an outer handle block. Each mandrel claw can engage one of the two handle blocks at a time (i.e., either the inner handle block or the outer handle block). Thus, there are several combinations of engagement by the upper mandrel claw 5210 and the lower mandrel claw 5250 with the handle blocks of the mandrel 4000. These combinations include: (i) the upper mandrel claw 5210 engaging the outer handle block 4120 and the lower mandrel claw 5250 engaging the corresponding outer handle block of the bottom handle 4156, (ii) the upper mandrel claw 5210 engaging the inner handle block 4124 and the lower mandrel claw 5250 engaging the corresponding inner handle block of the bottom handle 4156, (iii) the upper mandrel claw 5210 engaging the outer handle block 4120 and the lower mandrel claw 5250 engaging the inner handle block of the bottom handle 4156, and (iv) the upper mandrel claw 5210 engaging the inner handle block 4124 and the lower mandrel claw 5250 engaging the outer handle block of the bottom handle 4156.

The mandrel gripper 5000 thus enables several actions to be performed, including receiving a mandrel 4000 and a film roll mounted thereon, transferring a mandrel and the film roll thereon to another mandrel gripper 5000, and removing a mandrel and film roll thereon from the mandrel gripper 5000.

More specifically, although each of the combinations of engagement between the upper mandrel claw 5210 and lower mandrel claw 5250 with the outer handle blocks and inner handle blocks of the mandrel can occur, only engagement of the upper mandrel claw 5210 and lower mandrel claw 5250 with the respective outer handle blocks of the mandrel 4000 is described below for brevity.

As an initial step, the actuator 5130 is activated by the controller, thereby causing the upper mandrel claw 5210 and the lower mandrel claw 5250 to move apart in opposing directions.

The mandrel gripper 5000 is moved into position with respect to the mandrel 4000, such that the top handle 4116 and bottom handle 4156 of the mandrel 4000 are positioned between the first and second fingers of the upper mandrel claw 5210 and lower mandrel claw 5250 respectively.

The mandrel facing surface 5232 of the U-shaped mandrel engager 5230 of the upper mandrel claw 5210 is sized, shaped, positioned, oriented, and otherwise configured to engage the outer handle cylinder 4118 of the top handle 4116, and mirrored engagement occurs for the corresponding U-shaped mandrel engager of the lower mandrel claw 5250 with the outer handle cylinder of the bottom handle 4156.

The actuator 5130 is activated again by the controller, causing the upper mandrel claw 5210 and the lower mandrel claw 5250 to move toward each other. Movement of the upper mandrel claw 5210 and the lower mandrel claw 5250 continues until the first handle locking catch 5234 and the second handle locking catch 5236 of the upper mandrel claw 5210 receive and engage the outer handle block 4120 of the top handle 4116. On the bottom side, similar engagement occurs between the first handle locking catch and second handle locking catch of the lower mandrel claw 5250 with the outer handle block of the bottom handle 4156.

The mandrel 4000 is then locked into the mandrel gripper 5000. The first handle locking catch 5234 and the second handle locking catch 5236 engage the outside surface of the outer handle block 4120 (e.g., the surface facing away from the gripper 5000), thereby preventing the mandrel 4000 and film roll thereon from being dislodged from the mandrel gripper 5000 without the claws moving away from one another. The tolerances and geometry of the first handle locking catch 5234, the second handle locking catch 5236, and the handle of the mandrel 4000 positioned therebetween prevent rotation of the handle of the mandrel 4000, prevent rotation of the inner mandrel assembly 4100 of the mandrel 4000 (by preventing rotation of the handle), and prevent the mandrel 4000 from pivoting or tilting during operation.

Although each of the combinations of engagement between the upper mandrel claw 5210 and lower mandrel claw 5250 with the outer handle blocks and inner handle blocks of the mandrel can occur, only a transfer of the mandrel from a first mandrel gripper engaged with the respective outer handle blocks to a second mandrel gripper engaged with the respective inner handle blocks is now described herein for brevity with respect to FIG. 6.

At an initial state, a first mandrel gripper 5000F engages the respective outer handle blocks of the top handle 4116 and the bottom handle 4156 of the mandrel 4000. At this point, the mandrel gripper 5000 has sole control over the mandrel 4000.

The actuator of a second mandrel gripper 5000S is then activated by the controller CR to cause the upper mandrel claw and lower mandrel claw thereof to move apart, such that they are spaced apart appropriately to engage the inner handle blocks of the mandrel 4000.

The second mandrel gripper 5000S is moved into position around the mandrel 4000 such that the top handle 4116 and the bottom handle 4156 of the mandrel 4000 are positioned between the first and second fingers of the upper mandrel claw 5210 and lower mandrel claw 5250 of the second mandrel gripper 5000S respectively.

The mandrel facing surface 5232 of the upper mandrel claw of the second mandrel gripper 5000S engages the inner handle cylinder 4122 of the mandrel 4000, and a mirrored engagement of the U-shaped mandrel engager of the lower mandrel claw of the second mandrel gripper 5000S with the inner handle cylinder of the bottom handle 4156 occurs.

The actuator of the second mandrel gripper 5000S is then activated by the controller CR, causing the upper mandrel claw and the lower mandrel claw of the second mandrel gripper 5000S to move toward each other. This movement continues until both the first handle locking catch and the second handle locking catch of the upper mandrel claw of the second mandrel gripper 5000S engage the inner handle block 4120 of the top handle 4116, and the first handle locking catch and the second handle locking catch of the lower mandrel claw of the second mandrel gripper 5000S engage the inner handle block of the bottom handle 4156. The first handle locking catch and the second handle locking catch of the gripper engage the inner handle block 4120 such that the mandrel is locked in place to the second mandrel gripper 5000S.

At this point in the transfer process, both the first mandrel gripper 5000F and the second mandrel gripper 5000S are engaged with the mandrel holding the film roll. To complete the transfer to the second mandrel gripper 5000S, the actuator of the first mandrel gripper 5000F is then activated by the controller CF to move the upper mandrel claw and the lower mandrel claw of the first mandrel gripper 5000F out of engagement with the outer handle blocks of the mandrel 4000. The second mandrel gripper 5000S then has sole control of the mandrel 4000.

Sensors

The coil-wrapping system 20 includes a plurality of sensors S configured to sense various states of the coil-wrapping system 20, positions of the components of the coil-wrapping system 20, the amount of remaining film on each film roll held by the grippers of the applicator arms. The sensors S are communicatively connected to the controller CR. The sensors S can be any suitable sensors.

Operator Interface

The coil-wrapping system 20 includes an operator interface OI configured to receive inputs from an operator and, in certain embodiments, to output information to the operator. The operator interface OI includes one or more input devices configured to receive inputs from the operator. In various embodiments, the one or more input devices include one or more buttons (such as hard or soft keys), one or more switches, and/or a touch panel. In various embodiments, the operator interface OI includes a display device configured to display information to the operator, such as information about the coil, the status of the wrapping operation, or the settings of the coil-wrapping system 200. The operator interface can include other output devices instead of or in addition to the display device, such as one or more speakers and/or one or more lights. In certain embodiments, the operator interface is formed as part of the coil-wrapping system 20 and is, for instance, mounted to the machine frame 60. In other embodiments, the operator interface is remote from the frame 60.

Controller

The coil-wrapping system 20 includes a controller CR including a processing device communicatively connected to a memory device. The processing device can include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device can include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the coil-wrapping system 10 (such as to carry out the coil moving processes, coil rotating processes, carriage moving processes, film supply roll loading processes, coil wrapping processes, and film roll unloading described herein). The controller CR is communicatively and operably connected to the operator interface OI, the plurality of sensors S, the actuators that move the first wrapping carriage 100 and the components thereof, the second wrapping carriage 300 and the components thereof, the coil rotator 500, the first replacement-film-roll holder 600, the first empty-film-roll holder 800, the components of the first replacement-film-roll supplier 900, the components of the first empty-film-roll remover 1000, the second replacement-film-roll holder 1600, the second empty-film-roll holder 1800, the components of the second film-roll supplier 1900, the components of second empty-film-roll remover 2000, and the infeed and out feed coil movers 550 and 560.

We claim:

1. A coil-wrapping apparatus comprising:

a machine frame;

a first wrapper supported by the machine frame and comprising first and second applicator arms;

a second wrapper supported by the machine frame opposite the first wrapper and comprising third and fourth applicator arms, wherein a coil-wrapping area is defined between the first and second wrappers; and a controller operably connected to the first and second wrappers and configured to cause the first and second wrappers to simultaneously use first and second film rolls to simultaneously wrap first and second films from the first and second film rolls onto a coil positioned in the coil-wrapping area while the coil is rotated about a longitudinal axis of the coil by:

causing the first and fourth applicator arms to move the first film roll through an eye of the coil and around an outer surface of the coil in multiple loops to wrap the first film onto the coil; and causing the second and third applicator arms to move the second film roll through the eye of the coil and around the outer surface of the coil in multiple loops to wrap the second film onto the coil.

2. The coil-wrapping apparatus of claim 1, wherein the first wrapper is vertically movable relative to the machine frame to a raised position so the coil can be moved under the first wrapper and into the coil wrapping area.

3. The coil-wrapping system of claim 1, wherein the second wrapper is vertically movable relative to the machine frame to a raised position so after the coil is wrapped the coil can be moved under the second wrapper and out of the coil wrapping area.

4. The coil-wrapping apparatus of claim 1, wherein each loop of the first film roll comprises a generally rectangular path, wherein each loop of the second film roll comprises a generally rectangular path.

5. The coil-wrapping apparatus of claim 4, wherein when one of the first and second film rolls is inside the eye of the coil the other of the first and second film rolls is outside the eye of the coil.

6. The coil-wrapping apparatus of claim 1, wherein the controller is configured to cause the first and second wrappers to move the first and second film rolls together in the longitudinal direction during wrapping.

7. The coil-wrapping apparatus of claim 1, wherein the controller is configured to cause the first and second wrappers to move the first and second film rolls so their spacing in a transverse direction stays substantially the same during wrapping.

8. The coil-wrapping apparatus of claim 7, wherein the controller is configured to cause the first and second wrappers to move the first and second film rolls together in the longitudinal direction during wrapping.

9. The coil-wrapping apparatus of claim 1, wherein the controller is configured to cause the first and fourth applicator arms to, during one of the loops of the first film roll:

while the first applicator arm holds the first film roll and while the first and fourth applicator arms are generally aligned with the longitudinal axis of the coil, move the first and fourth applicator arms into the eye of the coil and toward one another to apply the first film to a portion of the inner surface of the coil;

transfer the first film roll to the fourth applicator arm within the eye of the coil;

move the first and fourth applicator arms away from one another and out of the eye of the coil to apply the first film to another portion of the inner surface of the coil;

move the first and fourth applicator arms in a transverse direction to apply the first film to a portion of a first side surface of the coil;

move the first and fourth applicator arms toward one another to apply the first film to a portion of the outer surface of the coil;

transfer the first film roll to the first applicator arm;

move the first and fourth applicator arms away from one another to apply the first film to another portion of the outer surface of the coil; and move the first and fourth applicator arms in the transverse direction until the first and fourth applicator arms are generally aligned with the longitudinal axis of the coil to apply the first film to a portion of a second side surface of the coil.

10. The coil-wrapping apparatus of claim 9, wherein the controller is configured to cause the second and third applicator arms to, during one of the loops of the second film roll:

while the second applicator arm holds the second film roll and while the second and third applicator arms are spaced transversely from the longitudinal axis of the coil, move the second and third applicator arms toward one another to apply the second film to a portion of the outer surface of the coil;

transfer the second film roll to the third applicator arm;

move the second and third applicator arms away from one another to apply the second film to another portion of the outer surface of the coil;

move the second and third applicator arms in the transverse direction until the second and third applicator arms are generally aligned with the longitudinal axis of the coil to apply the second film to a portion of the first side surface of the coil;

move the second and third applicator arms into the eye of the coil and toward one another to apply the second film to a portion of the inner surface of the coil;

transfer the second film roll to the second applicator arm within the eye of the coil;

move the second and third applicator arms away from one another and out of the eye of the coil to apply the second film to another portion of the inner surface of the coil;

move the second and third applicator arms in a transverse direction to apply the second film to a portion of the second side surface of the coil.

11. The coil-wrapping apparatus of claim 1, further comprising a coil rotator positioned in the coil wrapping area, wherein the controller is operably connected to the coil rotator and configured to cause the coil rotator to rotate the coil about its longitudinal axis.

12. A method of wrapping a coil with first film from a first film roll and second film from a second film roll, the method comprising:

rotating the coil about a longitudinal axis of the coil; and while the coil is rotating about its longitudinal axis, simultaneously using the first and second film rolls to wrap the first and second films onto the coil by simultaneously:

moving the first film roll through an eye of the coil and around an outer surface of the coil in multiple loops to wrap the first film onto the coil by periodically transferring the first film roll between a first applicator arm and a fourth applicator arm; and moving the second film roll through the eye of the coil and around the outer surface of the coil in multiple loops to wrap the second film onto the coil by periodically transferring the second film roll between a second applicator arm and a third applicator arm.

13. The method of claim 12, wherein each loop of the first film roll comprises a generally rectangular path, wherein each loop of the second film roll comprises a generally rectangular path.

* * * * *